US005950052A

United States Patent [19]

Nomura et al.

[11] Patent Number: 5,950,052

[45] Date of Patent: Sep. 7, 1999

[54] IMAGE FORMING APPARATUS

[75] Inventors: Yujiro Nomura; Akira Kubota; Tahei Ishiwatari; Kuniaki Tanaka; Tomoe Aruga, all of Nagano, Japan

[73] Assignee: Seiko Epson Corporation, Tokyo, Japan

[21] Appl. No.: 08/928,672

[22] Filed: Sep. 12, 1997

[30] Foreign Application Priority Data

| | | | |
|---|---|---|---|
| Sep. 17, 1996 | [JP] | Japan | 8-245354 |
| Sep. 17, 1996 | [JP] | Japan | 8-245355 |
| Oct. 8, 1996 | [JP] | Japan | 8-267560 |
| Nov. 19, 1996 | [JP] | Japan | 8-308393 |

[51] Int. Cl.[6] ..... G03G 15/00; G03G 15/01

[52] U.S. Cl. ..... 399/167; 399/301; 399/302

[58] Field of Search ..... 399/167, 301, 399/302, 308, 140, 298, 117

[56] References Cited

U.S. PATENT DOCUMENTS

| | | | |
|---|---|---|---|
| 5,357,325 | 10/1994 | Kawaguchi | 355/277 |
| 5,585,898 | 12/1996 | Fujii | 399/228 |
| 5,631,726 | 5/1997 | Sawada | 399/111 |
| 5,678,144 | 10/1997 | Osaki et al. | 399/167 |
| 5,740,503 | 4/1998 | Nakamura | 399/167 |
| 5,761,580 | 9/1996 | Harada et al. | 399/167 |
| 5,798,656 | 12/1996 | Nagasue et al. | 399/75 |

FOREIGN PATENT DOCUMENTS

| | | | |
|---|---|---|---|
| 61-95370 | 5/1986 | Japan | G03G 15/01 |
| 62-264067 | 11/1987 | Japan | G03G 15/00 |
| 63-11965 | 1/1988 | Japan | G03G 15/01 |
| 1-134475 | 5/1989 | Japan | G03G 15/01 |
| 3-249765 | 11/1991 | Japan | G03G 15/00 |
| 4-204859 | 7/1992 | Japan | G03G 15/00 |
| 5-289536 | 11/1993 | Japan | G03G 15/16 |
| 7-199768 | 8/1995 | Japan | G03G 21/16 |

*Primary Examiner*—Richard Moses
*Assistant Examiner*—Shival Virmani
*Attorney, Agent, or Firm*—Sughrue, Mion, Zinn, MacPeak & Seas, PLLC

[57] ABSTRACT

The present invention provides an electrophotographic image forming apparatus capable of forming a high quality image by eliminating an expansion/contraction, displacement in color or nonuniformity of color of the image formed on a transfer member. An image carrier gear for driving an image carrier is driven by a driving means gear at an image carrier driving position and transmits driving force to conveying force transmitting gear at a transfer driving position. The conveying force transmitting gear transmits conveying force to the transfer member. A time during which the image carrier moves from a latent image forming position to a transferring position is made substantially equal to a time during which the image carrier gear moves from an image carrier driving position to a transfer driving position.

42 Claims, 37 Drawing Sheets

IMAGE FORMING APPARATUS

BACKGROUND OF THE INVENTION

The present invention relates to an electrophotographic image forming apparatus for use in a copying machine, a printer, a facsimile and other machines and more particularly to a method for driving an image carrier and a transfer member of the image forming apparatus.

Hitherto, an image is formed by an electrophotographic image forming apparatus by forming a latent image on an image carrier by using latent image forming means and by transferring the image developed by developing means to a transfer member. However, such image forming apparatus has had a problem that the image may be expanded/contracted due to nonuniformity of speed of the image carrier.

In order to deal with such a problem, there have been proposed various methods for suppressing the nonuniformity of speed of the image carrier. Japanese Patent Application Laid-Open No. Hei. 4-204859 has proposed a method of suppressing the nonuniformity of speed of the image carrier by detecting a peripheral speed of the image carrier and by modulating a driving speed of a driving source corresponding to the detected peripheral speed.

Japanese Patent Application Laid-Open Nos. 62-264067 and 63-11965 have also proposed methods of suppressing the expansion/contraction of the image by arranging so that a time during which the image carrier moves from a position where a latent image is formed thereon by latent image forming means to a position where the image on the image carrier is transferred to a transfer member is integer times of a cycle of nonuniformity of speed of a driving source or an image carrier driving member to cancel the nonuniformity of speed of the driving source and the image carrier driving member in writing the latent image and transferring the image.

However, the method proposed in Japanese Patent Application Laid-Open No. Hei. 4-204859 described above has had a problem that it requires a high precision speed detector for detecting the peripheral speed of the delicate image carrier and an expensive feedback circuit for controlling the driving source based on the detected result and that a low inertial image carrier has to be realized in order to realize quickly response in controlling the speed, increasing the cost of the image forming apparatus.

Further, the methods proposed in Japanese Patent Application Laid-Open Nos. 62-264067 and 63-11965 have had a problem that although the nonuniformity of speed of the driving source for driving the image carrier and the drive transmitting means may be canceled, the nonuniformity of speed caused by eccentricity and geometrical error of the image carrier driving member which operates along with the image carrier such as a gear attached to the image carrier cannot be canceled. They also have had a problem that because the nonuniformity of speed of the image carrier is directly influenced by the nonuniformity of speed caused by the image carrier driving member which operates along with the image carrier, the image carrier driving member which operates along with the image carrier has to be mounted with extremely high precision or has to have an extremely high precision profile.

Further, when the image forming apparatus is equipped with a plurality of developing means to form a color image by transferring an image on the image carrier to a transfer member by laying one after another, the nonuniformity of speed of the image carrier affects the image quality not only as the expanded/contracted image but also as displacement in color or nonuniformity of color. When the nonuniformity of speed is the same, people have a much higher visual sensitivity to the displacement in color or the nonuniformity of color than that to the expansion/contraction of an image in general. Therefore, the image carrier used in the image forming apparatus for forming color images is required to be driven with extremely high precision.

In order to prevent the speed variation caused by the backlash between the driving gears, there has been one disclosed in Japanese Patent Application Laid-Open No. Hei. 5-289536 for example. The publication No. Hei. 5-289536 discloses a mechanism arranged such that drive is transmitted from a gear for driving an intermediate transfer belt to a gear for driving a photoreceptor belt and a peripheral speed of the photoreceptor belt is slightly faster than that of the intermediate transfer belt. It is intended to transmit driving force stably by arranging so that the gear for driving the photoreceptor belt engages with the gear for driving the intermediate transfer belt always in a certain direction by causing frictional force produced between the photoreceptor belt and the intermediate transfer belt to act as a load.

Further, in the publication described above, a driving roller for driving the intermediate transfer belt is disposed, with respect to the direction in which the intermediate transfer belt is conveyed, on the upstream side of a primary transfer position where a toner image on the photoreceptor belt is transferred to the intermediate transfer belt, and the intermediate transfer belt is wound in circular arc around the photoreceptor at the primary transfer position.

In the arrangement described above, however, the frictional force at the primary transfer position is not stable due to the variation of quantity of toner adhering on the photoreceptor belt and the intermediate transfer belt and to the variation of surface potential of the photoreceptor belt and the intermediate transfer belt. Still more, because the primary transfer position is located on the side where the intermediate transfer belt is pushed out from its driving roller (on the so-called loose side), there has been a problem that not only the speed of the intermediate transfer belt but also an angle of abutment of the intermediate transfer belt before and after the primary transfer position vary due to the variation of the frictional force at the primary transfer position, causing deterioration of image such as dispersion of the toner image during the primary transfer.

Further, the above-mentioned arrangement has had a problem that when the frictional force at the primary transfer position varies to a large extent, the intermediate transfer belt is loosened and the intermediate transfer belt vibrates, thus disturbing the image.

The above mentioned arrangement has had also another problem that when the friction force at the primary transfer position is not enough, the speed variation occurs due to the backlash of the driving gears, thus causing the displacement and nonuniformity of colors in the end.

The image forming apparatus using the electrophotography has had a problem that its structure is complicated, its size is large and it is difficult to maintain.

Then, in order to improve the maintenance of the equipment, Japanese Patent Application Laid-Open Nos. Hei. 3-249765 and Hei. 7-199768 have been proposed for example as an image forming apparatus arranged so that consumable can be readily replenished or replaced.

Japanese Patent Application Laid-Open No. Hei. 3-249765 has disclosed an arrangement in which an image carrier and a plurality of developing means are unitized into a body in a manner capable of being attached/removed.

However, being different from the image forming apparatus for forming a monochromatic image (only black for example), the image forming apparatus for forming a multi-color image has a plurality of developing means and its image carrier is relatively large, so that when they are unitized into a body, the unit turns out to be a considerably large and heavy unit. It is then practically very difficult to replace such unit in the image forming apparatus for forming multi-color images.

Still more, because consumption of each toner of the plurality of developing means is different, it is wasteful to unitize them because other developing means also cannot but be replaced when toner of any one of the developing means is all consumed.

Then, it is necessary to allow the image carrier, the developing means and the like to be replaced separately.

Further, a so-called laser scan optical system and the like comprising a step of scanning the image carrier by laser light is generally used as the latent image forming means and it is very sensitive to vibrations and shocks, so that when a dislocation occurs in the optical parts composing the laser scan optical system, it turns out to be a shear in colors in the image forming apparatus for forming a multi-color image even if it is a minor dislocation which poses no problem in the image forming apparatus for forming a monochromatic image. Then, it is necessary to be able to replace the image carrier, the developing means and others without moving the latent image forming means.

Further, while there may be a case when the latent image forming means receives a shock when the image carrier, the developing means or the like drop on the equipment proper by accident in replacing them, it is necessary to dispose the latent image forming means such that the locus of the image carrier, the developing means and others in attaching/removing them will not pass above the latent image forming means so that the shock is minimized.

Japanese Patent Application Laid-Open No. Hei. 7-199768 has disclosed an arrangement in which the image carrier, the developing means and others are attached/removed, respectively, in the direction of the axis of the image carrier.

However, because the image carrier, the developing means and others have a lengthy shape in the direction of the axis of the image carrier, it is difficult to insert one end thereof to an attaching/removing opening while holding only the other end. Because a driving section or an electrode section of the image carrier and the developing means is disposed on the opposite side from the side held in attaching/removing the image carrier and the developing means and it becomes the head in inserting to the equipment proper, there may be a case when the new image carrier or developing means becomes unusable when it is hit with the attaching/removing opening and is damaged in inserting thereto.

Further, while A4 size recording sheets had been the main stream in the image forming apparatus for forming a monochromatic image, it has come to be required to be able to accommodate with recording sheets larger than the A4 size, e.g. A3 or more, for the image forming apparatus for forming a multi-color image due to the increase of demand in the multi-color printing lately. Due to that, because the image carrier, the developing means and the like would have a shape which is even longer in the axial direction of the image carrier in the image forming apparatus which accommodates with the recording sheet larger than the A4 size in particular, it becomes more difficult to attach/remove them in the axial direction of the image carrier.

Still more, as means for helping the attachment/removal of the image carrier, the developing means and the like having the lengthy shape in the axial direction of the image carrier into/from the equipment proper, there have been proposed an arrangement in which guide grooves for moving the image carrier, the developing means or the like in the axial direction or a movable table for carrying and moving the image carrier, the developing means or the like are provided on the side of the equipment proper or an arrangement in which such auxiliary means is allowed to be drawn out. However, because a distance in moving the image carrier, the developing means and the like from the attaching/removing opening to the attachment position within the equipment proper becomes longer in attaching/removing in the axial direction than that of the case in attaching/removing in the direction vertical to the axial direction, it becomes difficult to attach/remove them when the linearity of the guide groove is not enough. Further, because the guide groove is long, it tends to be clogged by some objects, making it difficult to attach/remove them in the end.

Further, because one end of the image carrier, the developing means or the like having the lengthy shape in the axial direction of the image carrier is inserted to the attaching/removing opening of the equipment proper while holding the other end thereof in attaching/removing them to/from the equipment proper in the axial direction, the image carrier, the developing means or the like which is cantilevered tends to deflect or distort.

In particular, because the developing means used in the image forming apparatus for forming a multi-color image is repeatedly contacted/separated with/from the image carrier within the equipment proper, it tends to deflect or distort, disallowing good images to be obtained stably, when it is arranged such that when it is moved by supporting only the side face or the both ends thereof or by abutting it with a movable member such as a roller under the developing means when it is mounted within the equipment proper.

Therefore, although it is necessary to give enough strength to the image carrier, the developing means and the like so that they will not deflect in the axial direction, it becomes a factor of increasing the cost of those replaceable members.

Further, because the image carrier and the like are attached/removed in the direction vertical to the sheet conveying direction in the arrangement in which the image carrier, the developing means and the like having the lengthy shape in the axial direction of the image carrier are attached/removed to/from the equipment proper in the axial direction, a jammed paper may damage the image carrier and the like or the paper may be torn, damaging the whole equipment as its piece moves within the equipment proper (back at the opposite side from the attachment/removal port where it is hard to reach) if one tries to attach/remove the image carrier, the developing means or the like by mistake in the state when the paper is jammed within the main body. Further, such arrangement requires means for removing a paper jammed within the equipment proper, beside the opening for attaching/removing the image carrier, the developing means or the like.

Further image forming apparatus, there have been known ones disclosed in Japanese Patent Application Laid-Open No. Hei. 1-134475 and in Japanese Patent Application Laid-Open No. 61-95370 for example. The former image forming apparatus comprises an electrostatic latent image carrier, a plurality of developing units disposed adjacent to and around the electrostatic latent image carrier, and developing unit separating/contacting means comprising horizontal separating/contacting means for horizontally moving the developing unit and turning separating/contacting means for turning the developing unit. The latter image forming apparatus holds a plurality of developing units in a shape of Ferris wheel and has a development unit composed of a movable supporter capable of moving a required developing unit along a predetermined path to one developing position common to respective color developing units.

The latter is also provided with position detecting means for detecting a stop position for stopping the developing unit held like Ferris wheel at a certain position.

In the example disclosed in Japanese Patent Application Laid-Open No. Hei. 1-134475 described above, however, the means for separating/contacting the plurality of developing units comprises the horizontal separating/contacting means for horizontally moving the developing unit and the turning separating/contacting means for turning the developing unit, so that there mixedly exited two kinds of developing unit moving means for moving the developing unit to the developing position where the developing unit is approached to the electrostatic latent image carrier or the standby position where the developing unit is separated from the electrostatic latent image carrier, thus complicating the equipment. Further, the example disclosed in Japanese Patent Application Laid-Open No. 61-95370 has had a problem that the equipment is complicated because the plurality of developing units are held and unitized like the Ferris wheel and hence, a number of elements composing the developing units and the developing unit moving means increases. Still more, it has been difficult to miniaturize it because the size of the components has been apt to increase to hold and unitize the developing units like the Ferris wheel. Further, because a distance for moving the developing unit to the developing position where it is approached to the electrostatic latent image carrier or the standby position where it is separated from the electrostatic latent image carrier is prolonged, it took a long time to move the developing unit and it has been difficult to provide an image forming apparatus capable of outputting images at high speed.

Further, the example disclosed in Japanese Patent Application Laid-Open No. 61-95370 has had a problem that the equipment is complicated because it has been provided with the position detecting means such as a photosensor in order to detect the stop position of the developing units held like the Ferris wheel and it required numbers of elements composing the equipment.

Accordingly, the present invention has been devised in view of such problems and is intended to provide an inexpensive image forming apparatus which is capable of forming high quality images by canceling the nonuniformity of speed to suppress the expansion/contraction of the image even if there is the nonuniformity of speed caused by the image carrier driving member which operates along with the image carrier.

The present invention is also intended to provide an image forming apparatus, when applied thereto which is equipped with a plurality of developing means and in which images on the image carrier is transferred to a transfer member one after another, which is capable of forming high quality images by correcting the displacement in color or nonuniformity of color caused by the nonuniformity of speed of the image carrier with high precision.

It is another object of the present invention to solve the aforementioned problems by providing an image forming apparatus which is capable of driving the photoreceptor in synchronism with the intermediate transfer belt with a simple arrangement and, hence, of providing images finely reproduced.

It is a further object of the invention to solve the aforementioned problems that the image carrier, the developing means or the equipment proper is apt to be damaged if the image carrier or the developing means having the lengthy shape in the axial direction of the image carrier is attached/removed in the axial direction and that the latent image forming means is apt to be damaged in attaching/removing the image carrier, the developing means or recording member storage means.

It is a further object of the invention to solve the aforementioned problems that the image carrier or the equipment proper is apt to be damaged when the image carrier and the like is attached/removed in the state when a recording member is jammed within the equipment proper, that an equipment opening section has to be provided beside the opening for attaching/removing opening the image carrier, the developing means and the like and that an installation area of the equipment proper is large.

It is a further other object of the invention to solve the aforementioned problems that the developing means having the lengthy shape in the axial direction of the image carrier is apt to deflect and that no good image cannot be formed if it deflects when it is attached to the equipment proper.

It is a further object of the invention to solve the aforementioned problem that the installation area of the equipment is large.

It is a further object of the invention is to provide an image forming apparatus having a simple structure with less power source by arranging so as to have selective driving means for selectively driving first developing unit or second developing unit selected among a plurality of developing units by driving the driving motor forward or backward and also so as to have selective driving means for selectively driving first developing unit moving means or second developing unit moving means selected among a plurality of developing unit moving means by driving the driving motor forward or backward.

Further, the present invention is intended to provide an image forming apparatus which takes less time to move the developing unit and which is capable of outputting images at high speed by composing the developing unit moving means, for moving the developing unit to the developing position where it is approached to the latent image carrier or the standby position where it is separated from the latent image carrier, by supporting means for rockably supporting the developing unit; urging means for rocking and urging the developing unit in one direction; and a cam mechanism for rocking and moving the developing unit in the other direction.

Further, it is intended to provide a rotation transmitting unit which requires no position detecting member for detecting the rotation stop position of a rotation output shaft.

It is also intended to provide an image forming apparatus, which requires no position detecting means for detecting the developing position or the standby position of the developing unit, which is inexpensive and which has a simple structure, by arranging such that the rotation transmitting unit is used, one turn of the transmitting means of the rotation transmitting unit is divided into half, and turning force is transmitted from an input shaft to an output shaft sequentially by each partial angle by inputting pulses from control means.

SUMMARY OF THE INVENTION

According to a first aspect of the present invention, there is provided, an image forming apparatus comprises a rotatable image carrier; driving means for driving the image carrier; image carrier driving member for transmitting driving force received from the driving means at an image carrier driving position to the image carrier; latent image forming means for forming a latent image on the image carrier at a latent image forming position; developing means for developing the latent image on the image carrier to form a developer image; a transfer member to which the developer image on the image carrier is transferred at a transferring position; and transfer member conveying means for receiving driving force from the image carrier driving member at a transfer driving position to convey the transfer member; wherein a time during which the image carrier moves from the latent image forming position to the transferring position is almost equal with a time during which the image carrier driving member moves from the image carrier driving position to the transfer driving position.

In the image forming apparatus as described above, $k_T$ is 0.167 or less, where a period of rotation of the image carrier driving member is assumed to be $T_{11}$, a time difference between the time during which the image carrier moves from the latent image forming position to the transferring position and the time during which the image carrier driving member moves from the image carrier driving position to the transfer driving position is $\Delta T$ and a ratio of $\Delta T$ to $T_{11}$, described above is $k_T$.

In the image forming apparatus as described above, the image carrier driving member comprises a gear, the driving means has a driving means gear which engages with the image carrier driving member, the transfer member conveying means has a conveying force transmitting gear which engages with the image carrier driving member and the driving means gear and the conveying force transmitting gear are pressed against the image carrier driving member.

Further, the image forming apparatus has a plurality of the developing units and each image thereof on the image carrier is laid and transferred to the transfer member one after another.

In the image forming apparatus described above, $k_T$ is 0.064 or less, where a period of rotation of the image carrier driving member is $T_{11}$, a time difference between the time during which the image carrier moves from the latent image forming position to the transferring position and the time during which the image carrier driving member moves from the image carrier driving position to the transfer driving position is $\Delta T$ and a ratio of $\Delta T$ to $T_{11}$, described above is $k_T$.

According to a second aspect of the invention, there is provided an image forming apparatus comprising latent image forming means for forming a latent image on an image carrier; developing means for developing the latent image on the image carrier by toner; primary transfer means for transferring the toner images on the image carrier to an intermediate transfer belt one after another; secondary transfer means for transferring the toner images laid on the intermediate transfer belt to a recording member altogether; a driving source for driving the image carrier; first drive transmitting means for transmitting driving force of the driving source to the image carrier to drive the image carrier; and second drive transmitting means for transmitting the driving force of the image carrier to the intermediate transfer belt to drive the intermediate transfer belt in synchronism with the image carrier. The second drive transmitting means is disposed on the downstream side of the primary transfer means from the aspect of the direction in which the intermediate transfer belt is conveyed.

In the image forming apparatus described above, a peripheral speed of the intermediate transfer belt is set so as to be faster than a peripheral speed of the image carrier.

In the image forming apparatus described above, the primary transfer means is urged toward the image carrier via the intermediate transfer belt.

In the image forming apparatus described above, the intermediate transfer belt is stretched approximately in the tangential direction of the image carrier at the primary transfer position where the primary transfer means is disposed.

In the image forming apparatus described above, wrinkle preventing means is disposed on the upstream side of the primary transfer means in order to smooth out the wrinkled intermediate transfer belt before it is conveyed to the primary transfer position.

In the image forming apparatus described above, the first and second drive transmitting means are gears, a number of teeth of the first drive transmitting means from a latent image forming position on the image carrier to the primary transfer position is an integer, and a number of teeth of the first drive transmitting means from a position where the first drive transmitting means receives driving force from the driving source to a position where the first drive transmitting means transmits the driving force to the second drive transmitting means is an integer.

In the image forming apparatus described above, the image carrier is a drum.

In the image forming apparatus described above, the first and second drive transmitting means are gears and a pitch diameter of the first drive transmitting means is set so as to be larger than a pitch diameter of the second drive transmitting means.

According to a third aspect of the invention, there is provided an image forming apparatus comprising latent image forming means for forming a latent image corresponding to each color component on an image carrier; a plurality of developing means for developing the latent image on the image carrier by toner corresponding to each color component; primary transfer means for transferring the toner images on the image carrier to an intermediate transfer body one after another; secondary transfer means for transferring the toner images formed on the intermediate transfer body to a recording member conveyed from recording member storage means altogether; fixing means for fixing the multi-color image to the recording member; a first recording member conveying path for conveying the recording member in the recording member storage means from the secondary transfer means to the fixing means; and a second recording member conveying path for discharging the recording member conveyed from the fixing means out of the an image forming apparatus body, wherein the latent image forming means is disposed on the back of the image forming apparatus body, that the image carrier, the developing means and the recording member storage means can be detachably attached almost in the same direction on the front side of the equipment proper and that the direction is almost perpendicular to an axis of the image carrier.

In the image forming apparatus described above, the image carrier has a drum-like shape.

In the image forming apparatus described above, the developing means is disposed on the front side of the image forming apparatus body more than the image carrier.

In the image forming apparatus described above, the upper face and the front face are openable covers.

In the image forming apparatus described above, the second recording member conveying path conveys the recording member almost in the vertical direction at the front side of the image forming apparatus body to discharge it to the upper face of the image forming apparatus body.

In the image forming apparatus described above, the fixing means guides the recording member by changing the conveying direction thereof from the first recording member conveying path to the second recording member conveying path.

In the image forming apparatus described above, the second recording member conveying path and/or the fixing means moves while interlocking with an operation for opening and closing the front cover.

The image forming apparatus described above, further comprises supporting means for removably supporting the developing means; coupling means for coupling the developing means with the supporting means; and moving means for moving the supporting means to move the developing means coupled with the supporting means to a developing position or to a non-developing position.

The image forming apparatus described above further comprises a frame structure for supporting the plurality of supporting means corresponding to the plurality of developing means and that the frame structure is turned and moved to move the developing means fixed to the frame structure via the supporting means to a first position where it is urged to the image carrier and to a second position where it is released from the image carrier.

The image forming apparatus described above further comprises bi-stabilizing means for stabilizing the frame structure in two stable states at the first position and the second position.

In the image forming apparatus described above, the developing means is detachably attached in the state in which the frame structure is opened at the second position and a toner storage section of the developing means assumes a downward position.

In the image forming apparatus described above, the coupling means comprises a pin provided either on the developing means or the supporting means for engaging with the other; an inserted portion, provided either on the developing means or the supporting means, into which the other pin is inserted; and a cam for urging the pin inserted to the inserted portion in predetermined directions.

In the image forming apparatus described above, the predetermined directions are directions of urging the developing means to the image carrier and of urging the developing means to the supporting means.

In the image forming apparatus described above, the intermediate transfer body is an intermediate transfer belt and is spanned by a driving roller positioned on the back side of the equipment proper for driving the intermediate transfer belt; a backup roller positioned at the lower face side of the equipment proper and is provided at the position facing to the secondary transfer means; and a tension roller positioned at the front side of the equipment proper for giving tension to the intermediate transfer belt.

According to a fourth aspect of the invention, there is provided an image forming apparatus comprising a latent image carrier on which a latent image is formed; a plurality of developing units for developing the latent image on the latent image carrier; driving motors for driving the developing units; and selective driving means for selectively driving first developing unit or second developing unit selected among the plurality of developing units by driving the driving motor forward or backward.

According to a fifth aspect of the invention, there is provided an image forming apparatus comprising a latent image carrier on which a latent image is formed; a plurality of developing units for developing the latent image on the latent image carrier; developing unit moving means for moving the developing unit to a developing position where the developing unit is approached to the latent image carrier or a standby position where the developing unit is separated from the latent image carrier; driving motors for driving the developing unit moving means; selective driving means for selectively driving first developing unit moving means or second developing unit moving means selected among the plurality of developing unit moving means by driving the driving motor forward or backward.

According to a sixth aspect of the invention, there is provided an image forming apparatus comprising a latent image carrier on which a latent image is formed; a plurality of developing units for developing the latent image on the latent image carrier; developing unit moving means for moving the developing unit to a developing position where the developing unit is approached to the latent image carrier or a standby position where the developing unit is separated from the latent image carrier; driving motors for driving the developing unit moving means; selective moving means for moving a first developing unit or a second developing unit selected among the plurality of developing units by driving the driving motor forward or backward; and selective driving means for selectively driving first developing unit moving means or second developing unit moving means selected among the plurality of developing unit moving means by driving the driving motor forward or backward.

In the image forming apparatus described above, the developing unit moving means comprises supporting means for rockably supporting the developing unit; urging means for rocking and urging the developing unit in one direction; and a cam mechanism for rocking and moving the developing unit in the other direction.

In the image forming apparatus described above, the urging means urges the developing unit in the direction of the developing position and the cam mechanism moves the developing unit in the direction of the standby position.

In the image forming apparatus described above, the rocking and supporting means is disposed near an engagement point of a gear train for driving the developing unit.

According to a seventh aspect of the present invention, there is provided a rotation transmitting unit comprising an input shaft for obtaining turning force from a driving source; an output shaft for transmitting the turning force to a member to be driven; transmitting means interposed between the input shaft and the output shaft for transmitting the turning force intermittently from the driving source to the member to be driven; and control means for controlling the transmitting means; wherein one turn of the transmitting means is divided into n parts ($\theta_n$, $\theta_{n-1}$, . . . , $\theta_2$, $\theta_1$) and the turning force is transmitted from the input shaft to the output shaft sequentially by each partial angle as pulse is input by the control means; the partial angle of the transmitting means is represented by the following relational equation:

$$\sum_{1}^{n} \theta i = 360°$$

and the control means is capable of outputting the pulse at any timing and outputting a signal having a pulse width corresponding to an angle of revolution $\alpha$ represented by a relational equation of $\alpha<\theta_{min}$ (where, $\theta_{min}$ is a minimum partial angle among each partial angle of $\theta_1$ to $\theta_n$).

In the rotation transmitting unit described above, the partial angle of the transmitting means is represented by a relational equation of $180°<\theta_1<360°$ and the control means outputs a signal having a pulse width corresponding to an angle of rotation $\beta$ represented by the following relational equation:

$$\sum_{2}^{n} \theta i < \beta < \theta 1$$

In the rotation transmitting unit described above, the cam mechanism is controlled so as to turn or stop when the value of n is 2.

According to an eighth aspect of the invention, there is provided an image forming apparatus comprising four rotation transmitting units described above, four of the developing units and two of the driving sources.

The specific nature of the invention, as well as other objects, uses and advantages thereof, will clearly appear from the following description and the accompanying drawings.

DESCRIPTION OF PREFERRED EMBODIMENTS

Preferred embodiments of the present invention will be explained in detail below with reference to the drawings.

Figure 1:
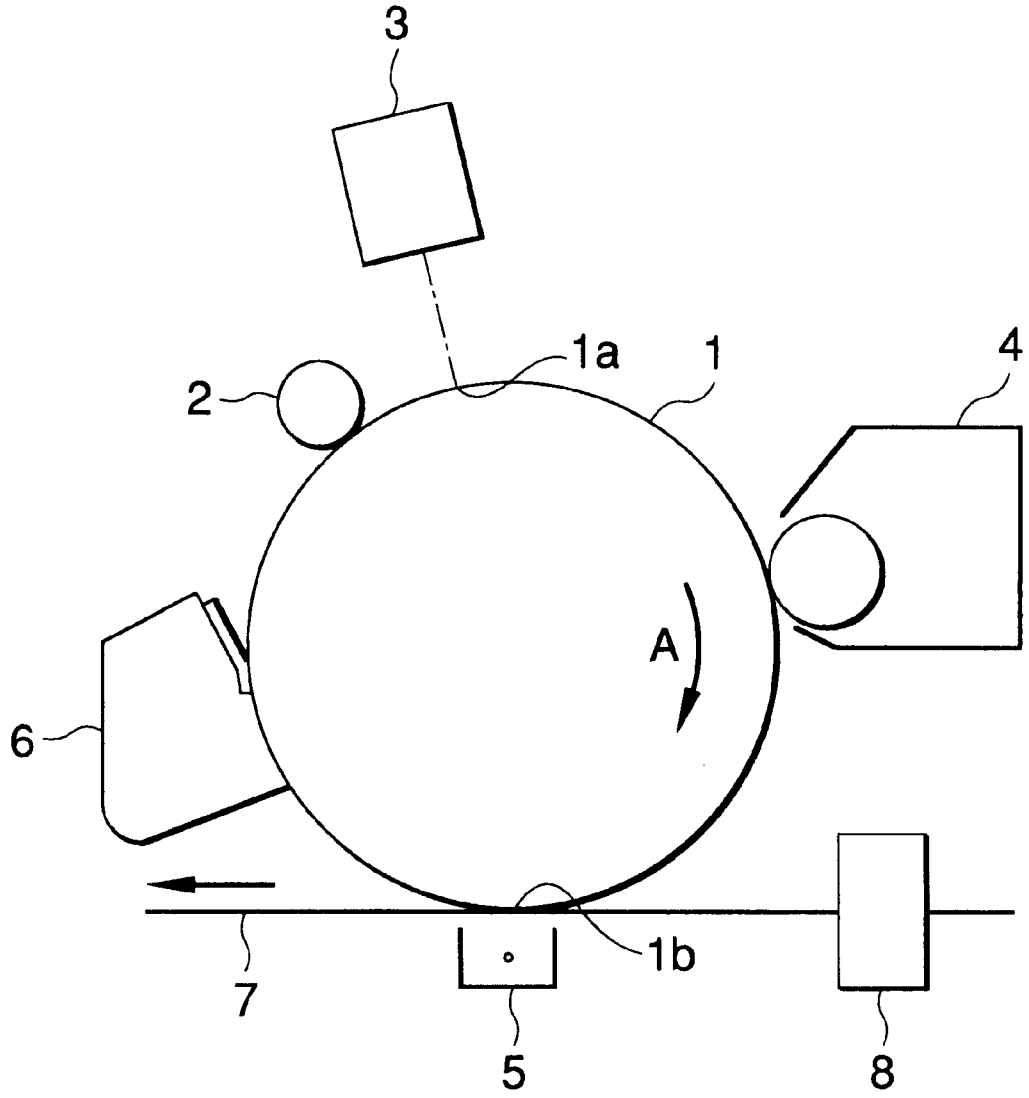
FIG. 1 is a front section view showing a schematic arrangement of an image forming apparatus.

FIG. 1 is a front section view schematically showing an arrangement of an image forming apparatus of the present invention. As shown in FIG. 1, the image forming apparatus comprises an image carrier 1, charging means 2, latent image forming means 3, developing means 4, transferring means 5, a cleaner 6, a transfer member 7, and transfer member conveying means 8 for conveying the transfer member 7 disposed around the image carrier 1.

A process for forming an image by the image forming apparatus will be briefly explained below. When the image carrier 1 rotates in the direction of an arrow A in the figure, a latent image is formed on the image carrier 1 by the latent image forming means 3 at a latent image forming position 1*a*. It is then developed by the developing means 4 and is transferred to the transfer member 7 by the transferring means 5 at a transferring position 1*b*. An image is thus formed.

Figure 2:
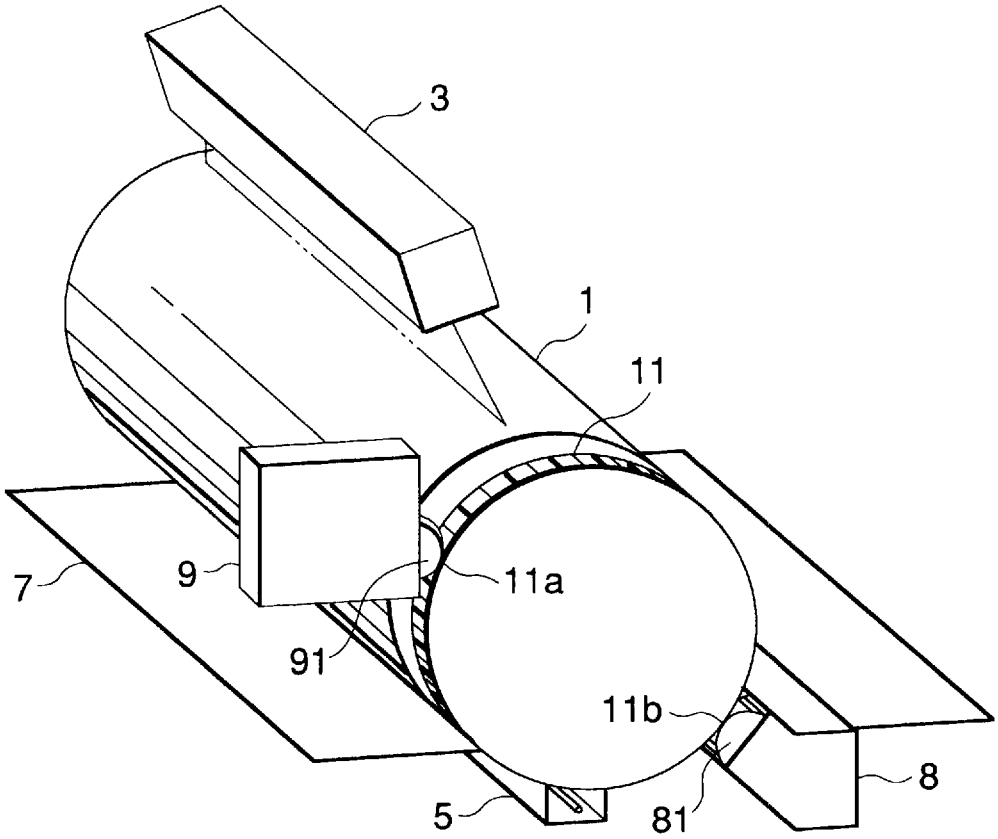
FIG. 2 is a perspective view showing a method for driving an image carrier and a method for conveying a transfer member.

FIG. 2 is a perspective view showing a method for driving the image carrier 1 and a method for conveying the transfer member 7. The image carrier 1 is attached to an image carrier gear 11 which is an image carrier driving member which turns along with the image carrier 1. A driving means gear 91 which is part of driving means 9 engages with the image carrier gear 11 at an image carrier driving position 11*a* to transmit driving force of the driving means 9 to the image carrier gear 11. The image carrier gear 11 operates along with the image carrier 1 to transmit the driving force to the image carrier 1. The transfer member conveying means 8 is arranged such that a conveying force transmitting gear 81 which is a component thereof engages with the image carrier gear 11 at a transfer driving position 11*b* to transmit the driving force from the image carrier gear 11 and to convey the transfer member 7.

When the image carrier gear 11 has a geometric error or an eccentricity in the arrangement described above, a driving speed from the driving means gear 91 is not transmitted accurately to the image carrier gear 11 and a rotational speed of the image carrier gear 11 becomes nonuniform. The nonuniformity of rotational speed of the image carrier gear 11 manifests directly as a nonuniformity of rotational speed of the image carrier 1. An influence caused by a geometric error or an eccentricity of the image carrier 1 is also added to it, causing a nonuniformity of peripheral speed of the image carrier 1. This nonuniformity of peripheral speed causes an expanded/contacted latent image to be formed on the image carrier 1 by the latent image forming means 3. Meanwhile, the nonuniformity of rotational speed of the image carrier gear 11 also causes a nonuniformity of speed of the transfer member conveying means 8 to which driving force is transmitted from the image carrier gear 11, causing a nonuniformity of conveying speed of the transfer member 7. Thus, the image finally formed on the transfer member 7 expands/contracts due to the influence of the nonuniformity of conveying speed of the transfer member 7 in addition to the expansion/contraction of the latent image on the image carrier and the image quality is reduced.

Noticing that the nonuniformity of rotational speed caused in the image carrier gear 11 affects not only the speed of the image carrier gear 11 but also the speed of the transfer member 7 with regard to the aforementioned problem, the inventors have invented a method of canceling the nonuniformity of speed of the image carrier gear 11 with the nonuniformity of speed of the transfer member 7. The principle of the present invention will be explained below.

Figure 3:
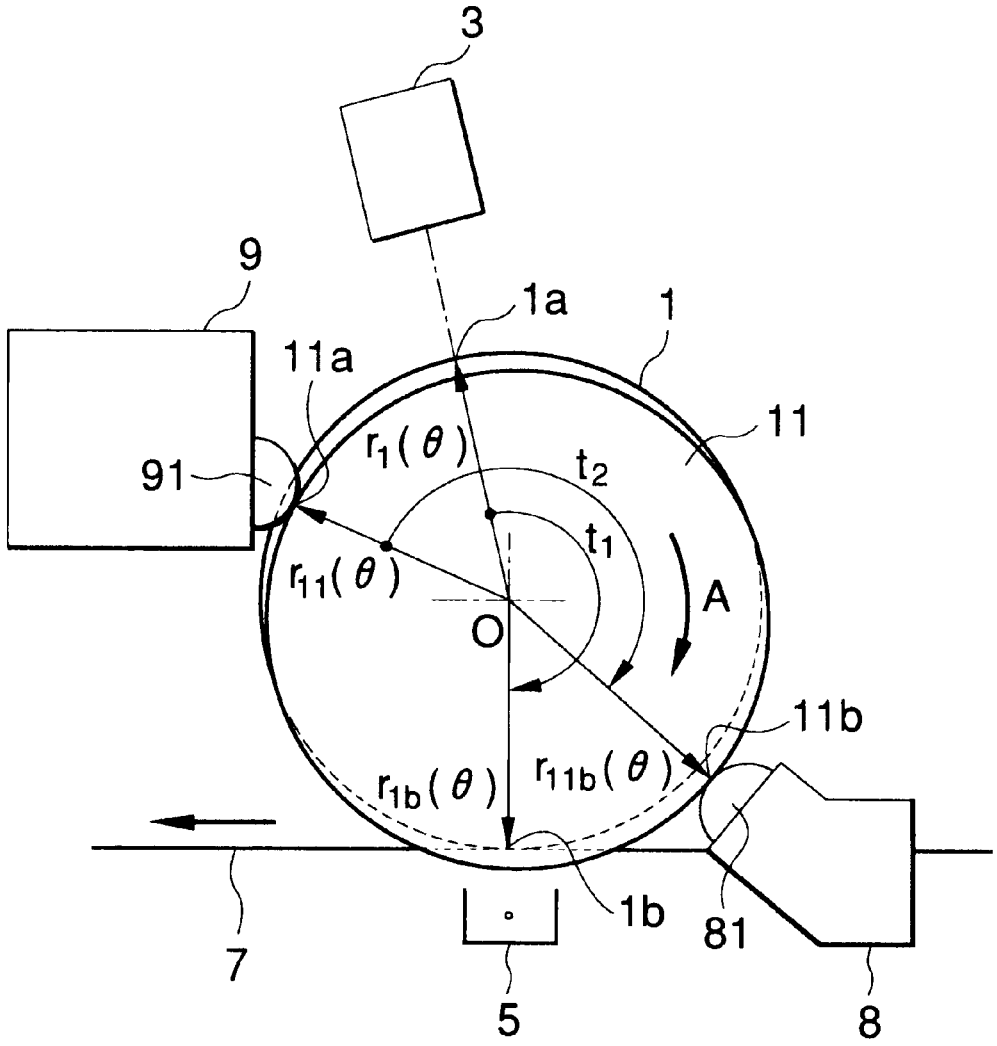
FIG. 3 is a front section view of the image forming apparatus showing a principle of the present invention.

FIG. 3 is a front section view of the image forming apparatus showing the principle of the present invention. When the image carrier gear 11 has the geometric error or the eccentricity, a length from the center of rotation O to a pitch circle which is an engaging position of the gear changes depending on a rotational angle of the image carrier gear 11. Then, the rotational angle of the image carrier gear 11 will be represented by θ and the length from the center of rotation to the pitch circle at the image carrier driving position 11*a* will be represented as $r_{11}(\theta)$. similarly, a length from the center of rotation O of the image carrier 1 to the peripheral face of the image carrier 1 at the latent image forming position 1*a* will be represented as $r_1(\theta)$. A time during which the image carrier 1 rotationally moves from the latent image forming position 1*a* to the transferring position 1*b* is assumed to be an image forming—transferring time $t_1$ and a time during which the image carrier gear 11 rotationally moves from the image carrier driving position 11*a* to the transfer driving position 11*b* is assumed to be a transfer drive transmitting time $t_2$. It is assumed that the driving means gear 91 and the conveying force transmitting gear 81 are pressed against the image carrier gear 11 and those gears always engage with the image carrier gear 11 at the aforementioned position $r_{11}(\theta)$ with respect to the radial direction of the image carrier gear 11.

At first, a small length $\Delta p_1$ of the latent image formed on the image carrier 1 at a small time Δt is found. Assuming that the rotational speed of the driving means gear 91 for driving the image carrier gear 11 has a nonuniformity of speed, the peripheral speed of the driving means gear 91 at the image carrier driving position 11*a* is represented as a function at time t as $v_{91}(t)$. Using the peripheral speed $v_{91}(t)$, a peripheral speed $v_{1a}(t)$ of the image carrier 1 at the latent image forming position 1*a* at time t is represented by the following equation:

$$v_{1a}(t) = \frac{r_1(\theta(t))}{r_{11}(\theta(t))} v_{91}(t) \tag{1}$$

In the equation (1), the rotational angle θ(t) of the image carrier 1 and the image carrier gear 11 is a function of the time t and may be found by solving the following differential equation with respect to θ;

$$\frac{d\theta}{dt} = \frac{v_{91}(t)}{r_{11}(\theta)} \tag{2}$$

From the equation (1), the small length $\Delta p_1$ of the latent image formed at the latent image forming position 1*a* at the small time Δt may be expressed as a function of the time t by the following equation;

$$\Delta p_1(t) = v_{1a}(t)\Delta t = \frac{r_1(\theta(t))}{r_{11}(\theta(t))} v_{91}\Delta(t) \quad (3)$$

Next, a small length $\Delta p_7(t)$ of the latent image, which has been formed at the time t, is found when it is transferred to the transfer member 7. The latent image formed at the time t is transferred to the transfer member 7 after the image forming—transferring time $t_1$ and $\Delta p_7(t)$ may be expressed as follows:

$$\Delta p_7(t+t_1) = \frac{v_7(t+t_1)}{v_{1b}(t+t_1)} \Delta p_1(t) \quad (4)$$

In the equation (4), $v_7(t+t_1)$ represents the conveying speed of the transfer member 7 at time $t+t_1$ and $v_{1b}(t+t_1)$ represents the peripheral speed of the image carrier 1 at the transferring position 1*b* at time $t+t_1$. $v_7(t+t_1)$ may be expressed as follows by using the peripheral speed $v_{91}(t)$ of the driving means gear 91:

$$v_7(t+t_1) = k_8(t+t_1)\frac{r_{11b}(\theta(t+t_1))}{r_{11}(\theta(t+t_1))} v_{91}(t+t_1) \quad (5)$$

In the equation (5), $k_8(t+t_1)$ represents a ratio of the conveying speed of the transfer member 7 to the peripheral speed of the image carrier gear 11 at the transfer driving position 11*b* at time $t+t_1$. This $k_8(t+t_1)$ is a coefficient defined by the arrangement of the transfer member conveying means 8. Assuming that the transfer member conveying means 8 has a nonuniformity in transmitting speed, it is represented by a function of the time t. $r_{11b}(\theta(t+t_1)$ represents the length from the center of rotation O to the pitch circle at the transfer driving position 11*b* at time $t+t_1$. $r_{11b}(\theta(t))$ and $r_{11}(\theta(t))$ are functions representing the same length, though only the phase is different by the transfer drive transmitting time $t_2$, so that $r_{11b}(\theta(t))$ may be expressed by using $r_{11}(\theta(t))$ as follows:

$$r_{11b}(\theta(t))=r_{11}(\theta(t-t_2)) \quad (6)$$

Thereby, the equation (5) may be rewritten by using the equation (6) as follows:

$$v_7(t+t_1) = k_8(t+t_1)\frac{r_{11}(\theta(t+t_1-t_2))}{r_{11}(\theta(t+t_1))} v_{91}(t+t_1) \quad (7)$$

Further, the peripheral speed $v_{1b}(t+t_1)$ used in the equation (4) may be represented by using the peripheral speed $v_{91}(t)$ of the driving means gear 91 as follows:

$$v_{1b}(t+t_1) = \frac{r_{1b}(\theta(t+t_1))}{r_{11}(\theta(t+t_1))} v_{91}(t+t_1) \quad (8)$$

In the equation (8), $r_{1b}(\theta(t+t_1)$ represents the length from the center of rotation O to the peripheral face of the image carrier 1 at the transferring position 1*b* at time $t+t_1$ and is equal to $r_1(\theta(t))$. Therefore, the equation (8) may be expressed as follows:

$$v_{1b}(t+t_1) = \frac{r_1(\theta(t))}{r_{11}(\theta(t+t_1))} v_{91}(t+t_1) \quad (9)$$

Accordingly, the small length $\Delta p_{77}(t+t_1)$ on the transfer member 7 may be expressed by substituting the equations (3), (7) and (9) to the equation (4), as follows:

$$\Delta p_7(t+t_1) = k_8(t+t_1)\frac{r_{11}(\theta(t+t_1-t_2))}{r_{11}(\theta(t))} v_{91}(t)\Delta t \quad (10)$$

When a variation of the small length $\Delta p_7(t+t_1)$ on the transfer member 7 expressed by the equation (10) represents the expansion/contraction of the image and when $\Delta p_7(t+t_1)$ is constant regardless of the time t, the image will not expand/contract on the transfer member 7. Here, when the image forming apparatus is arranged so that the image forming—transferring time $t_1$ equals with the transfer drive transmitting time $t_2$, the equation (10) may be expressed as follows:

$$\Delta p_7(t+t_1)k_8(t+t_1(v_{91}(t)\Delta t \quad (11)$$

It can be understood from the equations (10) and (11) that the length $r_{11}(\theta(t))$ from the center of rotation to the pitch circle of the image carrier gear 11 will not affect the small length $\Delta p_7(t+t_1)$ by equalizing the image forming—transferring time $t_1$ and the transfer drive transmitting time $t_2$. That is, it can be understood that the image formed on the transfer member 7 will not expand/contract even when the image carrier gear 11 has the geometric error or the eccentricity if the image forming—transferring time $t_1$ and the transfer drive transmitting time $t_2$ are made equal to the arrangement of the present invention.

Further, the length $r_1(\theta(t))$ from the center of rotation O of the image carrier 1 to the peripheral face of the image carrier 1 is not included in the equation (11) and it can be understood that the geometric error or the eccentricity of the image carrier 1 will not affect the small length $\Delta p_7(t+t_1)$. That is, it can be understood that the image formed on the transfer member 7 will not expand/contract even if the image carrier gear 11 has the geometric error or eccentricity according to the arrangement of the present invention.

By the way, the influence to the expansion/contraction of the image on the transfer member 7 caused by the eccentricity of the image carrier gear 11 may be reduced just by approximately equalizing, not completely equalizing, the image forming—transferring time $t_1$ and the transfer drive transmitting time $t_2$. Then, the influence to the expansion/contraction of the image on the transfer member 7 will be found when there is a time difference $\Delta T$ between the image forming—transferring time $t_1$ and the transfer drive transmitting time $t_2$. It is a general tendency that among the geometric error and the eccentricity caused in the image carrier gear 11, the component caused by the eccentricity is the largest. When the image carrier gear 11 has the eccentric component, the length $r_{11}(\theta)$ from the center of rotation O to the pitch circle of the image carrier gear 11 becomes a function having a cycle when the image carrier gear 11 makes one turn and may be expressed as follows:

$$R_{11}(\theta)=r_{11}+\delta_{11}\sin)(\theta+\xi_{11}) \quad (12)$$

In the equation (12), $\delta_{11}$ and $\xi_{11}$ represent phase angles the eccentricity and the direction of eccentricity of the image carrier gear 11 and $R_{11}$ represents an average radius of the pitch circle. By the way, when a frequency of variation of $r_{11}(\theta)$ per one turn of the image carrier gear 11 is low, there is no problem in terms of the calculation even if $\theta(t)$ found from the equation (2) is approximated as $\theta(t)=\omega$, where $\omega$ is an average rotational speed of the image carrier gear 11. Further, with regard to the rotational speed of the image carrier gear 11, because the eccentricity $\delta_{11}$ of the image carrier gear 11 is fully small as compared to the reference radius of the pitch circle $R_{11}$, the small length $\Delta p_7(t+t_1)$ on the transfer member 7 may be expressed approximately by using the equation (12), as follows:

$$\Delta p_7(t+t_1) \approx k_8(t+t_1)\left\{1+2\frac{\delta_{11}}{R_{11}}\sin\frac{\omega\Delta T}{2}\cos\left(\omega t+\frac{\omega\Delta T}{2}+\xi_{11}\right)\right\}v_{91}(t)\Delta t \tag{13}$$

The equation (13) may be expressed by normalizing the time difference $\Delta T$ between the image forming—transferring time $t_1$ and transfer drive transmitting time $t_2$ and by replacing and expressing it with a ratio $k_T$ to a rotational period $T_{11}$ of the image carrier gear 11, as follows:

$$\Delta p_7(t+t_1) \approx k_8(t+t_1)\left\{1+2\frac{\delta_{11}}{R_{11}}\sin\pi k_T\cos(\omega t+\pi k_T+\xi_{11})\right\}v_{91}(t)\Delta t \tag{14}$$

It can be understood from the equation (14) that the expansion/contraction of the image caused by the eccentricity $\delta_{11}$ of the image carrier gear 11 changes with one cycle per one turn of the image carrier gear 11 and that its amplitude changes depending on the ratio of time difference $k_T$.

Figure 4:
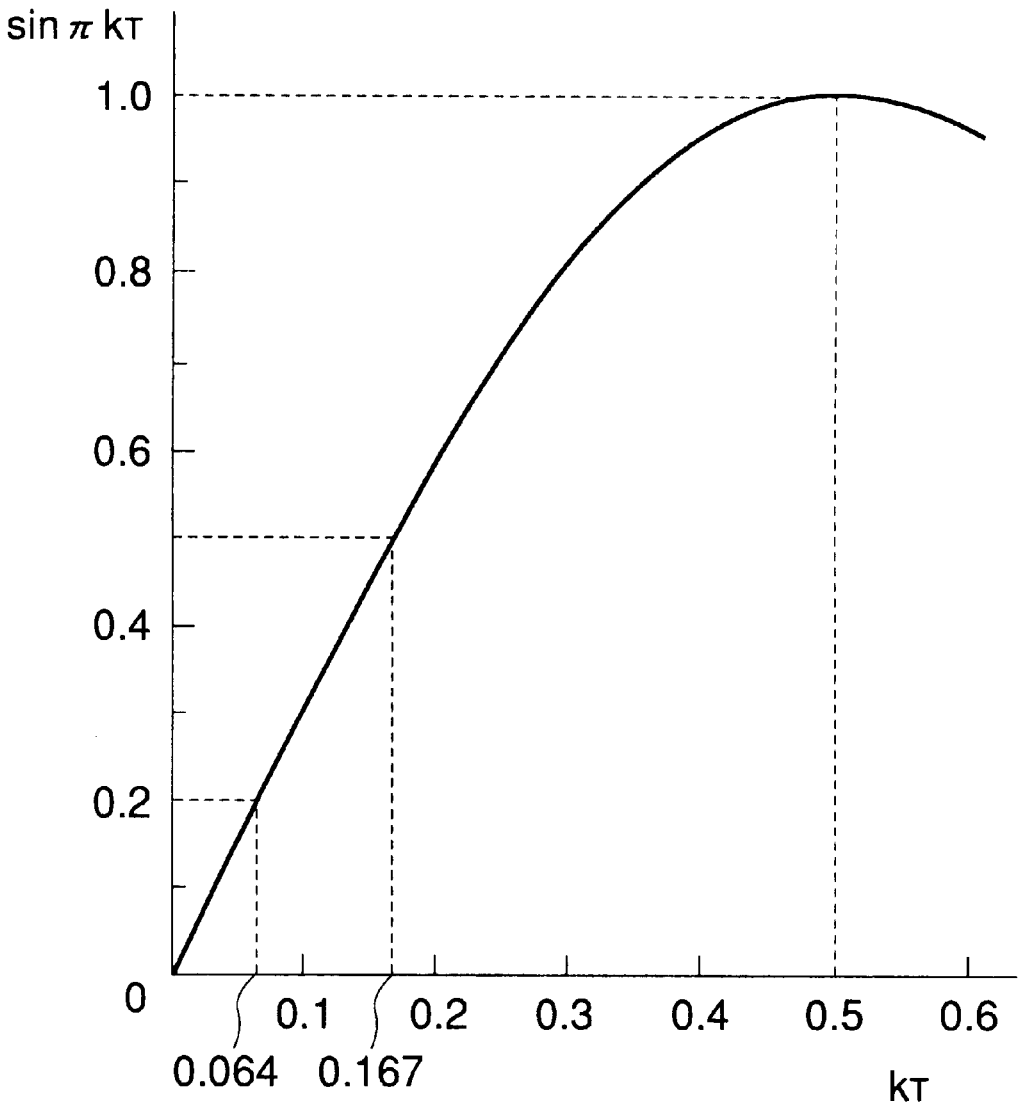
FIG. 4 is a graph showing a relationship between a time difference ratio $k_T$ and an influence to the expansion/contraction of an image caused by eccentricity of an image carrier gear.

FIG. 4 is a graph showing a relationship between the time difference ratio $k_T$ and an influence to the expansion/contraction of an image caused by eccentricity of the image carrier gear 11, wherein the horizontal axis represents $k_T$ and the vertical axis represents $\sin(\pi k_T)$. It can be seen from the graph that when $k_T$ is 0.5, $\sin(\pi k_T)$ becomes the maximum value of 1 and that the influence to the expansion/contraction of the image caused by the eccentricity of the image carrier gear 11 is maximized. When $k_T$ is 0.167, $\sin(\pi k_T)$ is 0.5 and the influence to the expansion/contraction of the image is relaxed to a half. When a monochromatic image is to be formed by the image forming apparatus, the expansion/contraction of the image may be relaxed to a level which poses no problem in terms of image quality if $k_T$ is 0.167 or less. When $k_T$ is within this range, it may be considered that the image forming—transferring time $t_1$ and the transfer drive transmitting time $t_2$ are almost equal. When $k_T$ is 0.064, $\sin(\pi k_T)$ is 0.2 and the influence to the expansion/contraction of the image may be relaxed to ⅕. When a color image is to be formed by the image forming apparatus by laying colors on the transfer member 7, $k_T$ is preferred to be 0.064 or less because developer images need to be positioned on the transfer member 7 with high precision. If $k_T$ is within this range, the image forming—transferring time $t_1$ is considered to be almost equal with the transfer drive transmitting time $t_2$.

The case in which the driving means gear 91 and the conveying force transmitting gear 81 are pressed against the image carrier gear 11 has been explained in the explanation of the embodiment described above. Next, the expansion/contraction of the image on the transfer member 7 will be found when the axes of rotation of the driving means gear 91 and the conveying force transmitting gear 81 are fixed.

Figure 5:
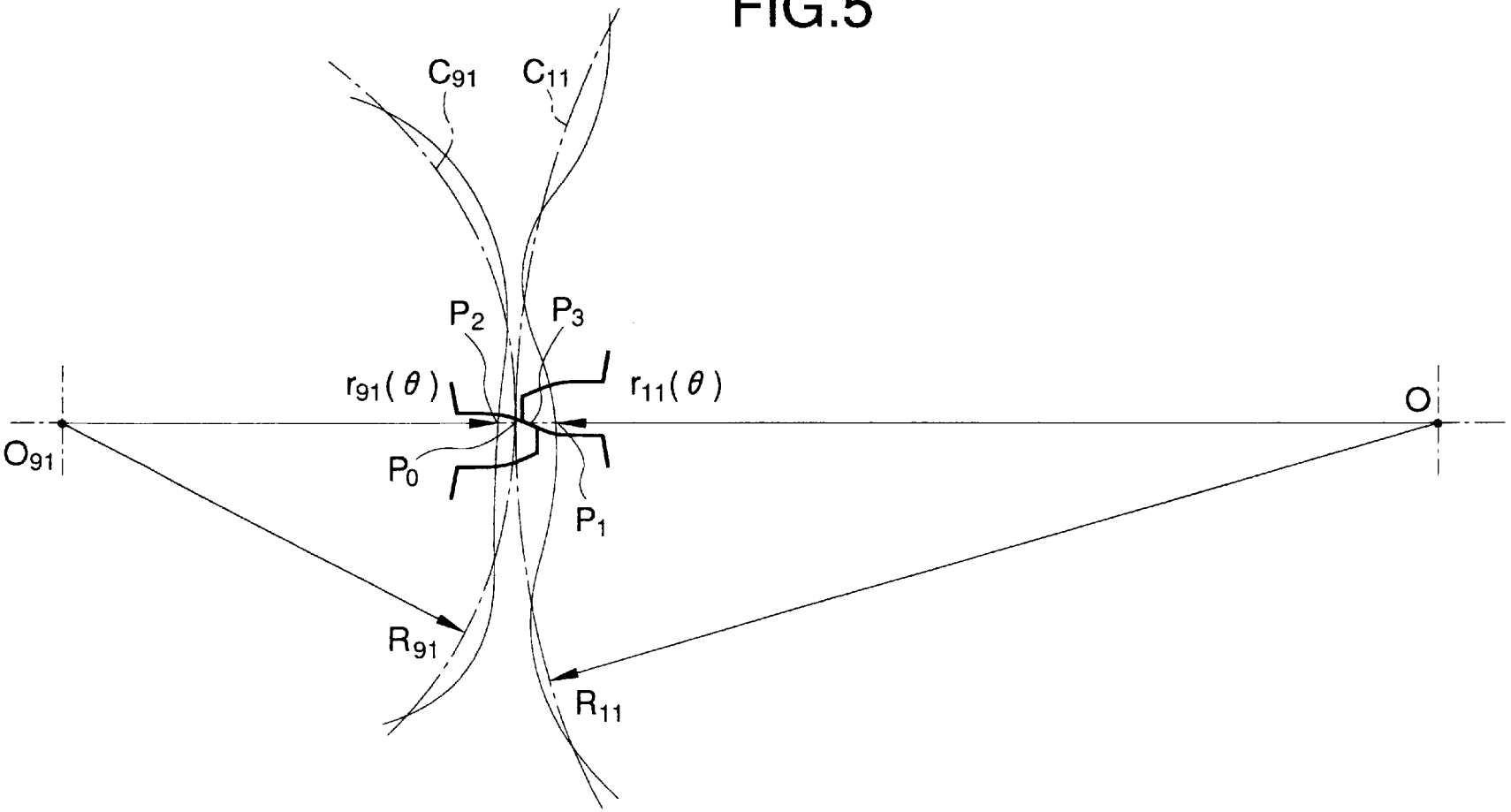
FIG. 5 is a front section view showing an engagement of the image carrier gear and driving means gear when an axis of rotation of the driving means gear is fixed.

FIG. 5 is a front section view showing an engagement of the image carrier gear 11 and the driving means gear 91 when the axis of rotation $O_{91}$ of the driving means gear 91 is fixed. In an ideal case when the gears have no geometric error nor eccentricity, the pitch circle of the image carrier gear 11 turns out to be a true circle $C_{11}$ whose center is O and whose radius is $R_{11}$ and the pitch circle of the driving means gear 91 turns out to a true circle $C_{91}$ whose center is $O_{91}$ and whose radius is $R_{91}$. The both gears engage at a contact point $P_0$ among the pitch circles.

When the gears have a geometric error or an eccentricity, the pitch circles of the image carrier gear 11 and the driving means gear 91 deviate from $C_{11}$, and $C_{91}$ and turn out to be curves whose lengths from the axes of rotation O and $O_{91}$ are $r_{11}(\theta)$ and $r_{91}(\theta_{91})$ represents a rotational angle of the driving means gear 91 and is a function of the time t. While the engaging point is a point $P_1$ on the pitch circle of the image carrier gear 11 when the driving means gear 91 is pressed against the image carrier gear 11, the engaging position is located at the intermediate point of the both pitch circles, i.e. a middle point $P_3$ of a line segment $P_1$ and $P_2$ when the axis of rotation of the driving means gear 91 is fixed. In such a case, a rotational angular velocity $\omega_{11}(t)$ of the image carrier gear 11 at time t may be expressed by using a rotational angular velocity $\omega_{91}(t)$ of the driving means gear 91 like an equation (15). It is noted that for the sake of the simplification of the calculation, the pitch circles of the both gears are expressed by errors $\delta_{11}(\theta)$ and $\delta_{91}(\theta)$ from the ideal pitch circles and they are converted from $r_{11}(\theta)$ and $r_{91}(\theta_{91})$ using equations (16) and (17):

$$\omega_{11}(t) = \frac{2R_{91}-\delta_{11}(\theta(t))+\delta_{91}(\theta_{91}(t))}{2R_{11}+\delta_{11}(\theta(t))-\delta_{91}(\theta_{91}(t))}\omega_{91}(t) \tag{15}$$

$$\delta_{11}(\theta) = r_{11}(\theta) - R_{11} \tag{16}$$

$$\delta_{91}(\theta_{91}) = r_{91}(\theta_{91}) - R_{91} \tag{17}$$

From the equation (15), the peripheral speed $v_{1a}(t)$ of the image carrier 1 at the latent image forming position 1*a* at time t may be expressed as follows:

$$v_{1a}(t) = \frac{2R_{91}-\delta_{11}(\theta(t))+\delta_{91}(\theta_{91}(t))}{2R_{11}+\delta_{11}(\theta(t))-\delta_{91}(\theta_{91}(t))}r_1(\theta(t))\omega_{91}(t) \tag{18}$$

A relationship between rotational angular velocities $\omega_{11}(t)$ and $\omega_{81}(t)$ of the image carrier gear 11 and the conveying force transmitting gear 81 is calculated in the same manner also in the engagement of the image carrier gear 11 and the conveying force transmitting gear 81 and may be expressed as follows:

$$\omega_{81}(t) = \frac{2R_{11}-\delta_{11b}(\theta(t))-\delta_{81}(\theta_{81}(t))}{2R_{81}-\delta_{11b}(\theta(t))+\delta_{81}(\theta_{81}(t))}\omega_{11}(t) \tag{19}$$

wherein, $r_{81}$ is a radius of an ideal pitch circle of the conveying force transmitting gear 81 and $\delta_{81}(\theta_{81})$ is an error from the ideal pitch circle when the rotational angle of the gear is $\theta_{81}$.

From the equation (19), the speed $v_7(t+t_1)$ of the transfer member 7 may be expressed by using the rotational angular velocity $\omega_{91}(t)$ of the driving means gear 91 as follows:

$$v_7(t+t_1) = k'_8(t+t_1)\frac{2R_{11}+\delta_{11b}(\theta(t+t_1))-\delta_{81}(\theta_{81}(t+t_1))}{2R_{81}-\delta_{11b}(\theta(t+t_1))+\delta_{81}(\theta_{81}(t+t_1))}\omega_{11}(t+t_1) \tag{20}$$

In the equation (20), $k'_8(t+t_1)$ represents a ratio of the conveying speed $v_7(t)$ of the transfer member 7 to the rotational angular velocity $\omega_{81}(t)$ of the conveying force transmitting gear 81. When a calculation is made by the same procedure with the case when the driving means gear 91 and the conveying force transmitting gear 81 are pressed against the image carrier gear 11 by using the equations (18) and (20), a small length $\Delta p_7(t+t_1)$ of the image formed on the transfer member 7 at time $t+t_1$ may be expressed as follows:

$$\Delta p_7(t+t_1) = k'_8(t+t_1)\frac{2R_{11}+\delta_{11}(\theta(t+t_1-t_2))-\delta_{81}(\theta_{81}(t+t_1))}{2R_{81}-\delta_{11}(\theta(t+t_1-t_2))+\delta_{81}(\theta_{81}(t+t_1))}\frac{2R_{91}-\delta_{11}(\theta(t))-\delta_{91}(\theta_{91}(t))}{2R_{11}+\delta_{11}(\theta(t))-\delta_{91}(\theta_{91}(t))}\omega_{91}(t)\Delta t \tag{21}$$

Because $\delta_{11}(\theta)$, $\delta_{91}(\theta_{91})$ and $\delta_{81}(\theta)$ are fully small as compared to $R_{11}$, $R_{91}$ and $R_{81}$, the equation (21) may be approximated as follows:

$$\Delta p_7(t+t_1) \approx k'_8(t+t_1)\frac{R_{91}}{R_{81}}\left\{1+\frac{\delta_{11}(\theta(t+t_1-t_2))-\delta_{11}(\theta(t))}{2R_{11}}-\frac{\delta_{11}(\theta(t))}{2R_{91}}+\frac{\delta_{11}(\theta(t+t_1-t_2))}{2R_{81}}+\left(\frac{1}{2R_{11}}+\frac{1}{2R_{91}}\right)\delta_{91}(\theta_{91}(t))-\left(\frac{1}{2R_{11}}+\frac{1}{2R_{81}}\right)\delta_{81}(\theta_{81}(t+t_1))\right\}\omega_{91}(t)\Delta t \tag{22}$$

When the image forming—transferring time $t_1$ and the transfer drive transmitting time $t_2$ are equal in the equation (22), the equation (22) may be expressed as follows:

$$\Delta p_7(t+t_1) \approx k'_8(t+t_1)\frac{R_{91}}{R_{81}}\left\{1+\left(\frac{1}{2R_{81}}-\frac{1}{2R_{91}}\right)\delta_{11}(\theta(t))+\left(\frac{1}{2R_{11}}+\frac{1}{2R_{91}}\right)\delta_{91}(\theta_{91}(t))-\left(\frac{1}{2R_{11}}+\frac{1}{2R_{81}}\right)\delta_{81}(\theta_{81}(t+t_1))\right\}\omega_{91}(t)\Delta t \tag{23}$$

It can be understood from the equations (22) and (23) that although the term containing $\delta_{11}(\theta)$ remains in $\Delta p_7$ by equalizing the image forming—transferring time $t_1$ and the transfer drive transmitting time $t_2$, terms divided by $R_{11}$ are eliminated and the equation is simplified and that the influence to the expansion/contraction of the image on the transfer member 7 caused by the eccentricity of the image carrier gear 11 may be considerably relaxed even if the axes of rotation of the driving means gear 91 and the conveying force transmitting gear 81 are fixed. It can be also understood that when $R_{91}$ is equal with $R_{81}$, a term containing $\delta_{11}(\theta)$ is totally eliminated in $\Delta p_7$ and the influence to the expansion/contraction of the image on the transfer member 7 caused by the geometric error or eccentricity of the image carrier gear 11 may be completely canceled.

As described above, even when the axes of rotation of the driving means gear 91 and the conveying force transmitting gear 81 are fixed, the influence to the expansion/contraction of the image on the transfer member 7 caused by the geometric error or the eccentricity of the image carrier gear 11 may be considerably relaxed or canceled by equalizing the image forming—transferring time $t_1$ with the transfer drive transmitting time $t_2$.

The preferred embodiments of the image forming apparatus based on the principle of the present invention will be explained below with reference to the drawings.

Figure 6:
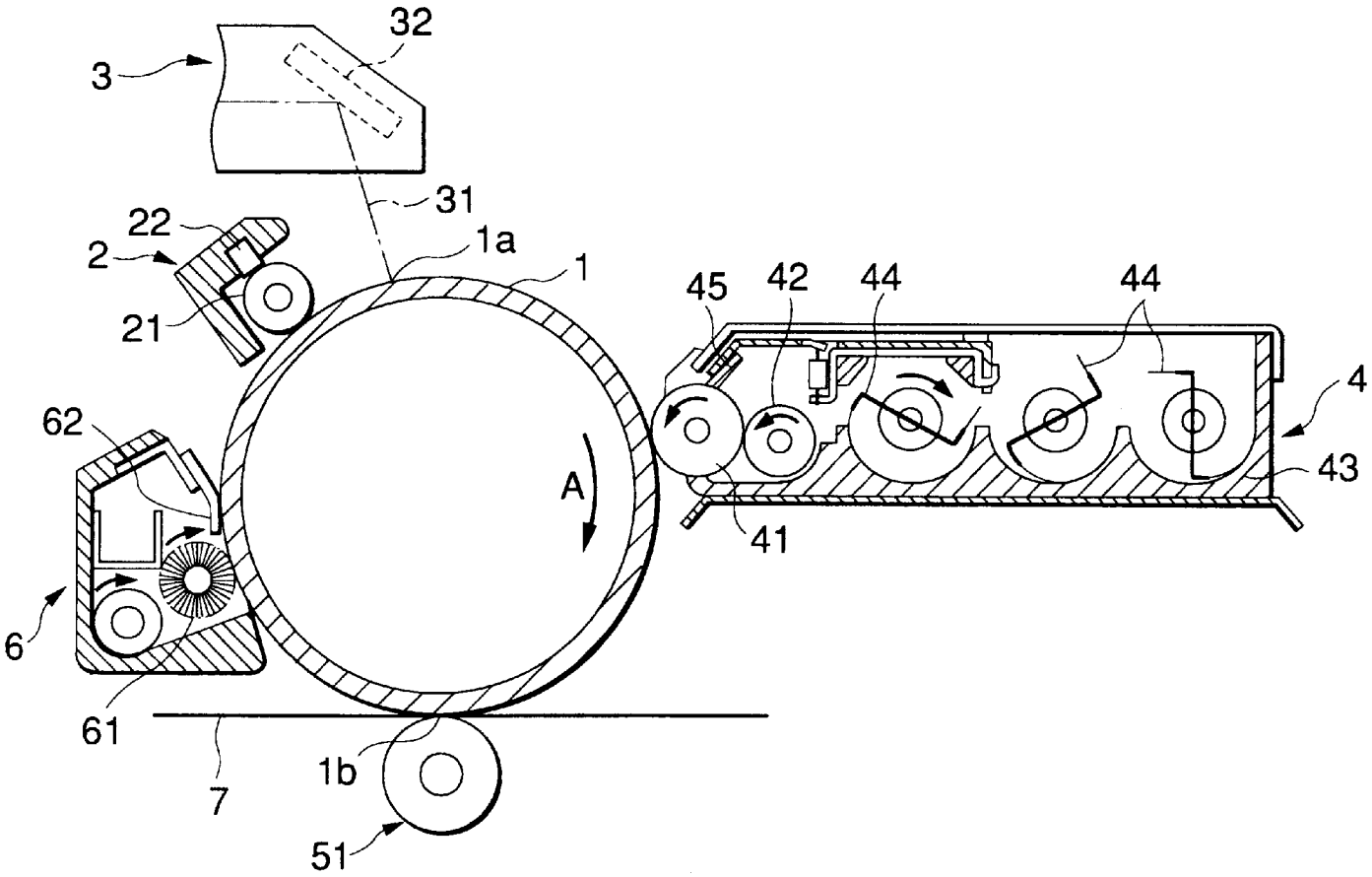
FIG. 6 is a front section view of the image forming apparatus showing a first embodiment of the present invention.

FIG. 6 is a front section view of the image forming apparatus showing a first embodiment of the present invention. The image forming apparatus of the present embodiment comprises main processing means such as a charging unit 2, an exposing unit 3, i.e. the latent image forming means, a developing unit 4, i.e. the developing means, a transfer section 5, i.e. the transferring means and a cleaner section 6 disposed around the image carrier 1 having a photoreceptor layer formed on an outer peripheral face of an aluminum elementary tube to be rotationally driven in the direction of an arrow A in the figure.

A process for forming an image will be sequentially explained with reference to FIG. 6. A charging roller 21 in the present embodiment is made of a semi-conductive elastic member such as rubber. It is applied with a bias of about DC (−)2 kV or less while rotating following the image carrier 1 which turns in the direction of the arrow A in the figure and charges the image carrier 1 uniformly to (−)600 V to (−)700 V of charging potential.

It is noted that the charging roller 21 is pressed against the image carrier 1 and is supported by a pressing mechanism comprising a spring 22 or the like and is pressed to and in contact with the image carrier 1 with about 1 kg of, total pressure.

Next, deflecting-scanning means for deflecting and scanning a light beam emitted from a light emitting element such as a semiconductor laser not shown is turned by mounting on an output shaft of a motor. The image carrier 1 is exposed at the latent image forming position 1*a* of the image carrier 1 to form a latent image by the incident light beam irradiated from the exposing unit 3 in which a reflecting mirror 32 or the like for forming a light path 31 for irradiating the light beam toward the image carrier 1 is stored. An electric potential at the image exposing section is (−)10 V to (−)150 V.

The developing unit 4 is arranged such that it contains developer within a developer storage section 43 for storing developer and transfers the developer to a developer supplying roller 42 by agitating developer transferring means comprising agitators 44. The developer supplying roller 42 transfers the developer on a surface of a developer carrier 41, frictionally electrifies the developer to negative (−) polarity by frictionally sliding with the developer carrier 41 and coats the developer on the surface of the developer carrier 41. A bias of about DC (−)200 V to (−)400 V has been applied to the developer carrier 41 and the developer conveyed while being carried on the surface of the rotating developer carrier 41 is restricted to a desired conveying amount by a restricting blade 45 and is frictionally electrified even more homogeneous negative (−) polarity. It is then conveyed to the image carrier 1 and is used to develop the latent image.

The developer image developed by the developer carrier 41 of the developing unit is conveyed in the direction of the arrow A in the figure and meets with the transfer member 7 driven by a transfer roller 51 which is transferring means and transfer member conveying means. A bias of about DC (+) 800 V is applied to the transfer roller 51 to transfer the developer image to the transfer member 7 at the transferring position 1*b* of the image carrier 1 and the image is then conveyed in a direction different from the moving path of the image carrier 1. It is then advanced to processing means prepared in the next step not shown.

After the transfer, the image carrier 1 is rotationally driven further in the direction of the arrow A in the figure to remove the remaining developer after the transfer by frictionally sliding the image carrier 1 with a rotary cleaning brush 61 disposed in the cleaning unit 6. The image carrier 1 also frictionally slides with a cleaning blade 62 to clean and wipe the developer which is to be conveyed to and stored in a remaining developer storage section not shown.

Figure 7:
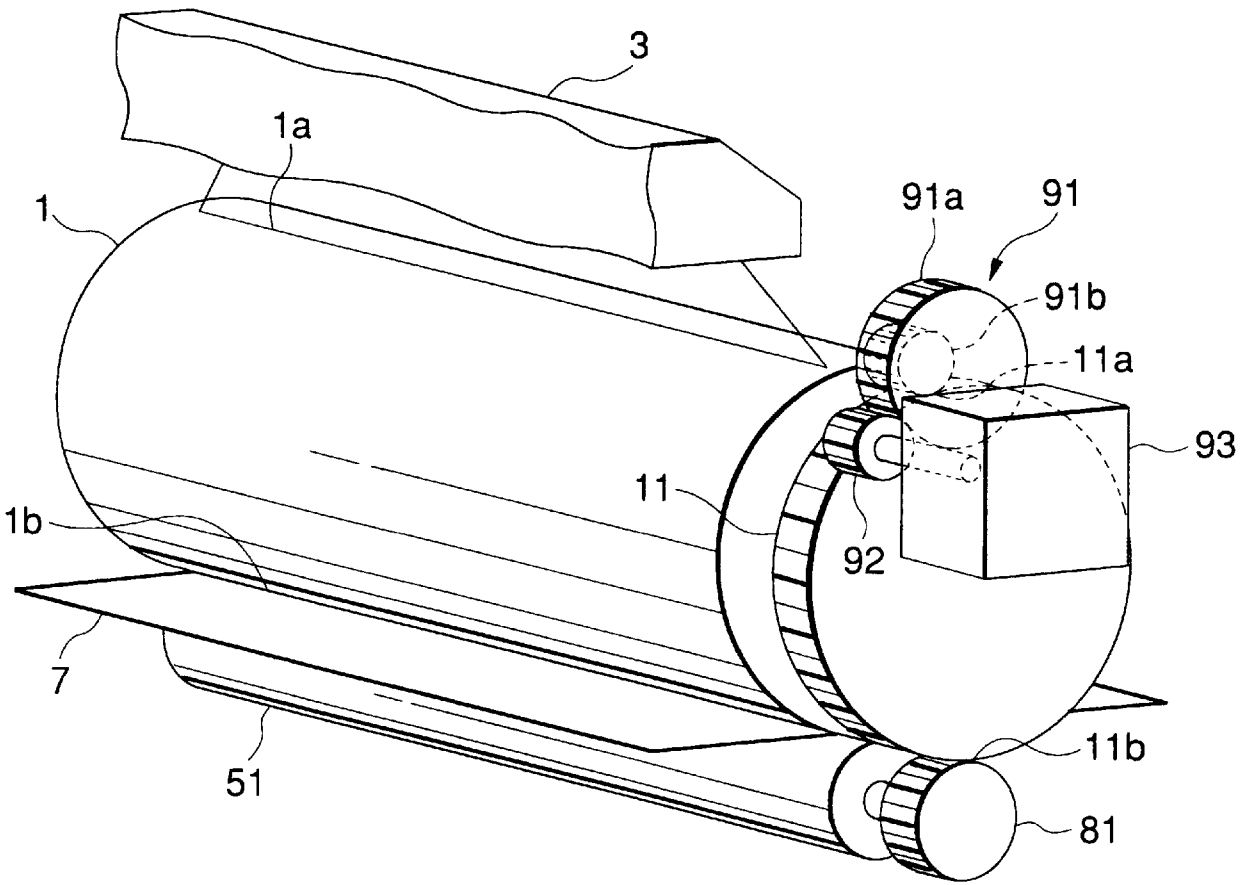
FIG. 7 is a perspective view showing a method for driving the image carrier and the transfer member in the first embodiment of the present invention.

Next, a method for driving the image carrier 1 and the transfer member 7 in the present embodiment will be explained with reference to FIG. 7. The image carrier 1 is attached with the image carrier gear 11 which is an image carrier driving member which rotates along with the image carrier 1 to transmit driving force from driving means to the image carrier 1 and the transfer member conveying means.

The driving means comprises the driving motor 93, the motor gear 92 attached to a driving shaft of the driving motor, and the driving means gear 91. The driving means gear 91 comprises a gear 91*a* having a pitch circle whose diameter is larger than that of the motor gear 92 and a gear 91*b* having a pitch circle whose diameter is smaller than that of the image carrier gear 11. They are rotatably supported so that the gear 91*a* engages with the motor gear 92 and the gear 91*b* engages with the image carrier gear 11 at the image carrier driving position 11*a,* respectively, and are arranged such that the axes of rotation thereof are pressed against the image carrier gear 11 by the pressing mechanism not shown and the image carrier gear 11 and the gear 91*b* engage always on the pitch circle of the image carrier gear 11. The driving force generated by the driving motor 93 is decelerated by two steps via the motor gear 92 and the driving means gear 91 and is transmitted to the image carrier gear 11.

The transfer member conveying means comprises the transfer roller 51 and the conveying force transmitting gear 81 which rotates along with the transfer roller 51. The conveying force transmitting gear 81 is arranged so that it engages with the image carrier gear 11 at the transfer driving position 11*b* and driving force is transmitted from the image carrier gear 11 to the transfer roller 51. The transfer roller 51 and the conveying force transmitting gear 81 are pressed against the image carrier 1 and the image carrier gear 11 and supported by the pressing mechanism not shown. They are arranged such that the image carrier gear 11 and the conveying force transmitting gear 81 engage always on the pitch circle of the image carrier gear 11 and the transfer roller 51 presses the transfer member 7 to the image carrier 1 to nip at the transferring position 1*b*. The peripheral face of the transfer roller 51 is coated by a material such as foaming rubber whose friction coefficient is higher than that of the image carrier 1 and the transfer roller 51 turns and conveys the transfer member 7 by frictional force.

Although the module of each gear of the image carrier gear 11, the driving means gear 91, the motor gear 92 and the conveying force transmitting gear 81 is desirable to be small as much as possible to reduce driving jitters, an allowance of the drive transmitting force is reduced or a strict inter-shaft precision is required if it is too small, so that it is determined by taking the balance among them and is desirable to be about 0.5 to 2. As for the shape of each gear, although a gear having involute tooth or helical gear may be used, the helical gear is desirable to reduce jitters because it allows the contact ratio to be increased. As for the material of each gear, although metals such as iron, aluminum, brass and sintered alloy or resins such as polyacetal may be used, polyacetal which has a vibration proofing effect is desirable in order to reduce jitters and noise.

The present embodiment is arranged such that the image carrier driving position 11*a* and the latent image forming position 1*a* become the same position with respect to the direction of rotation of the image carrier 1 and the image carrier gear 11. Further, the positions of the transferring position 1*b* and the transfer driving position 11*b* with respect to the direction of rotational angle are necessarily equal in the arrangement of the present embodiment. Therefore, according to the arrangement of the present embodiment, the time during which the image carrier 1 turns from the latent image forming position 1*a* to the transferring position 1*b* is equal with the time during which the image carrier gear 11 turns from the image carrier driving position 11*a* to the transfer driving position 11*b* and the influence to the expansion/contraction of the image on the transfer member 7 caused by the geometric error or eccentricity of the image carrier gear 11 may be totally canceled even if the image carrier gear 11 has them by the principle described above.

Figure 8:
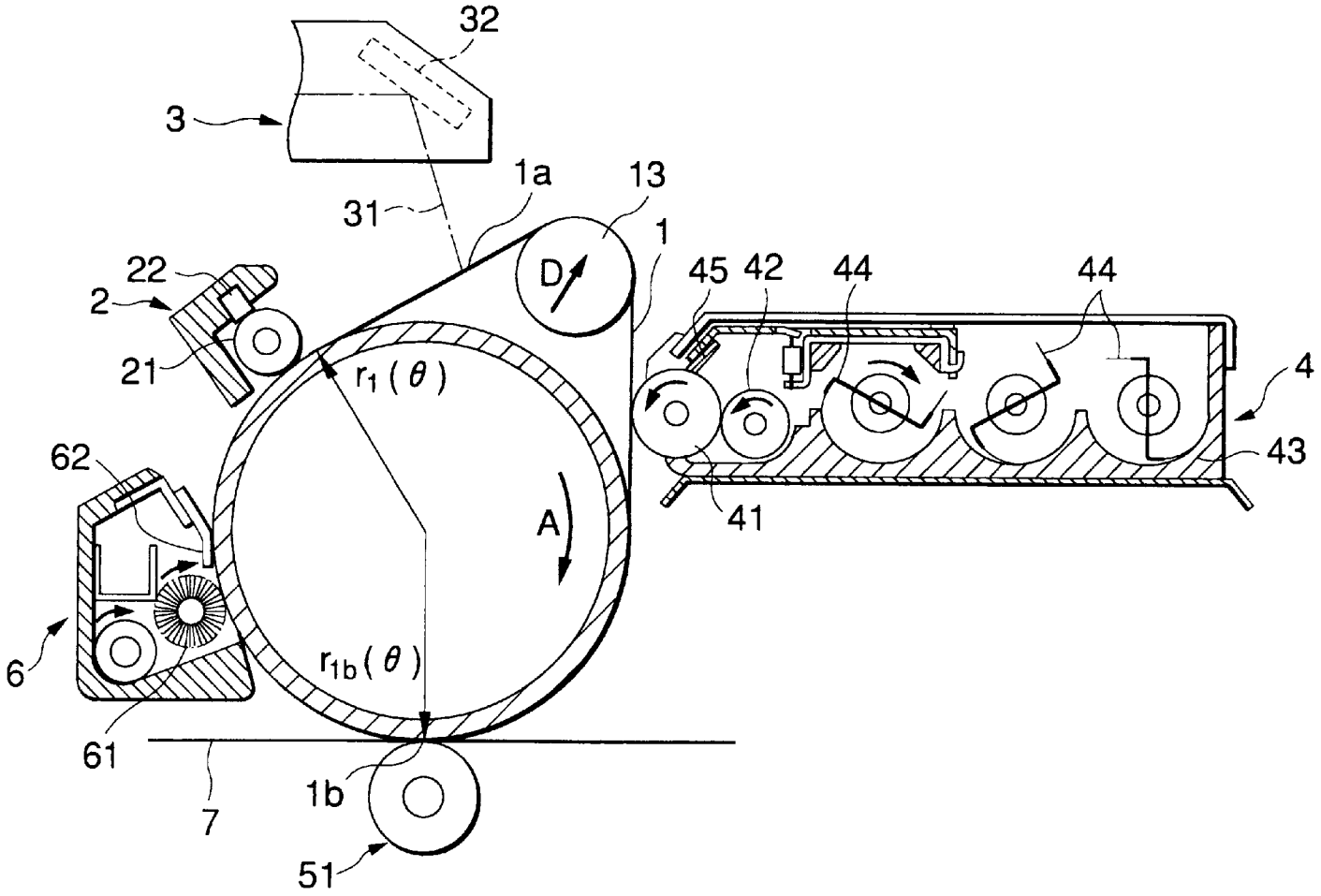
FIG. 8 is a front section view of the image forming apparatus showing a second embodiment of the present invention.

FIG. 8 is a front section view of the image forming apparatus showing a second embodiment of the present invention. The image forming apparatus of the present embodiment comprises main processing means such as the charging unit 2, the exposing unit 3, i.e. the latent image forming means, the developing unit 4, i.e. the developing means, the transfer section 5, i.e. the transferring means and the cleaner section 6 disposed around a belt-like image carrier 1 in which a photoreceptor layer is formed on an outer peripheral face of a flexible member such as a nickel electrocast tube and which is conveyed in the direction of an arrow A in the figure.

The present embodiment will be explained with reference to FIG. 8. The image carrier 1 of the present embodiment is supported by an image carrier driving roller 12 and a tension roller 13. The outer peripheral face of the image carrier driving roller 12 is coated by a material having a high frictional coefficient such as urethane rubber to convey the image carrier 1 by frictional force. The tension roller 13 is arranged such that it rotates following the conveyance of the image carrier 1 and supports the image carrier 1 by pressing in the direction of an arrow D in the figure by a pressing mechanism not shown to apply a tension to the image carrier 1.

Next, the members other than the image carrier 1 will be explained in the order of the process for forming an image. A charging roller 21 in the present embodiment is made of a semi-conductive elastic member such as rubber. It is applied with a bias of about DC (−)2 kV or less while rotating following the image carrier 1 which is conveyed in the direction of the arrow A in the figure and charges the image carrier 1 uniformly to (−)600 V to (−)700 V of charging potential.

It is noted that the charging roller 21 is pressed against the image carrier 1 and is supported by a pressing mechanism comprising a spring 22 or the like and is pressed to and in contact with the image carrier 1 with about 1 kg of total pressure.

Next, deflecting-scanning means for deflecting and scanning a light beam emitted from a light emitting element such as a semiconductor laser not shown is turned by mounting on an output shaft of a motor. The image carrier 1 is exposed at the latent image forming position 1*a* of the image carrier 1 to form a latent image by the incident light beam irradiated from the exposing unit 3 in which a reflecting mirror 32 or the like for forming a light path 31 for irradiating the light beam toward the image carrier 1 is stored. An electric potential at the image exposing section is (−)10 V to (−)150 V.

The developing unit 4 is arranged such that it contains developer within a developer storage section 43 for storing developer and transfers the developer to a developer supplying roller 42 by rotating developer transferring means comprising agitators 44. The developer supplying roller 42 transfers the developer on a surface of a developer carrier 41, frictionally electrifies the developer to negative (−) polarity by frictionally sliding with the developer carrier 41 and coats the developer on the surface of the developer carrier 41. A bias of about DC (−)200 V to (−)400 V has been applied to the developer carrier 41 and the developer conveyed while being carried on the surface of the rotating developer carrier 41 is restricted to a desired conveying amount by a restricting blade 45 and is frictionally electrified even more homogeneous negative (−) polarity. It is then conveyed to the image carrier 1 and is used to develop the latent image.

The developer image developed by the developer carrier 41 of the developing unit is conveyed in the direction of the arrow A in the figure and meets with the transfer member 7 driven by a transfer roller 51 which is transferring means and transfer member conveying means. A bias of about DC (+)800 V is applied to the transfer roller 51 to transfer the developer image to the transfer member 7 at the transferring position 1*b* of the image carrier 1 and the image is then conveyed in a direction different from the moving path of the image carrier 1. It is then advanced to processing means prepared in the next step not shown.

After the transfer, the image carrier 1 is rotationally driven further in the direction of the arrow A in the figure to remove the remaining developer after the transfer by frictionally sliding the image carrier 1 with a rotary cleaning brush 61 disposed in the cleaning unit 6. The image carrier 1 also frictionally slides with a cleaning blade 62 to clean and wipe the developer which is to be conveyed to and stored in a remaining developer storage section not shown.

Figure 9:
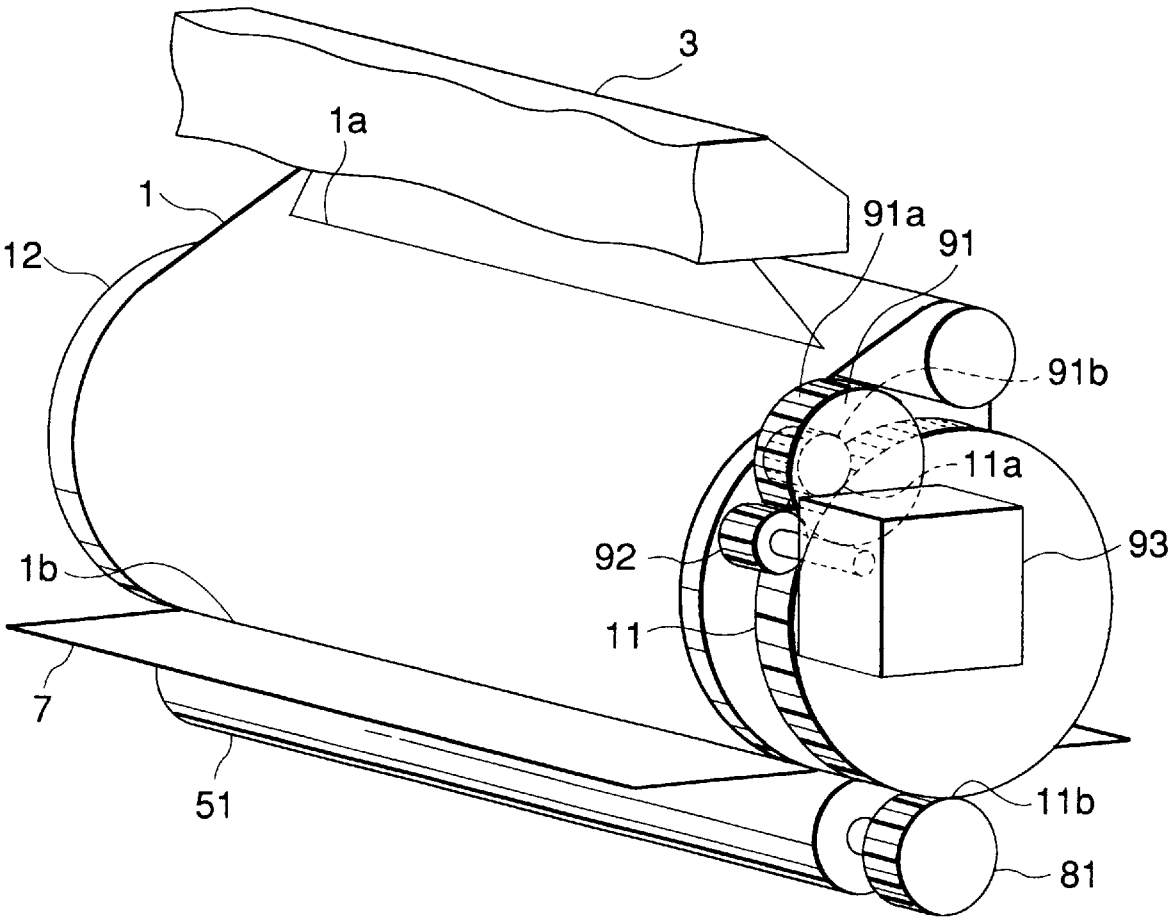
FIG. 9 is a perspective view showing a method for driving the image carrier and the transfer member in the second embodiment of the present invention.

Next, a method for driving the image carrier 1 and the transfer member 7 in the present embodiment will be explained with reference to FIG. 9. Along the rotation of the image carrier driving roller 12 , the image carrier 1 is conveyed by frictional force with the outer peripheral face of the image carrier driving roller 12. The image carrier driving roller 12 is attached with the image carrier gear 11 which is an image carrier driving member which rotates along with the image carrier driving roller 12 to transmit driving force from driving means to the image carrier 1 and the transfer member conveying means.

The driving means comprises the driving motor 93, the motor gear 92 attached to the driving shaft of the driving motor, and the driving means gear 91. The driving means gear 91 comprises the gear 91*a* having a pitch circle whose diameter is larger than that of the motor gear 92 and the gear 91*b* having a pitch circle whose diameter is smaller than that of the image carrier gear 11. They are rotatably supported so that the gear 91*a* engages with the motor gear 92 and the gear 91*b* engages with the image carrier gear 11 at the image carrier driving position 11*a,* respectively, and are arranged such that the axes of rotation thereof are pressed against the image carrier gear 11 by the pressing mechanism not shown and the image carrier gear 11 and the gear 91*b* engage always on the pitch circle of the image carrier gear 11. The driving force generated by the driving motor 93 is decelerated by two steps via the motor gear 92 and the driving means gear 91 and is transmitted to the image carrier gear 11.

The transfer member conveying means comprises the transfer roller 51 and the conveying force transmitting gear 81 which rotates along with the transfer roller 51. The conveying force transmitting gear 81 is arranged so that it engages with the image carrier gear 11 at the transfer driving position 11*b* and driving force is transmitted from the image carrier gear 11 to the transfer roller 51. The transfer roller 51 and the conveying force transmitting gear 81 are pressed against the image carrier 1 and the image carrier gear 11 and supported by the pressing mechanism not shown. They are arranged such that the image carrier gear 11 and the conveying force transmitting gear 81 engage always on the pitch circle of the image carrier gear 11 and the transfer roller 51 presses the transfer member 7 to the image carrier 1 to nip at the transferring position 1*b*. The peripheral face of the transfer roller 51 is coated by a material such as foaming rubber whose friction coefficient is higher than that of the image carrier 1 and the transfer roller 51 turns and conveys the transfer member 7 by frictional force.

Although the module of each gear of the image carrier gear 11, the driving means gear 91, the motor gear 92 and the conveying force transmitting gear 81 is desirable to be small as much as possible to reduce driving jitters, an allowance of the drive transmitting force is reduced or a strict inter-shaft precision is required if it is too small, so that it is determined by taking the balance among them and is desirable to be about 0.5 to 2. As for the shape of each gear, although a gear having involute tooth or helical gear may be used, the helical gear is desirable to reduce jitters because it allows the contact ratio to be increased. As for the material of each gear, although metals such as iron, aluminum, brass and sintered alloy or resins such as polyacetal may be used, polyacetal which has a vibration proofing effect is desirable in order to reduce jitters and noise.

The latent image forming position 1*a* and the image carrier driving position 11*a* are determined so that the time during which the image carrier 1 moves from the latent image forming position 1*a* to the transferring position 1*b* becomes equal to the time during which the image carrier gear 11 moves from the image carrier driving position 11*a* to the transfer driving position 11*b*.

In the present embodiment, the influence to the expansion/contraction of the image on the transfer member 7 may be calculated in the same manner as described above by assuming that a length $r_1(\theta)$ from the center of rotation of the image carrier 1 to the outer peripheral face thereof is a length from the center of rotation O of the image carrier driving roller 12 to the outer peripheral face thereof at a point 1*c* where the image carrier 1 separates from the image carrier driving roller 12 as shown in FIG. 8. However, because the image carrier 1 is belt-like and a circumferential length of the image carrier 1 is different from that of the image carrier driving roller 12, $r_1(\theta(t))$ described above is not necessarily equal to $r_{1b}(\theta(t+t_1))$. Therefore, the small length $\Delta p_7(t+t_1)$ on the transfer member 7 is expressed as follows:

$$\Delta p_7(t+t_1) = k_8(t+t_1)v_{91}(t)\frac{r_1(\theta(t))}{r_{1b}(\theta(t+t_1))}\Delta t \tag{24}$$

It can be understood from the equation (24) that although the influence of the length $r_1(\theta)$ from the center of rotation of the image carrier driving roller 12 to the outer peripheral face thereof remains to the small length $\Delta p_7(t+t_1)$, the length $r_{11}(\theta(t))$ from the center of rotation of the image carrier gear 11 to the pitch circle thereof will not affect by equalizing the image forming—transferring time $t_1$ and the transfer drive transmitting time $t_2$. Further, because $r_{11}(\theta(t))$ is a periodic function, $\Delta p_7(t+t_1)$ may be expressed like the equation (24) even when a relationship of the following equation (25) holds between the image forming—transferring time $t_1$ and the transfer drive transmitting time $t_2$:

$$t_1 = t_2 + nT_{12} \tag{25}$$

where, T12 is a rotational period of the image carrier driving roller 12 and n is an integer more than 1.

Therefore, according to the arrangement of the present embodiment, the influence to the expansion/contraction of the image on the transfer member 7 caused by the geometric error or the eccentricity of the image carrier gear 11 may be completely canceled even when the image carrier gear 11 has them by equalizing the time during which the image carrier 1 turns from the latent image forming position 1*a* to the transferring position 1*b* with the time during which the image carrier gear 11 turns from the image carrier driving position 11*a* to the transfer driving position 11*b* or by satisfying the relationship shown in the equation (25).

Figure 10:
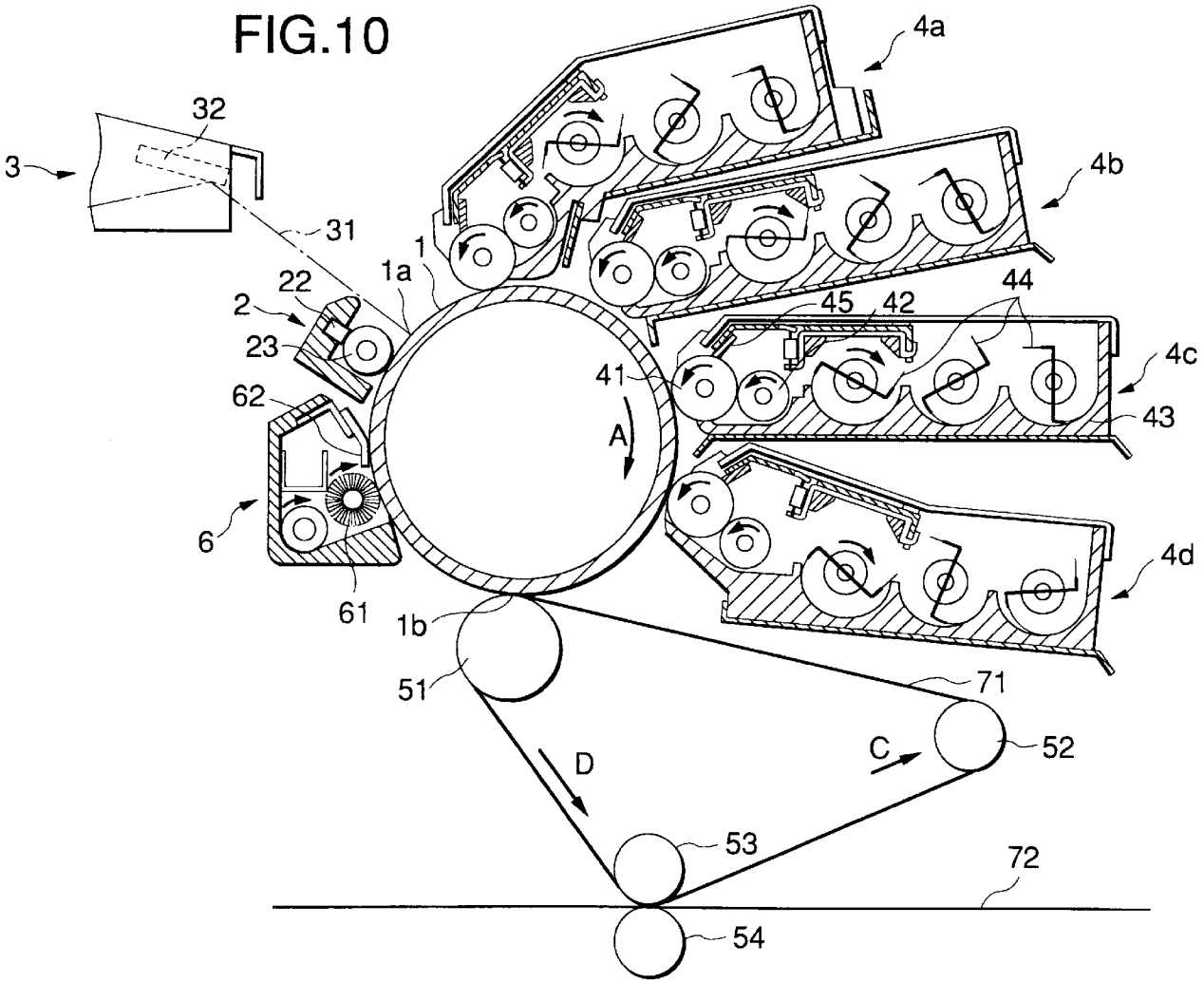
FIG. 10 is a front section view of the image forming apparatus showing a third embodiment of the present invention.

FIG. 10 is a front section view of the image forming apparatus showing a third embodiment of the present invention. The image forming apparatus of the present embodiment comprises main processing means such as the charging unit 2, the exposing unit 3, i.e. the latent image forming means, a plurality of developing units 4 which are developing means, the transfer section 5, i.e. the transferring means and the cleaner section 6 disposed around the image carrier 1 having a photoreceptor layer formed on an outer peripheral face of an aluminum elementary tube to be rotationally driven in the direction of an arrow A in the figure. The transfer member of the present embodiment comprises an intermediate transfer medium 71 and a secondary transfer member 72 to transfer developer images of plural colors on the image carrier 1 to the intermediate transfer medium 71 by laying one after another to form a color image and to transfer it to the secondary transfer member 72 to form a color image.

The present embodiment will be explained in the order of the process for forming an image with reference to FIG. 10. A charging roller 21 in the present embodiment is made of a semi-conductive elastic member such as rubber. It is applied with a bias of about DC (−)2 kV or less while rotating following the image carrier 1 which rotates in the direction of the arrow A in the figure and charges the image carrier 1 uniformly to (−)600 V to (−)700 V of charging potential.

It is noted that the charging roller 21 is pressed against the image carrier 1 and is supported by a pressing mechanism comprising a spring 22 or the like and is pressed to and in contact with the image carrier 1 with about 1 kg of total pressure.

Next, deflecting-scanning means for deflecting and scanning a light beam emitted from a light emitting element such as a semiconductor laser not shown is turned by mounting on an output shaft of a motor. The image carrier 1 is exposed at the latent image forming position 1*a* of the image carrier 1 to form a latent image by the incident light beam irradiated from the exposing unit 3 in which a reflecting mirror 32 or the like for forming a light path 31 for irradiating the light beam toward the image carrier 1 is stored. An electric potential at the image exposing section is (−)10 V to (−)150 V.

In the developing region having the plurality of developing units 4*a*, 4*b*, 4*c* and 4*d*, each developing unit is arranged such that each developing unit contains developer of different color of yellow, magenta, cyan or black and is put into a state in which it can develop the latent image selectively based on a command of a controller not shown. In FIG. 10, developing unit 4*c* is in the developable state in which a developer carrier 41 is in contact with the image carrier 1 and is driven by a driving unit not shown.

Meanwhile, the other developing units 4*a*, 4*b* and 4*d* are put in a standby state in which each developer carrier is separated from the image carrier 1 and is also driven by the driving unit not shown.

In the present embodiment, the plurality of developing units 4*a*, 4*b*, 4*c* and 4*d* disposed around the image carrier 1 are formed approximately into a shape of flat section in order to be able to store a desired amount of developer and to be able to dispose around the image carrier 1 while avoiding them interfering from each other.

Each developing unit is arranged such that it contains developer within a developer storage section 43 for storing developer and transfers the developer to a developer supplying roller 42 by rotating developer transferring means comprising agitators 44. The developer supplying roller 42 transfers the developer on a surface of a developer carrier 41, frictionally electrifies the developer to negative (−) polarity by frictionally sliding with the developer carrier 41 and coats the developer on the surface of the developer carrier 41. A bias of about DC (−)200 V to (−)400 V has been applied to the developer carrier 41 and the developer conveyed while being carried on the surface of the rotating developer carrier 41 is restricted to a desired conveying amount by a restricting blade 45 and is frictionally electrified even more homogeneous (−) polarity. It is then conveyed to the image carrier 1 and is used to develop the latent image.

The developer image developed by the developer carrier 41 of the developing unit 4*c* is conveyed in the direction of the arrow A in the figure and meets with the intermediate transfer medium 71. A bias of about DC (+)800 V is applied to the primary transfer roller 51 to transfer the developer image to the transfer member 7 at the transferring position 1*b* of the image carrier 1 and the image is then conveyed in a direction different from the moving path of the image carrier 1.

After the transfer, the image carrier 1 is rotationally driven further in the direction of the arrow A in the figure to remove the remaining developer after the transfer by frictionally sliding the image carrier 1 with a rotary cleaning brush 61 disposed in the cleaning unit 6. The image carrier 1 also frictionally slides with a cleaning blade 62 to clean and wipe the developer which is to be conveyed to and stored in a remaining developer storage section not shown.

The intermediate transfer medium 71 is a belt which is arranged so as to have a medium resistance by distributing conductive agent such as carbon in a resin such as polycarbonate and is supported by the primary transfer roller 51, a tension roller 52 and a secondary transfer upper roller 53. The primary transfer roller 51 serves as transferring means for transferring the developer image on the image carrier 1 to the intermediate transfer medium 71 and as driving means for periodically driving and conveying the intermediate transfer medium 71 in a path shown in the figure. The tension roller 52 is pressed in the direction of an arrow C in the figure and is supported by a pressing mechanism not shown to apply tension so that the intermediate transfer medium 71 does not become loose and rotates following the conveyance of the intermediate transfer medium 71. A secondary transfer roller 54 presses the secondary transfer member 72 against the intermediate transfer medium 71 by a pressing mechanism not shown and nips the secondary transfer member 72 together with the secondary transfer upper roller via the intermediate transfer medium 71. The secondary transfer upper roller rotates following the conveyance of the intermediate transfer medium 71.

The above-mentioned image forming process of transferring the developer image on the image carrier 1 to the intermediate transfer medium 71 is repeated four times while changing the developing unit to be abutted from the developing unit 4*a* to developing units 4*b*, 4*c* and 4*d*. The intermediate transfer medium 71 is conveyed through the path shown in the figure by four rounds to transfer the developer image of each developing unit one after another to form a color image. The color image formed on the intermediate transfer medium 71 is conveyed in the direction of an arrow D in the figure and meets with the secondary transfer member 72. A bias of about DC (+)1 kV is applied to the secondary transfer roller 54 to transfer the image to the secondary transfer member 72 and to form a color image. It is then conveyed in a direction different from the moving path of the intermediate transfer medium 71 and is advanced to processing means prepared for the next step not shown.

Figure 11:
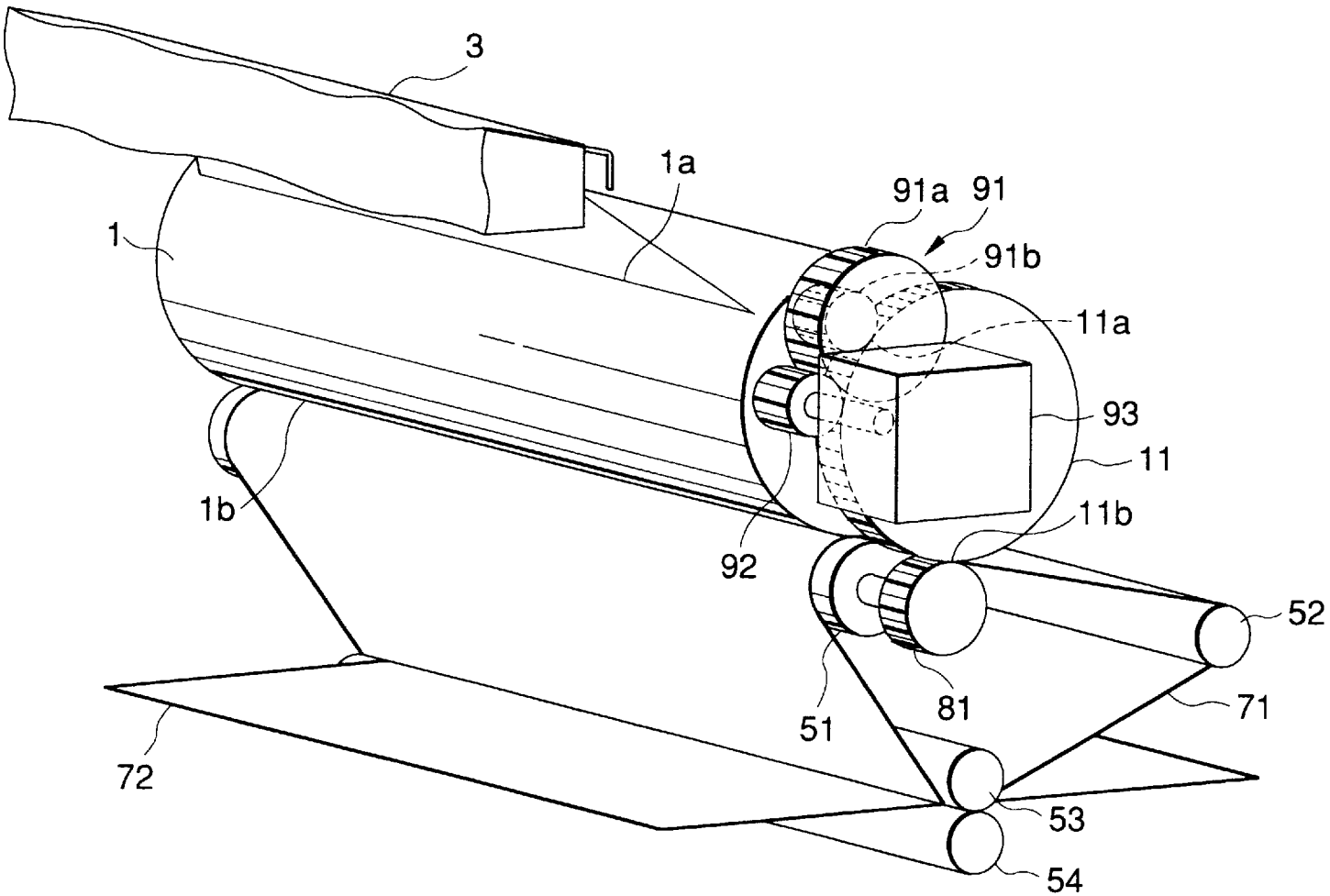
FIG. 11 is a perspective view showing a method for driving the image carrier and an intermediate transfer medium in the third embodiment of the present invention.

Next, a method for driving the image carrier 1 and the intermediate transfer medium 71 in the present embodiment will be explained with reference to FIG. 11. The image carrier 1 is attached with the image carrier gear 11 which rotates along with the image carrier 1 to transmit driving force from driving means to the image carrier 1 and the transfer member conveying means.

The driving means comprises the driving motor 93, the motor gear 92 attached to the driving shaft of the driving motor, and the driving means gear 91. The driving means gear 91 comprises the gear 91*a* having a pitch circle whose diameter is larger than that of the motor gear 92 and the gear 91*b* having a pitch circle whose diameter is smaller than that of the image carrier gear 11. They are rotatably supported so that the gear 91*a* engages with the motor gear 92 and the gear 91*b* engages with the image carrier gear 11 at the image carrier driving position 11*a*, respectively, and are arranged such that the axes of rotation thereof are pressed against the image carrier gear 11 by the pressing mechanism not shown and the image carrier gear 11 and the gear 91*b* engage always on the pitch circle of the image carrier gear 11. The driving force generated by the driving motor 93 is decelerated by two steps via the motor gear 92 and the driving means gears 91*a* and 91*b* to be transmitted to the image carrier gear 11.

The transfer member conveying means comprises the primary transfer roller 51 and the conveying force transmitting gear 81 which rotates along with the primary transfer roller 51. The conveying force transmitting gear 81 is arranged so that it engages with the image carrier gear 11 at the transfer driving position 11*b* and driving force is transmitted from the image carrier gear 11 to the transfer roller 51. The transfer roller 51 and the conveying force transmitting gear 81 are pressed against the image carrier 1 and the image carrier gear 11 by the pressing mechanism not shown. They are arranged such that the image carrier gear 11 and the conveying force transmitting gear 81 engage always on the pitch circle of the image carrier gear 11 and the transfer roller 51 presses the intermediate transfer medium 71 to the image carrier 1 to nip at the transferring position 1*b*. The peripheral face of the transfer roller 51 is coated by a material such as foaming rubber whose friction coefficient is higher than that of the image carrier 1 and the transfer roller 51 turns and conveys the intermediate transfer medium 71 by frictional force.

Although the module of each gear of the image carrier gear 11, the driving means gear 91, the motor gear 92 and the conveying force transmitting gear 81 is desirable to be small as much as possible to reduce driving jitters, an allowance of the drive transmitting force is reduced or a strict inter-shaft precision is required if it is too small, so that it is determined by taking the balance among them and is desirable to be about 0.5 to 2. As for the shape of each gear, although a gear having involute tooth or helical gear may be used, the helical gear is desirable to reduce jitters because it allows the contact ratio to be increased. As for the material of each gear, although metals such as iron, aluminum, brass and sintered alloy or resins such as/polyacetal may be used, polyacetal which has a vibration proofing effect is desirable in order to reduce jitters and noise.

The present embodiment is arranged such that the image carrier driving position 11*a* and the latent image forming position 1*a* become the same position with respect to the direction of rotation of the image carrier 1 and the image carrier gear 11. Further, the positions of the transferring position 1*b* and the transfer driving position 11*b* with respect to the direction of rotational angle are necessarily equal in the arrangement of the present embodiment. Therefore, according to the arrangement of the present embodiment, the time during which the image carrier 1 turns from the latent image forming position 1*a* to the transferring position 1*b* is equal with the time during which the image carrier gear 11 turns from the image carrier driving position 11*a* to the transfer driving position 11*b* and the influence to the expansion/contraction of the image on the secondary transfer member 72 caused by the geometric error or eccentricity of the image carrier gear 11 may be totally canceled even if the image carrier gear 11 has them by the principle described above.

When the color image is to be formed by laying the developer images of plural colors sequentially on the intermediate transfer medium 71 like the present embodiment in particular, a displacement in color or nonuniformity of color occurs in the image if the position of the developer image of each color deviates on the intermediate transfer medium 71. Generally, the sensitivity of human visibility on the displacement in color is much higher than the sensitivity on the expansion/contraction of the image when nonuniformity of speed is the same. Therefore, the image carrier used in the image forming apparatus for forming color images is required to be driven at extremely high precision. According to the arrangement of the present embodiment, the nonuniformity of speed of the image carrier 1 caused by the image carrier gear 11 may be completely canceled in the image forming apparatus for forming color images, allowing to provide high quality images having no displacement in color or nonuniformity of color.

Figure 12:
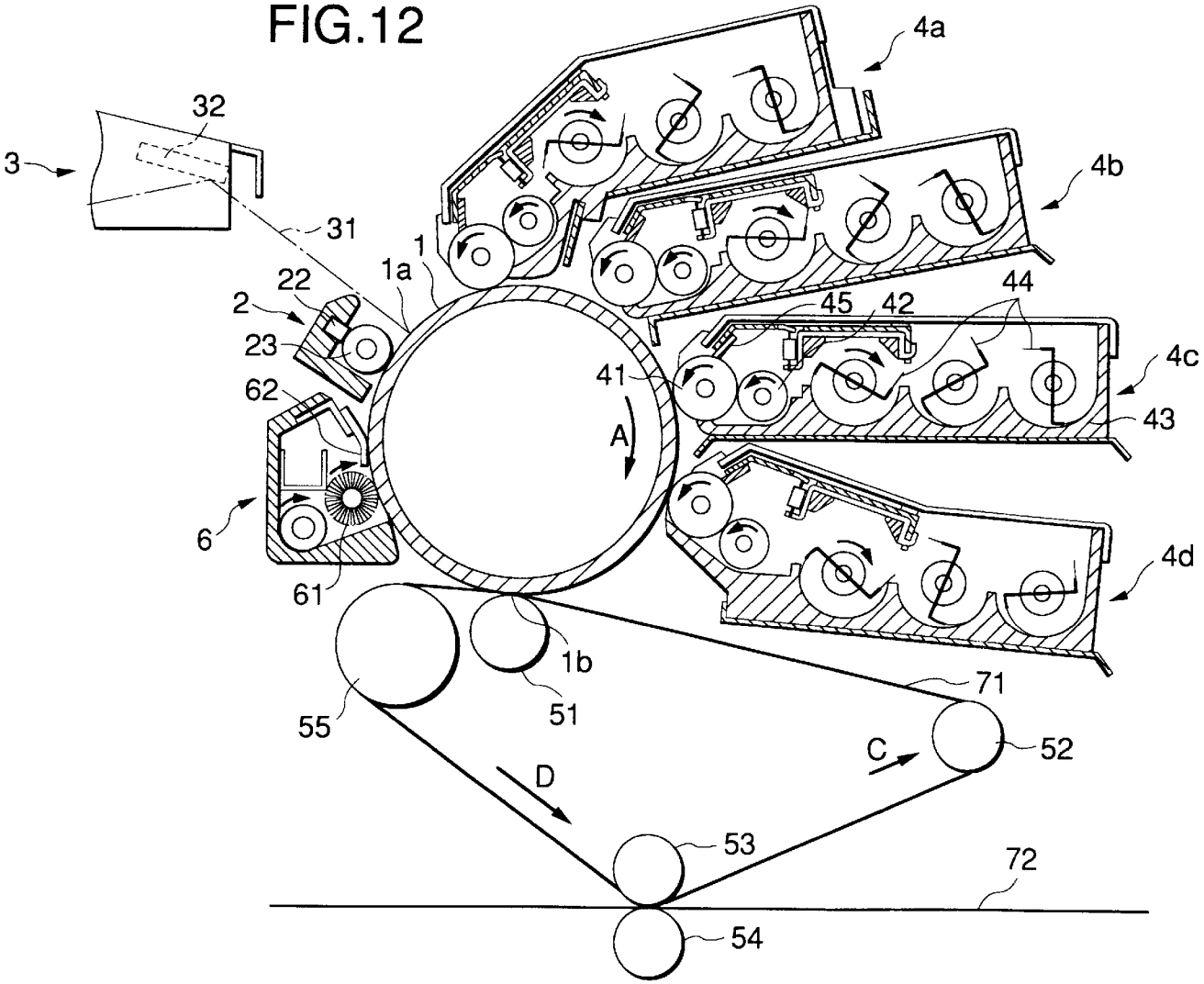
FIG. 12 is a front section view of the image forming apparatus showing a fourth embodiment of the present invention.

FIG. 12 is a front section view of the image forming apparatus showing a fourth embodiment of the present invention. The image forming apparatus of the present embodiment comprises main processing means such as the charging unit 2, the exposing unit 3, i.e. the latent image forming means, a plurality of developing units 4, i.e. the developing means, the transfer section 5, i.e. the transferring means and the cleaner section 6 disposed around the image carrier 1 having a photoreceptor layer formed on an outer peripheral face of an aluminum elementary tube to be rotationally driven in the direction of an arrow A in the figure. The transfer member of the present embodiment comprises an intermediate transfer medium 71 and a secondary transfer member 72 to transfer developer images of plural colors on the image carrier 1 to the intermediate transfer medium 71 by laying one after another to form a color image and to transfer it to the secondary transfer member 72 to form a color image.

The present embodiment will be explained in the order of the process for forming an image with reference to FIG. 12. A charging roller 21 in the present embodiment is made of a semi-conductive elastic member such as rubber. It is applied with a bias of about DC (−)2 kV or less while rotating following the image carrier 1 which rotates in the direction of the arrow A in the figure and charges the image carrier 1 uniformly to (−)600 V to (−)700 V of charging potential.

It is noted that the charging roller 21 is pressed against the image carrier 1 and is supported by a pressing mechanism comprising a spring 22 or the like and is pressed to and in contact with the image carrier 1 with about 1 kg of total pressure.

Next, deflecting-scanning means for deflecting and scanning a light beam emitted from a light emitting element such as a semiconductor laser not shown is turned by mounting on an output shaft of a motor. The image carrier 1 is exposed at the latent image forming position 1*a* of the image carrier 1 to form a latent image by the incident light beam irradiated from the exposing unit 3 in which a reflecting mirror 32 or the like for forming a light path 31 for irradiating the light beam toward the image carrier 1 is stored. An electric potential at the image exposing section is (−)10 V to (−)150 V.

In the developing region having the plurality of developing units 4*a,* 4*b,* 4*c* and 4*d,* each developing unit is arranged such that each developing unit contains developer of different color of yellow, magenta, cyan or black and it is put into a state in which it can develop the latent image selectively based on a command of a controller not shown. In FIG. 12, developing unit 4*c* is in the developable state in which a developer carrier 41 is in contact with the image carrier 1 and is driven by a driving unit not shown.

Meanwhile, the other developing units 4*a,* 4*b* and 4*d* are put in a standby state in which each developer carrier is separated from the image carrier 1 and is also driven by the driving unit not shown.

In the present embodiment, the plurality of developing units 4*a,* 4*b,* 4*c* and 4*d* disposed around the image carrier 1 are formed approximately into a shape of flat section in order to be able to store a desired amount of developer and to be able to dispose around the image carrier 1 while avoiding them interfering from each other.

Each developing unit is arranged such that it contains developer within a developer storage section 43 for storing developer and transfers the developer to a developer supplying roller 42 by rotating developer transferring means comprising agitators 44. The developer supplying roller 42 transfers the developer on a surface of a developer carrier 41, frictionally electrifies the developer to negative (−) polarity by frictionally sliding with the developer carrier 41 and coats the developer on the surface of the developer carrier 41. A bias of about DC (−)200 V to (−)400 V has been applied to the developer carrier 41 and the developer conveyed while being carried on the surface of the rotating developer carrier 41 is restricted to a desired conveying amount by a restricting blade 45 and is frictionally electrified even more homogeneous negative (−) polarity. It is then conveyed to the image carrier 1 and is used to develop the latent image.

The developer image developed by the developer carrier 41 of the developing unit 4*c* is conveyed in the direction of the arrow A in the figure and meets with the intermediate transfer medium 71. A bias of about DC (+)800 V is applied to the primary transfer roller 51 to transfer the developer image to the intermediate transfer member 72 at the transferring position 1*b* of the image carrier 1 and the image is then conveyed in a direction different from the moving path of the image carrier 1.

After the transfer, the image carrier 1 is rotationally driven further in the direction of the arrow A in the figure to remove the remaining developer after the transfer by frictionally sliding the image carrier 1 with a rotary cleaning brush 61 disposed in the cleaning unit 6. The image carrier 1 also frictionally slides with a cleaning blade 62 to clean and wipe the developer which is to be conveyed to and stored in a remaining developer storage section not shown.

The intermediate transfer medium 71 is a belt which is arranged so as to have a medium resistance by distributing conductive agent such as carbon in a resin such as polycarbonate and is supported by the primary transfer roller 51, a tension roller 52, a secondary transfer upper roller 53 and a medium driving roller 55. The primary transfer roller 51 serves as transferring means for transferring the developer image on the image carrier 1 to the intermediate transfer medium 71 and turns following the conveyance of the intermediate transfer medium 71. The tension roller 52 is pressed in the direction of an arrow C in the figure and is supported by a pressing mechanism not shown to apply tension so that the intermediate transfer medium 71 does not become loose and rotates following the conveyance of the intermediate transfer medium 71. A secondary transfer roller 54 presses the secondary transfer member 7 against the intermediate transfer medium 71 by a pressing mechanism not shown and nips the secondary transfer member 7 together with the secondary transfer upper roller via the intermediate transfer medium 71. The secondary transfer upper roller rotates following the conveyance of the intermediate transfer medium 71. The medium driving roller 55 conveys and drives the intermediate transfer medium 71 periodically through the path shown in the figure.

The above-mentioned image forming process of transferring the developer image on the image carrier 1 to the intermediate transfer medium 71 is repeated four times while changing the developing unit to be abutted from the developing unit 4*a* to developing units 4*b,* 4*c* and 4*d*. In the mean time, the intermediate transfer medium 71 is conveyed through the path shown in the figure by four rounds to transfer the developer image of each developing unit one after another to form a color image. The color image formed on the intermediate transfer medium 71 is conveyed in the direction of an arrow D in the figure and meets with the secondary transfer member 72. A bias of about DC (+)1 kV is applied to the secondary transfer roller 54 to transfer the image to the secondary transfer member 72 and to form a color image. The secondary transfer member 72 is then conveyed in a direction different from the moving path of the intermediate transfer medium 71 and is advanced to processing means prepared for the next step not shown.

Figure 13:
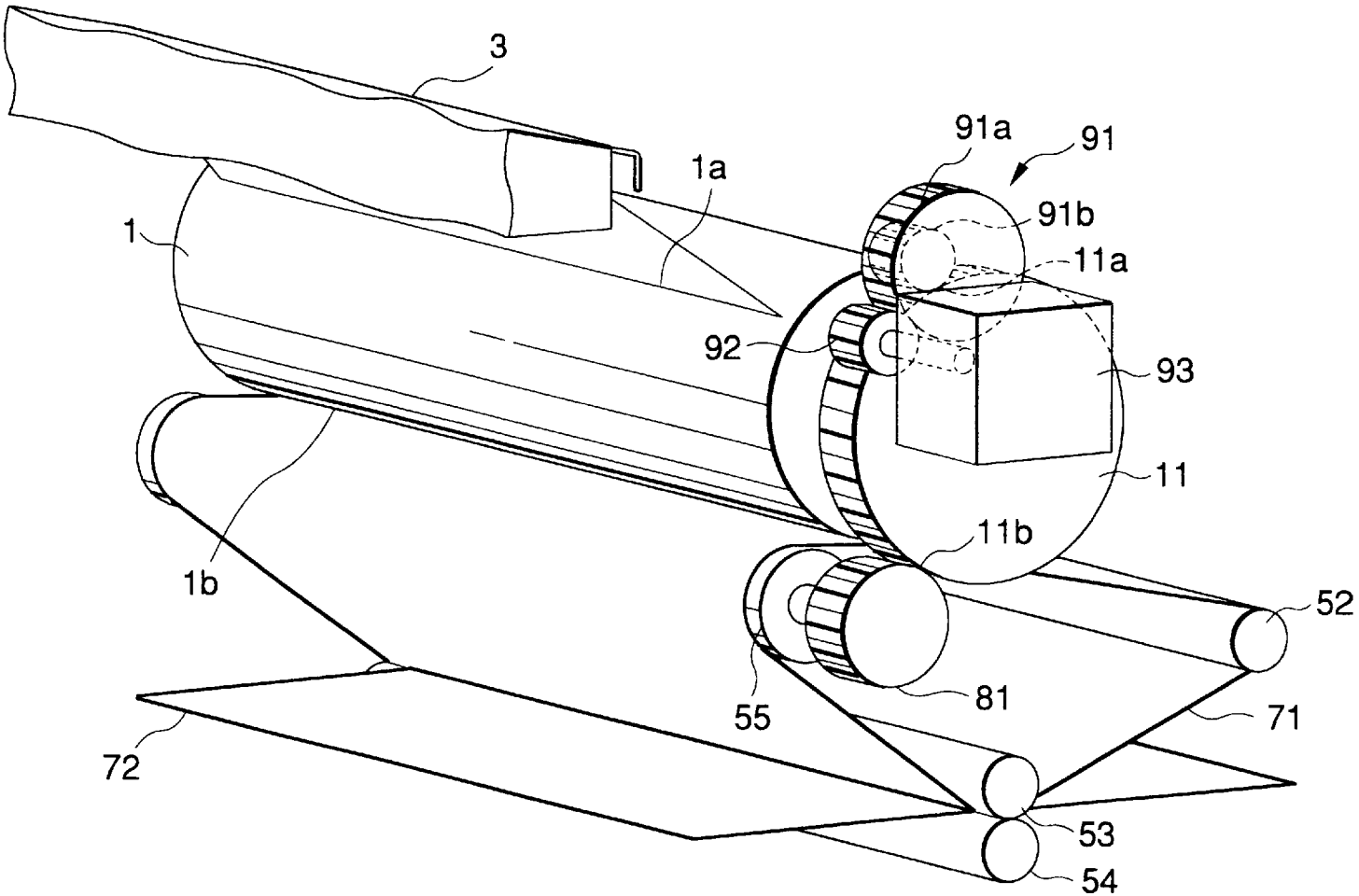
FIG. 13 is a perspective view showing a method for driving the image carrier and the intermediate transfer medium in the fourth embodiment of the present invention.

Next, a method for driving the image carrier 1 and the intermediate transfer medium 71 in the present embodiment will be explained with reference to FIG. 13. The image carrier 1 is attached with the image carrier gear 11 which rotates along with the image carrier 1 and which has a pitch circle whose diameter is larger than that of the image carrier 1 to transmit driving force from driving means to the image carrier 1 and the transfer member conveying means.

The driving means comprises the driving motor 93, the motor gear 92 attached to the driving shaft of the driving motor, and the driving means gear 91. The driving means gear 91 comprises the gear 91*a* having a pitch circle whose diameter is larger than that of the motor gear 92 and the gear 91*b* having a pitch circle whose diameter is smaller than that of the image carrier gear 11. They are rotatably supported around fixed axes of rotation so that the gear 91*a* engages with the motor gear 92 and the gear 91*b* engages with the image carrier gear 11 at the image carrier driving position 11*a,* respectively. The driving force generated by the driving motor 93 is decelerated by two steps via the motor gear 92 and the driving means gears 91*a* and 91*b* to be transmitted to the image carrier gear 11.

The transfer member conveying means comprises the medium driving roller 55 and the conveying force transmitting gear 81 which rotates along with the medium driving roller 55. The conveying force transmitting gear 81 is arranged so that it engages with the image carrier gear 11 at the transfer driving position 11*b*. The axis of rotation of the conveying force transmitting gear 81 is fixed and a length from the axis of rotation of the image carrier gear 11 does not change. The peripheral face of the medium driving roller 55 is coated by a material such as foaming rubber whose friction coefficient is high and the medium driving roller turns and conveys the intermediate transfer medium 71 by frictional force.

Although the module of each gear of the image carrier gear 11, the driving means gear 91, the motor gear 92 and the conveying force transmitting gear 81 is desirable to be small as much as possible to reduce driving jitters, an allowance of the drive transmitting force is reduced or a strict inter-shaft precision is required if it is too small, so that it is determined by taking the balance among them and is desirable to be about 0.5 to 2. As for the shape of each gear, although a gear having involute tooth or helical gear may be used, the helical gear is desirable to reduce jitters because it allows the contact ratio to be increased. As for the material of each gear, although metals such as iron, aluminum, brass and sintered alloy or resins such as polyacetal may be used, polyacetal which has a vibration proofing effect is desirable in order to reduce jitters and noise.

In the present embodiment, the positions of the transferring position 1*b* and the transfer driving position 11*b* with respect to the direction of rotation are not the same. Therefore, the positions of the image carrier driving position 11*a* and the latent image forming position 1*a* with respect to the direction of rotation are adequately changed so that the time during which the image carrier 1 turns from the latent image forming position 1*a* to the transferring position 1*b* is equal with the time during which the image carrier gear 11 turns from the image carrier driving position 11*a* to the transfer driving position 11*b*. Further, in the present embodiment, the axes of rotation of the driving means gear 91 and the conveying force transmitting gear 81 are fixed. Therefore, according to the arrangement of the present embodiment, the influence to the expansion/contraction of the image on the secondary transfer member 72 caused by the geometric error or eccentricity of the image carrier gear 11 may be relaxed considerably even if the image carrier gear 11 has them.

When the color image is to be formed by laying the developer images of plural colors one after another on the intermediate transfer medium 71 like the present embodiment in particular, a displacement in color or nonuniformity of color occurs in the image if the position of the developer image of each color deviates on the intermediate transfer medium 71. Generally, the sensitivity of human visibility on the displacement in color is much higher than the sensitivity on the expansion/contraction of the image when nonuniformity of speed is the same. Therefore, the image carrier used in the image forming apparatus for forming color images is required to be driven at extremely high precision. According to the arrangement of the present embodiment, the nonuniformity of speed of the image carrier 1 caused by the image carrier gear 11 may be relaxed considerably in the image forming apparatus for forming color images, allowing to provide high quality images having no displacement in color or nonuniformity of color.

Further, a degree of freedom on the respective formations and materials of the members increases, the intermediate transfer medium 71 can be driven at higher precision and the highly efficient transfer can be realized by separating the transferring means for transferring images from the image carrier 1 to the intermediate transfer medium 71 and the driving means for driving the intermediate transfer medium 71 like the arrangement of the present embodiment.

Figure 14:
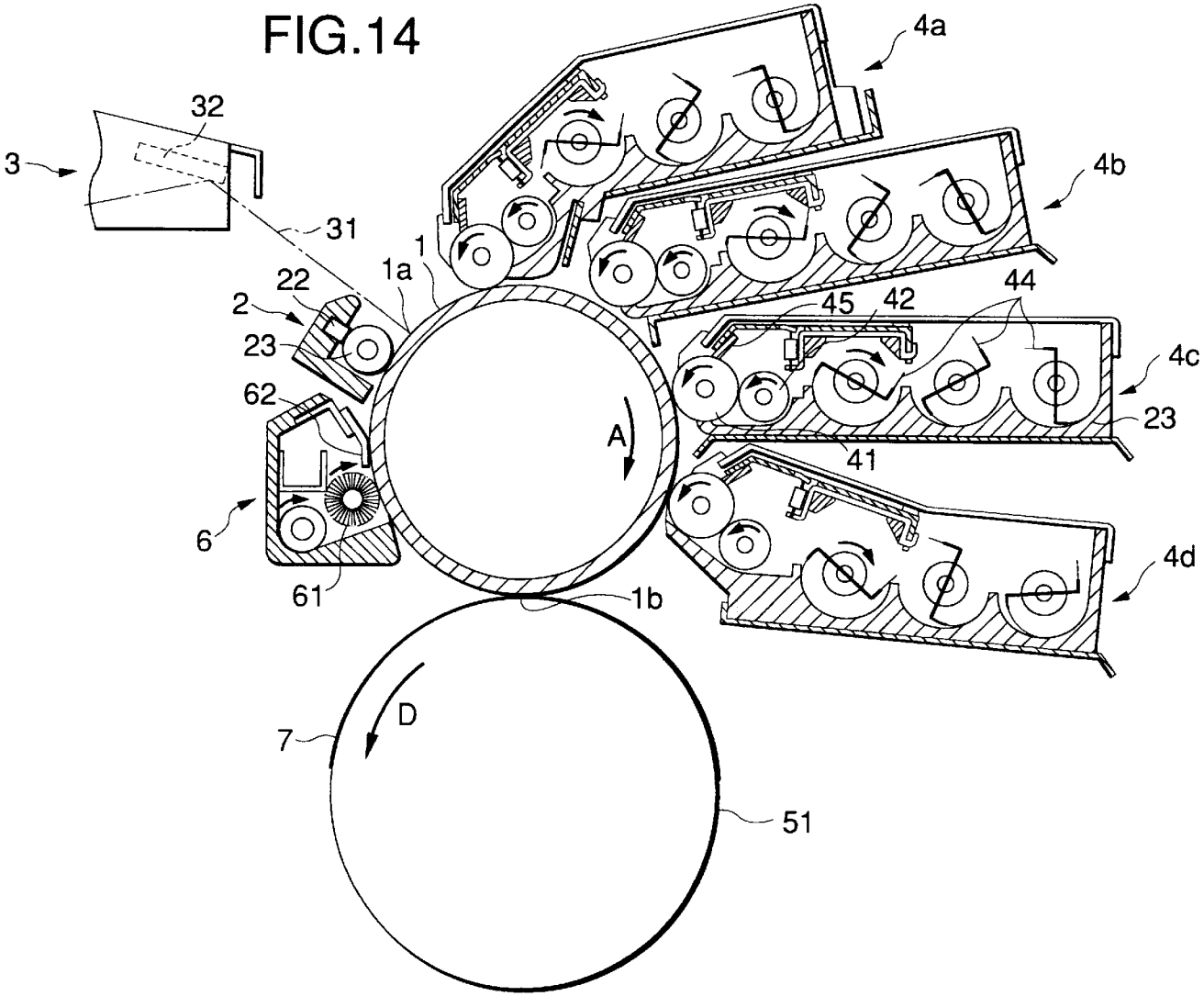
FIG. 14 is a front section view of the image forming apparatus showing a fifth embodiment of the present invention.

FIG. 14 is a front section view of the image forming apparatus showing a fifth embodiment of the present invention. The image forming apparatus of the present embodiment comprises main processing means such as the charging unit 2, the exposing unit 3, i.e. the latent image forming means, a plurality of developing units 4, i.e. the developing means, the transfer section 5, i.e. the transferring means and the cleaner section 6 disposed around the image carrier 1 having a photoreceptor layer formed on an outer peripheral face of an aluminum elementary tube to be rotationally driven in the direction of an arrow A in the figure. The transfer member 7 of the present embodiment is attached on a peripheral face of a transfer drum 51 and a color image is formed by transferring developer images of plural colors on the image carrier 1 to the transfer member 7 by laying one after another by rotating the transfer member 7 a plurality of times along with the transfer drum 51.

The present embodiment will be explained in the order of the process for forming an image with reference to FIG. 14. A charging roller 21 in the present embodiment is made of a semi-conductive elastic member such as rubber. It is applied with a bias of about DC (−)2 kV or less while rotating following the image carrier 1 which rotates in the direction of the arrow A in the figure and charges the image carrier 1 uniformly to (−)600 V to (−)700 V of charging potential.

It is noted that the charging roller 21 is pressed against the image carrier 1 and is supported by a pressing mechanism comprising a spring 22 or the like and is pressed to and in contact with the image carrier 1 with about 1 kg of total pressure.

Next, deflecting-scanning means for deflecting and scanning a light beam emitted from a light emitting element such as a semiconductor laser not shown is turned by mounting on an output shaft of a motor. The image carrier 1 is exposed at the latent image forming position 1*a* of the image carrier 1 to form a latent image by the incident light beam irradiated from the exposing unit 3 in which a reflecting mirror 32 or the like for forming a light path 31 for irradiating the light beam toward the image carrier 1 is stored. An electric potential at the image exposing section is (−)10 V to (−)150 V.

In the developing region having the plurality of developing units 4*a*, 4*b*, 4*c* and 4*d*, each developing unit is arranged such that each developing unit contains developer of different color of yellow, magenta, cyan or black and it is put into a state in which it can develop the latent image selectively based on a command of a controller not shown. In FIG. 14, developing unit 4*c* is in the developable state in which a developer carrier 41 is in contact with the image carrier 1 and is driven by a driving unit not shown.

Meanwhile, the other developing units 4*a*, 4*b* and 4*d* are put in a standby state in which each developer carrier is separated from the image carrier 1 and is also driven by the driving unit not shown.

In the present embodiment, the plurality of developing units 4*a*, 4*b*, 4*c* and 4*d* disposed around the image carrier 1 are formed approximately into a shape of flat section in order to be able to store a desired amount of developer and to be able to dispose around the image carrier 1 while avoiding them interfering from each other.

Each developing unit is arranged such that it contains developer within a developer storage section 43 for storing developer and transfers the developer to a developer supplying roller 42 by rotating developer transferring means comprising agitators 44. The developer supplying roller 42 transfers the developer on a surface of a developer carrier 41, frictionally electrifies the developer to negative (–) polarity by frictionally sliding with the developer carrier 41 and coats the developer on the surface of the developer carrier 41. A bias of about DC (–)200 V to (–)400 V has been applied to the developer carrier 41 and the developer conveyed while being carried on the surface of the rotating developer carrier 41 is restricted to a desired conveying amount by a restricting blade 45 and is frictionally electrified even more homogeneous negative (–) polarity. It is then conveyed to the image carrier 1 and is used to develop the latent image.

The developer image developed by the developer carrier 41 of the developing unit 4*c* is conveyed in the direction of the arrow A in the figure and meets with the transfer member 7 on the transfer drum 51. A bias of about DC (+)800 V is applied to the transfer drum 51 to transfer the developer image to the transfer member 7 at the transferring position 1*b* of the image carrier 1 and the image is then conveyed in a direction different from the moving path of the image carrier 1.

After the transfer, the image carrier 1 is rotationally driven further in the direction of the arrow A in the figure to remove the remaining developer after the transfer by frictionally sliding the image carrier 1 with a rotary cleaning brush 61 disposed in the cleaning unit 6. The image carrier 1 also frictionally slides with a cleaning blade 62 to clean and wipe the developer which is to be conveyed to and stored in a remaining developer storage section not shown.

The transfer member 7 is attached around the peripheral face of the transfer drum 51 by means of an attaching device not shown utilizing electrostatic absorption or the like. The transfer drum 51 serves as transfer member for transferring the developed image on the image carrier 1 to the transfer member 7 and driving means for rotationally driving the transfer member 7 in the direction of an arrow D in the figure.

The above-mentioned image forming process of transferring the developer image on the image carrier 1 to the transfer member 7 is repeated four times while changing the developing unit to be abutted from the developing unit 4*a* to developing units 4*b*, 4*c* and 4*d*. In the mean time, the transfer drum 51 turns four times to transfer the developer image of each developing unit to the transfer member 7 one after another to form a color image. Then, the transfer member 7 is peeled off from the transfer drum 51 and is conveyed by a conveying mechanism not shown to advance to processing means prepared for the next step not shown.

Figure 15:
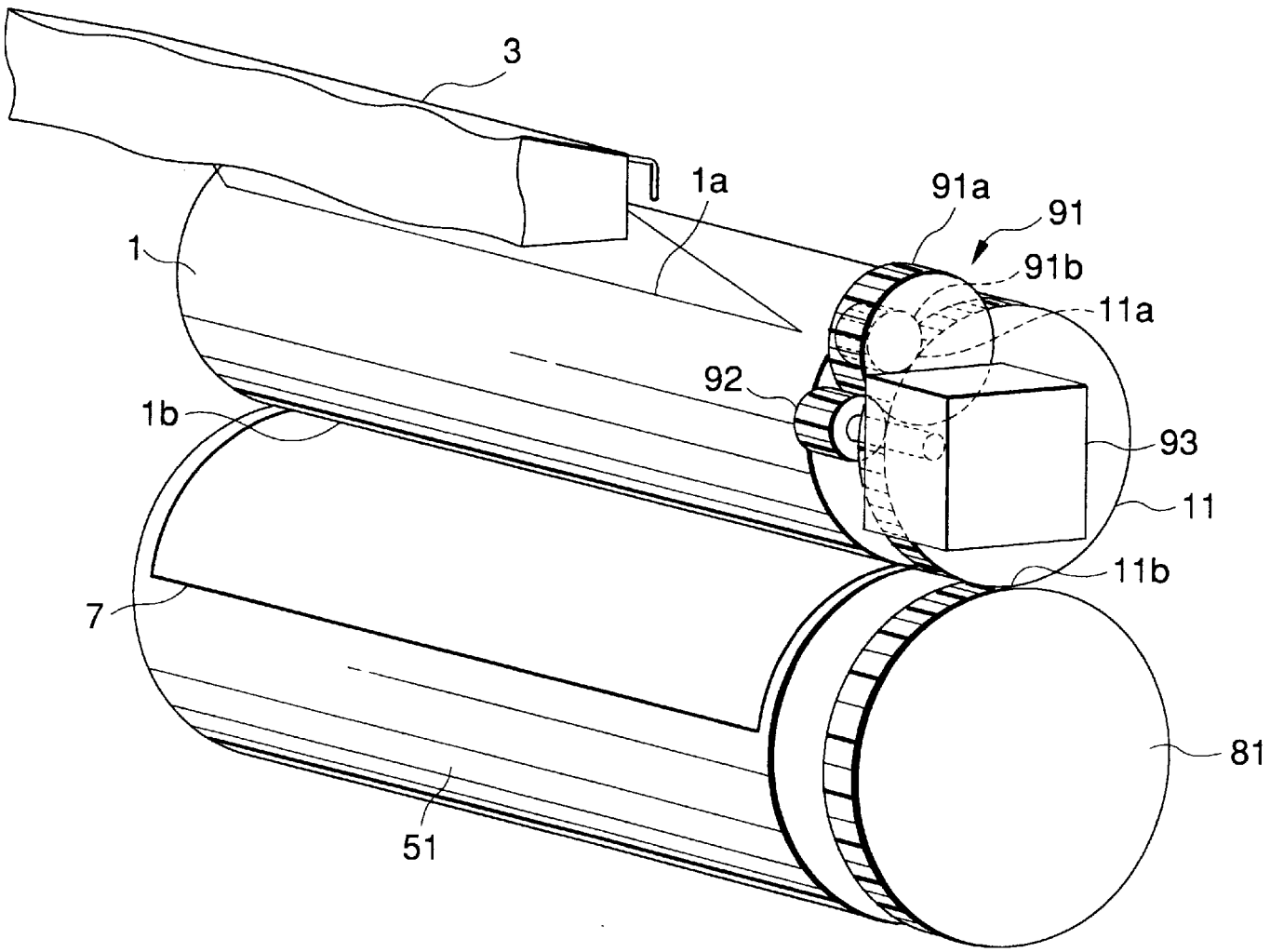
FIG. 15 is a perspective view showing a method for driving the image carrier and a transfer drum in the fifth embodiment of the present invention.

Next, a method for driving the image carrier 1 and the transfer drum 51 in the present embodiment will be explained with reference to FIG. 15. The image carrier 1 is attached with the image carrier gear 11 which rotates along with the image carrier 1 to transmit driving force from driving means to the image carrier 1 and the transfer member conveying means.

The driving means comprises the driving motor 93, the motor gear 92 attached to the driving shaft of the driving motor, and the driving means gear 91. The driving means gear 91 comprises the gear 91*a* having a pitch circle whose diameter is larger than that of the motor gear 92 and the gear 91*b* having a pitch circle whose diameter is smaller than that of the image carrier gear 11. They are rotatably supported so that the gear 91*a* engages with the motor gear 92 and the gear 91*b* engages with the image carrier gear 11 at the image carrier driving position 11*a*, respectively, the axes of rotation thereof are pressed against the image carrier gear 11 by a pressing mechanism not shown and the image carrier gear 11 engages with the gear 91*b* always on the pitch circle of the image carrier gear 11. The driving force generated by the driving motor 93 is decelerated by two steps via the motor gear 92 and the driving means gears 91*a* and 91*b* to be transmitted to the image carrier gear 11.

The transfer member conveying means comprises the transfer drum 51 and the conveying force transmitting gear 81 which rotates along with the transfer drum 51. The conveying force transmitting gear 81 is arranged so that it engages with the image carrier gear 11 at the transfer driving position 11*b* to transfer driving force from the image carrier gear 11 to the transfer drum 51. The transfer drum 51 and the conveying force transmitting gear 81 are arranged such that they are pressed against the image carrier 1 and the image carrier gear 11 and supported by a pressing mechanism not shown, the conveying force transmitting gear 81 engages with the image carrier gear 11 always on the pitch circle of the image carrier gear 11 and the transfer drum 51 nips the transfer member 7 by pressing it to the image carrier 1 at the transferring position lb.

Although the module of each gear of the image carrier gear 11, the driving means gear 91, the motor gear 92 and the conveying force transmitting gear 81 is desirable to be small as much as possible to reduce driving jitters, an allowance of the drive transmitting force is reduced or a strict inter-shaft precision is required if it is too small, so that it is determined by taking the balance among them and is desirable to be about 0.5 to 2. As for the shape of each gear, although a gear having involute tooth or helical gear may be used, the helical gear is desirable to reduce jitters because it allows the contact ratio to be increased. As for the material of each gear, although metals such as iron, aluminum, brass and sintered alloy or resins such as polyacetal may be used, polyacetal which has a vibration proofing effect is desirable in order to reduce jitters and noise.

The present embodiment is arranged such that the image carrier driving position 11*a* and the latent image forming position 1*a* become the same with respect to the direction of rotation of the image carrier 1 and the image carrier gear 11. Therefore, the transferring position 1*b* and the transfer driving position 11*b* are necessarily equal with respect to the direction of rotational angle. Then, according to the arrangement of the present embodiment, the time during which the image carrier 1 turns from the latent image forming position 1*a* to the transferring position 1*b* is equal with the time during which the image carrier gear 11 turns from the image carrier driving position 11*a* to the transfer driving position 11*b*, so that the influence to the expansion/contraction of the image on the transfer member 7 caused by the geometric error or eccentricity of the image carrier gear 11 may be completely canceled even if the image carrier gear 11 has them.

When the color image is to be formed by laying the developer images of different colors one after another on the transfer member 7 like the present embodiment in particular, a displacement in color or nonuniformity of color occurs in the image if the position of the developer image of each color deviates on the transfer member 7. Generally, the sensitivity of human visibility on the displacement in color is much higher than the sensitivity on the expansion/contraction of the image when nonuniformity of speed is the same. Therefore, the image carrier used in the image forming apparatus for forming color images is required to be driven at extremely high precision. According to the arrangement of the present embodiment, the nonuniformity of speed of the image carrier 1 caused by the image carrier gear 11 may be completely canceled in the image forming apparatus for forming color images, allowing to provide high quality images having no displacement in color or nonuniformity of color.

As described above, according to the arrangement of the present invention, the influence to the image formed on the transfer member caused by the geometric error or the eccentricity of the image carrier gear may be canceled or relaxed by equalizing the image forming—transferring time almost with the transfer drive transmitting time, so that the image forming apparatus capable of forming high quality images having no expansion/contraction may be provided.

Further, the influence to the expansion/contraction of the image caused by the eccentricity of the image carrier gear may be relaxed to a half by setting the time difference ratio $k_T$ at 0.167 or less, allowing the expansion/contraction of the image to be put on a level posing no problem in forming a monochromatic image by the image forming apparatus.

Still more, the expansion/contraction of the image caused by the geometric error or eccentricity of the image carrier gear may be completely canceled by pressing the driving means gear and the conveying force transmitting gear against the image carrier gear when the image forming—transferring time is equal with the transfer drive transmitting time.

When the present invention is applied to the image forming apparatus equipped with a plurality of developing units for forming a color image by laying and transferring images on the image carrier to a transfer member one after another, the present invention allows displacement in color or nonuniformity of color which might otherwise caused by the geometric error or the eccentricity of the image carrier gear to be canceled or relaxed, so that it allows the image forming apparatus which is capable of forming high quality color images to be provided.

Further, the influence to the expansion/contraction, displacement in color and nonuniformity of color of the image caused by the eccentricity of the image carrier gear may be relaxed to ⅕ by setting the time difference ratio $k_T$ at 0.064 or less, allowing the displacement in color or nonuniformity of color of the image to be put on a level posing no problem in terms of the image quality in forming a color image by the image forming apparatus.

Further embodiment of the present invention will be explained below by exemplifying an equipment for forming a color image with reference to the drawings.

Figure 16:
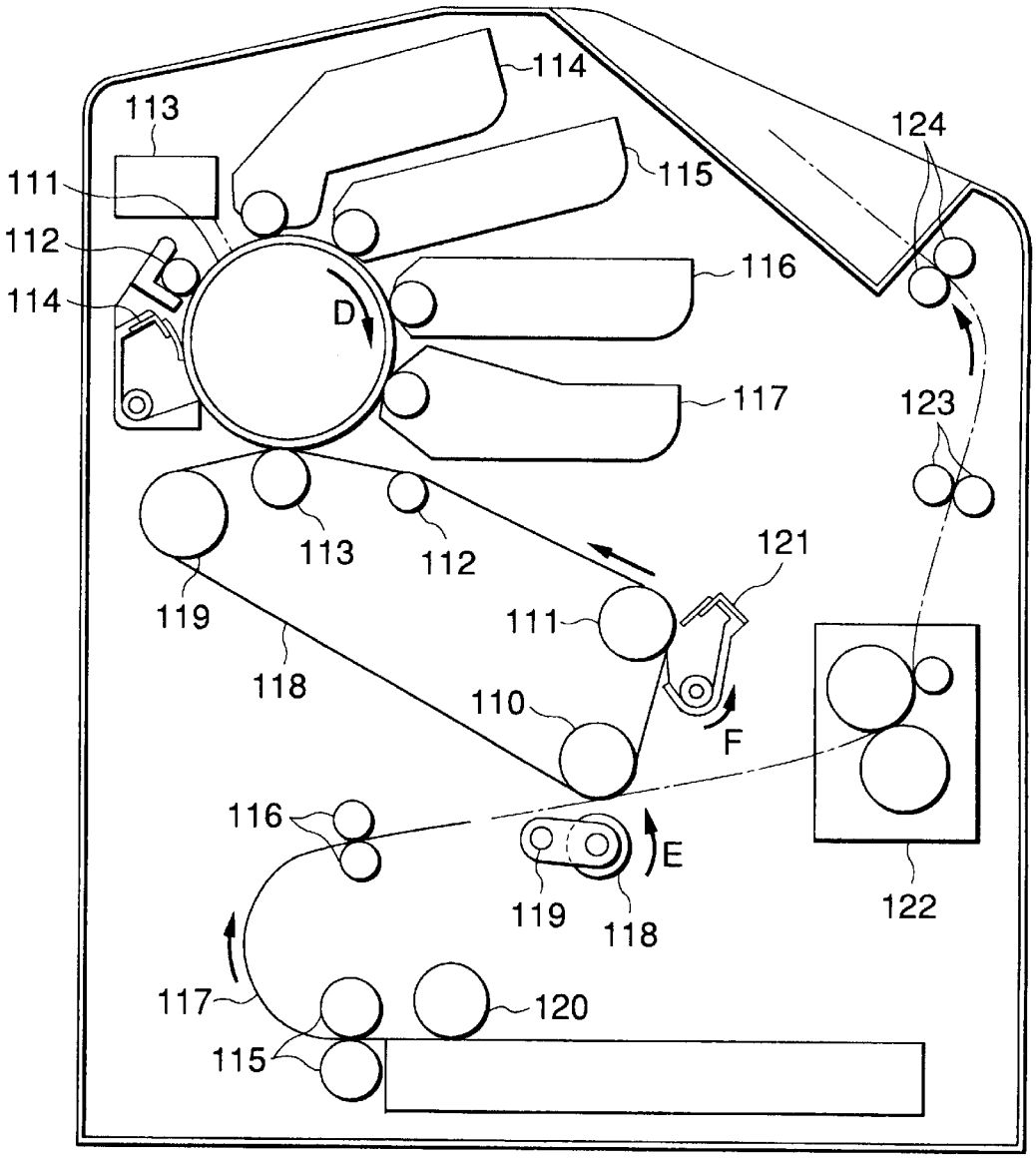
FIG. 16 is a section view showing the whole structure of an image forming apparatus.

FIG. 16 is a section view showing the whole structure of an image forming apparatus, i.e. the color image forming apparatus using a belt-like intermediate transfer body. The whole structure and the operation of the equipment will be explained with reference to FIG. 16.

In the figure, a drum-like photoreceptor (image carrier) 101 is turned and driven in the direction of arrow D by a driving source such as a motor not shown. Charging means 102 such as a charging roller is disposed on the outer periphery of the photoreceptor 101 to charge the surface of the photoreceptor 101 uniformly while abutting with the photoreceptor 101 and rotating.

The photoreceptor 101 whose surface has been uniformly charged is scanned and exposed selectively corresponding to image information of yellow for example as a first color by latent image forming means 103 such as a laser scanning optical system to form an electrostatic latent image for yellow.

Yellow, magenta, cyan and black toners are stored as developers and developing means 104, 105, 106 and 107 which are capable of contacting/separating with/from the photoreceptor 101 are disposed on the rotational downstream side of the photoreceptor 101 on which the electrostatic latent image has been recorded. The electrostatic latent image of yellow thus formed is developed only when the yellow developing means 104 abuts with the photoreceptor 101, thus forming a yellow toner image.

An intermediate transfer belt 108 is disposed adjacent to the photoreceptor 101 on the rotational downstream side of the photoreceptor 101 on which the toner image has been formed. The intermediate transfer belt 108 is hooked around a driving roller 109, a backup roller 110, a tension roller 111 and a smoothing roller 112 and is driven at the same speed with a peripheral speed of the photoreceptor 101. Driving force of the photoreceptor 101 is transmitted to the driving roller 109 to drive the intermediate transfer belt 108 in synchronism with the photoreceptor 101.

A primary transfer roller 113 is urged toward the photoreceptor 101 via the intermediate transfer belt 108 and voltage is supplied from a high voltage source not shown to the primary transfer roller 113 at the primary transfer position where the intermediate transfer belt 108 is pinched by the photoreceptor 101 and the primary transfer roller 113 to transfer the yellow toner image which has been formed in accordance to the aforementioned procedure to the surface of the intermediate transfer belt 108.

The photoreceptor 101 from which the yellow toner image has been transferred to the intermediate transfer belt 108 rotates further in the direction of the arrow D to wipe out the toner remaining on the surface of the photoreceptor 101 by a photoreceptor cleaner 114 comprising a cleaner blade and the like. It allows an image to be formed again.

The same procedure is repeated for the second through fourth colors (magenta, cyan and black) to lay and record toner images of four colors one after another on the intermediate transfer belt 108.

When it finishes to lay the four colors of toner images on the intermediate transfer belt 108, a recording sheet 117 is fed by a sheet feeding roller 120 and pairs of sheet conveying rollers 115 and 116. In synchronism with it, a secondary transfer roller 118 rotates in the direction of arrow E centering on a secondary transfer fulcrum 119 by a clutch and cam mechanisms not shown and abuts with the backup roller 110 via the intermediate transfer belt 108. Then, voltage from a high voltage source not shown is applied to the secondary transfer roller 118 to transfer the four color toner images on the intermediate transfer belt 108 to the recording sheet 117 altogether. Then, the intermediate transfer belt 108 from which the secondary transfer has been made abuts with a cleaner 121 comprising a cleaner blade and the like which rotates in the direction of arrow F by clutch and cam mechanisms not shown to wipe out toners remaining on the surface of the intermediate transfer belt 108. After finishing to wipe out the toners, the cleaner 121 rotates in the direction opposite from the arrow F to retreat.

The recording sheet 117 on which the four color toner images have been transferred is pinched and conveyed while being heated and pressurized by fixing means 122 having heat rollers which contain heating means such as a halogen lamp to fix the toner images. The recording sheet 117 on which the toner images have been fixed is discharged out of the equipment by pairs of discharge rollers 123 and 124, thus completing the recording of the color image.

Figure 17:
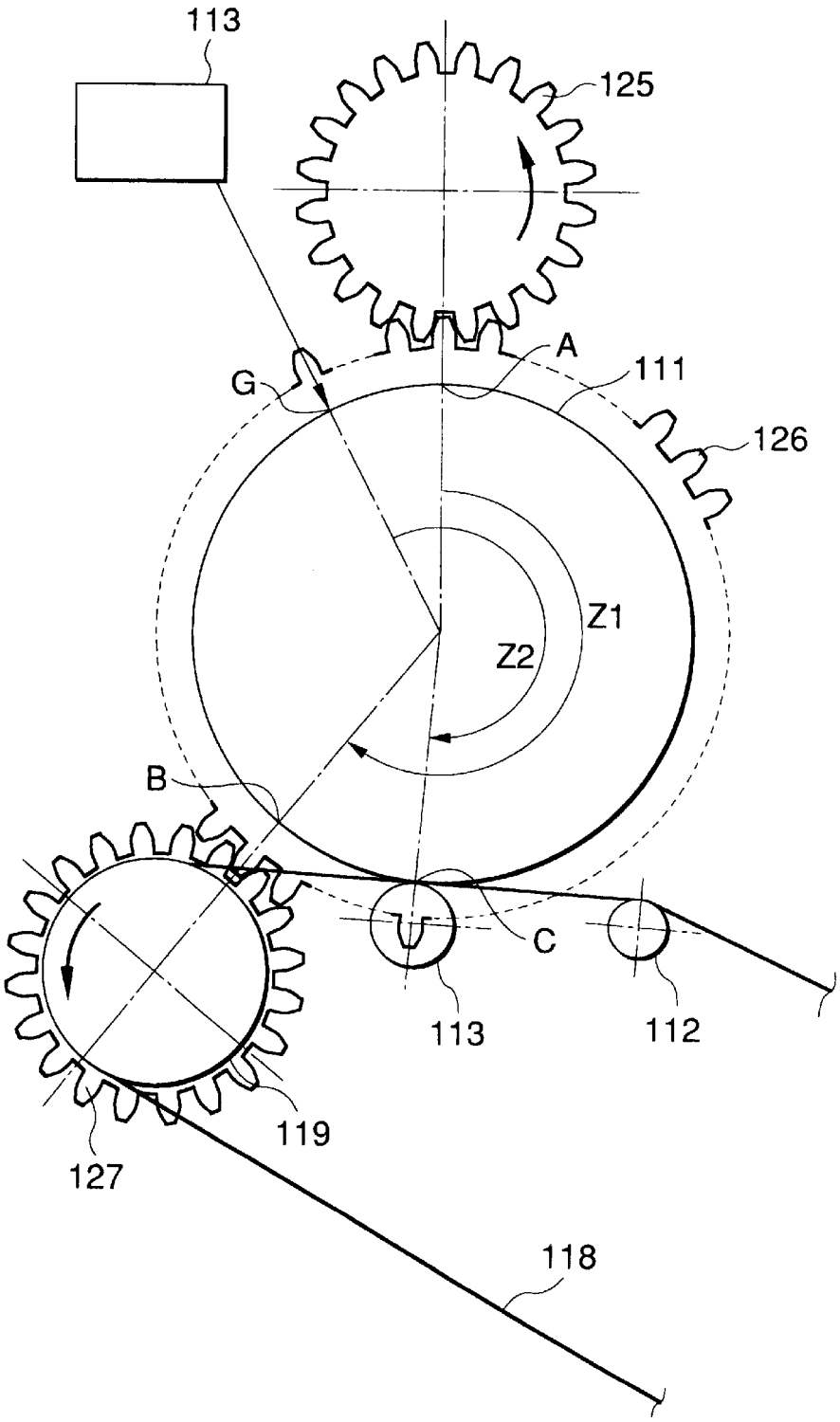
FIG. 17 is a side section view showing a drive transmission system and an arrangement of an image carrier and an intermediate transfer body of the present invention.

FIG. 17 is a side section view showing a drive transmission system and an arrangement of the image carrier and the intermediate transfer body of the present invention.

The driving operation of the photoreceptor 101 and the intermediate transfer belt 108 will be briefly explained below by using FIG. 17.

In FIG. 17, when a driving gear 125 is rotated by driving force of a driving source not shown, the driving gear 125 transmits the driving force to a photoreceptor gear 126 (first drive transmitting means) which is provided on the side of the photoreceptor 101 and turns along with the photoreceptor 101 to rotate the photoreceptor 101. Then, the photoreceptor gear 126 rotates and drives a driving roller gear 127 (second drive transmitting means) which rotates along with the driving roller 109 to drive and convey the intermediate transfer belt 108 in the direction indicated by an arrow.

A peripheral speed of the intermediate transfer belt 108 is set so as to be faster than a peripheral speed of the photoreceptor 101. In concrete, the peripheral speed of the intermediate transfer belt 108 is arranged such that it becomes equal to or slightly faster than the peripheral speed of the photoreceptor 101 when an outer diameter of the driving roller 109 is minimum within a range of tolerance from a predetermined dimension and an outer diameter of the drum-like photoreceptor 101 is maximum within a range of tolerance from a predetermined dimension.

Further, the intermediate transfer belt 108 is stretched approximately in the tangential direction of the photoreceptor 101 at the primary transfer position C by the driving roller 109 which is disposed on the upstream side from the primary transfer position C and the smoothing roller 112 which is disposed on the downstream side with respect to the direction in which the intermediate transfer belt 108 is conveyed.

A length of the intermediate transfer belt 108 between an edge of termination of contact with the smoothing roller 112 and an edge of beginning of contact with the driving roller 109 is set so as to be less than 60 mm. Further, a length of the intermediate transfer belt 108 between the edge of termination of contact with the smoothing roller 112 and the primary transfer position C is set so as to be less than 30 mm.

A pitch diameter of the driving gear 125 is set to be larger than a pitch diameter of the driving roller gear 127 so as to arrange the drive transmission system from the driving gear 125 to the driving roller gear 127 as a speed increasing system.

While the photoreceptor 101 moves from a position G where the latent image is formed on the photoreceptor 101 by the latent image forming means 103 to the primary transfer position C where the primary transfer roller 113 is pressed against the photoreceptor 101 via the intermediate transfer belt 108, the photoreceptor gear 126 rotates by a number of teeth Z2. While the photoreceptor 101 moves from a position A where the driving gear 125 engages with the photoreceptor gear 126 to a position B where the photoreceptor gear 126 engages with the driving roller gear 127, the photoreceptor gear 126 rotates by a number of teeth Z1. The numbers of teeth Z1 and Z2 of the photoreceptor gear 126 are set so as to be integers.

Speed variation of the photoreceptor 101 and the intermediate transfer belt 108 caused by the driving gear 125, the photoreceptor gear 126 and the driving roller gear 127 will be explained briefly by using FIG. 18.

Figure 18:
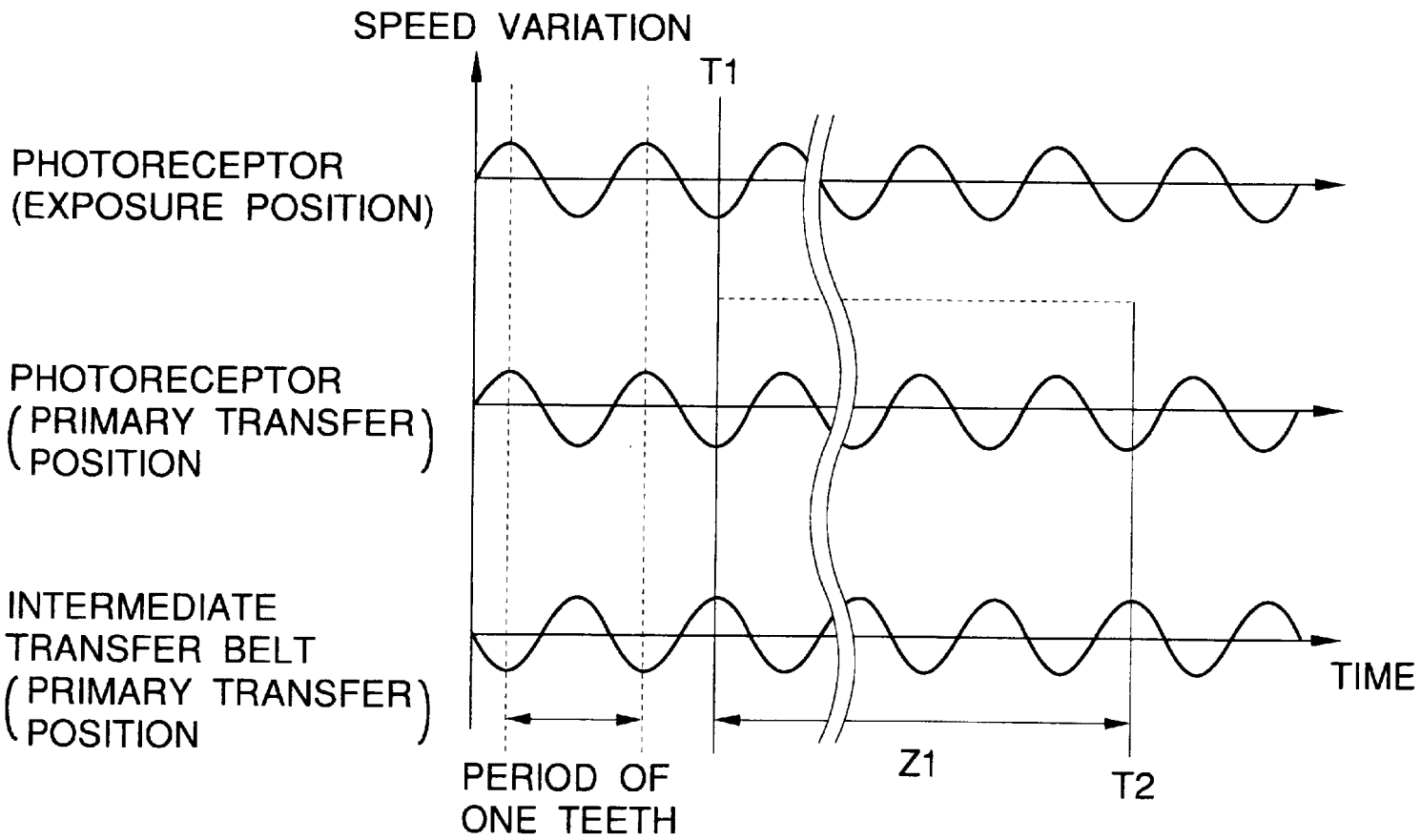
FIG. 18 is a chart showing speed variation of a photoreceptor and the intermediate transfer body of the present invention.

FIG. 18 is a chart showing the speed variation of the photoreceptor and the intermediate transfer body of the present invention.

While the speed variation of a period of one tooth occurs in transmitting driving force from the driving gear 125 to the photoreceptor gear 126, phases of the speed variation at the both positions of the latent image forming position G and the primary transfer position C turn out to be same when the photoreceptor 101 rotates from the latent image forming position G (time T1) to the primary transfer position C (time T2) by arranging such that the number of teeth Z1 of the photoreceptor gear 126 from the latent image forming position G to the primary transfer position C is an integer.

That is, in respect to the speed variation, the part in which the latent image has been formed fast at the latent image forming position G, i.e. the part in which the image has been formed in a high density in the direction of rotation of the photoreceptor, becomes fast at the primary transfer position C. In contrary to that, the part in which the latent image has been formed slowly at the latent image forming position G, i.e. the part in which the image has been formed in a sparse density in the direction of rotation of the photoreceptor, becomes slow at the primary transfer position C.

At this time, the phase of the speed variation of the photoreceptor 101 and that of speed variation of the intermediate transfer belt 108 become opposite phase by arranging such that the number of teeth of the photoreceptor gear 126 from the position A where the driving gear 125 engages with the photoreceptor gear 126 to the position B where the photoreceptor gear 126 engages with the driving roller gear 127 is an integer.

Accordingly, when the photoreceptor 101 advances fast, the intermediate transfer belt 108 advances slowly and when the photoreceptor 101 advances slowly, the intermediate transfer belt 108 advances fast. Therefore, the toner image on the part of the photoreceptor 101 where the distance between each pixel is short in the direction of rotation of the photoreceptor is relatively enlarged on the intermediate transfer belt 108 and that on the part where the distance between each pixel is long in the direction of rotation of the photoreceptor is relatively reduced on the intermediate transfer belt 108, so that the nonuniformity of image caused by the period of one tooth of the photoreceptor gear 126 may be reduced.

While the image carrier has been explained by exemplifying the drum-like photoreceptor 101, it is possible to use a belt instead of that.

Further, it is possible to use one having a shape other than the roller, e.g. a blade, as the smoothing roller 112. It is also possible to cause it to function also as guide means for preventing the intermediate transfer belt from snaking.

Still more, although the primary transfer means has been explained by exemplifying the transfer roller, it is also possible to use a transfer brush or a transfer blade.

As described above, according to the image forming apparatus of the present invention, the intermediate transfer belt is driven stably because the primary transfer position is located on the side where the intermediate transfer belt is pulled by the driving roller (on the so-called pulling side), rather than the loose side. Therefore, it becomes possible to prevent the speed variation of the intermediate transfer belt caused by variation of friction force between the photoreceptor and the intermediate transfer belt at the primary transfer position, the looseness of the intermediate transfer belt and the variation of an angle of abutment of the intermediate transfer belt before and after the primary transfer position. Thereby, it becomes possible to prevent the displacement and nonuniformity of colors which might otherwise occur during the primary transfer and the deterioration of images such as dispersion of toner images from occurring with the simple arrangement.

Further, because the driving roller which has a strong friction force with respect to the intermediate transfer belt is disposed downstream of and near the primary transfer position, it is possible to prevent the intermediate transfer belt from deflecting laterally at the primary transfer position even if the intermediate transfer belt deflects in the lateral direction on the upstream side of the primary transfer position with respect to the direction in which the intermediate transfer belt is conveyed when the cleaner and the secondary transfer roller contact/separate with/from the intermediate transfer belt for example.

Further, according to the image forming apparatus, the transmission of drive from the drive transmitting means of the photoreceptor to the drive transmitting means of the intermediate transfer belt is carried out stably regardless of dispersion of dimension of the driving rollers for driving the photoreceptor and the intermediate transfer belt.

Further, according to the image forming apparatus, the friction force between the photoreceptor and the intermediate transfer belt at the primary transfer position is obtained stably regardless of the variation of quantity of toner and electrostatic force between the photoreceptor and the intermediate transfer belt. Therefore, it becomes possible to prevent the speed variation of the intermediate transfer belt and the variation of the angle of abutment of the intermediate transfer belt before and after the primary transfer position. It is then possible to prevent the displacement and nonuniformity of colors and the deterioration of image such as dispersion of toner images, which might otherwise occur during the primary transfer, with the simple arrangement.

Still more, it allows a width of contact of the photoreceptor and the intermediate transfer belt at the primary transfer position to be reduced as compared to the arrangement in which the intermediate transfer belt is wrapped around the photoreceptor. Therefore, because the part of the photoreceptor occupied for the primary transfer position may be lessened in the whole outer periphery of the photoreceptor, it is possible to increase a degree of freedom in disposing other processing means such as developing means around the photoreceptor, to use a photoreceptor whose outer diameter is smaller and to construct a smaller image forming apparatus.

Further, according to the image forming apparatus, the pressure for urging the primary transfer roller against the photoreceptor through the intermediary of the intermediate transfer belt and the angle of abutment of the intermediate transfer belt before and after the primary transfer position is kept unchanged even if the tensile force of the intermediate transfer belt varies at the primary transfer position when the cleaner of the intermediate transfer belt and the secondary transfer roller contact/separate with/from the intermediate transfer belt. Therefore, a fine image having no image disturbance may be obtained with the simple arrangement.

Further, according to the image forming apparatus, the wrinkled intermediate transfer belt is smoothed out before it is conveyed to the primary transfer position. Because the face of the intermediate transfer belt located on the pulling side with respect to the driving roller is pulled strongly by the driving roller, wrinkles are apt to be created in the direction approximately parallel with the direction in which the intermediate transfer belt is conveyed. Because the wrinkles create gaps at the part where the primary transfer roller contacts with the intermediate transfer belt and the part where the intermediate transfer belt contacts with the photoreceptor, there arises the deterioration of image such as a hollow toner image and dispersion and the decrease of efficiency of transfer. However, according to the present invention, because the smoothing roller disposed on the upstream side of and near the primary transfer position can smooth out the wrinkles which are created on the intermediate transfer belt before it is conveyed to the primary transfer position even if the primary transfer position is located upstream of and near the driving roller of the intermediate transfer belt, fine images having no nonuniformity of colors and image deterioration may be obtained with the simple arrangement.

Further, according to the image forming apparatus, the arrangement allows to prevent the displacement and nonuniformity of colors caused by the gear for driving the photoreceptor and the gear for driving the intermediate transfer belt from occurring with the simple arrangement.

Further, according to the image forming apparatus, the arrangement allows to prevent the displacement and nonuniformity of colors from occurring effectively because the photoreceptor and the gear for driving the photoreceptor are driven in a body.

Further, according to the image forming apparatus, the backlash between the gears is absorbed, the photoreceptor and the intermediate transfer belt are driven stably without speed variation and hence to prevent the displacement and nonuniformity of colors in the drive transmission system in which drive is transferred from the driving source to the photoreceptor and from the photoreceptor to the intermediate transfer belt, because the drive transmission system becomes a speed increasing system by setting the pitch diameter of the gear for driving the photoreceptor to be larger than the pitch diameter of the gear for driving the intermediate transfer belt.

Still more, because the displacement and nonuniformity of colors are hard to be seen when they arise in a long period, an image from which substantially no displacement nor nonuniformity of colors is sensed may be obtained even if the displacement and nonuniformity of colors arise due to the periodic speed variation of one round of a gear caused by eccentricity of the gear by setting the pitch diameter of the gear for driving the photoreceptor to be larger than the pitch diameter of the gear for driving the intermediate transfer belt and by transmitting the drive from the photoreceptor to the intermediate transfer belt.

A mode for carrying out the present invention will be explained below by exemplifying an equipment for forming a color image with reference to the drawings.

Figure 19:
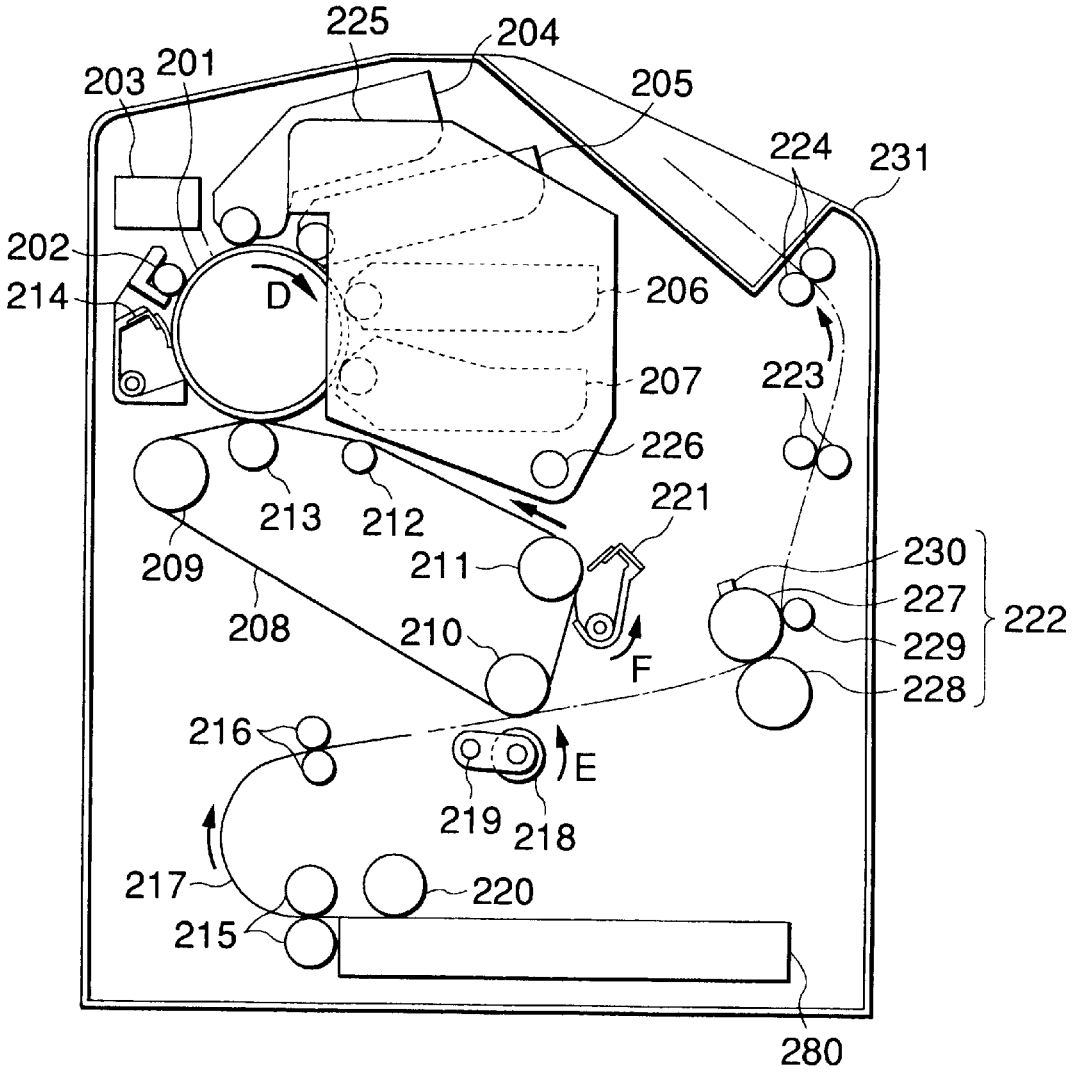
FIG. 19 is a section view showing the whole structure of an image forming apparatus according to another embodiment of the present invention.

FIG. 19 is a section view showing the whole structure of an image forming apparatus, i.e. the color image forming apparatus using a belt-like intermediate transfer body. The whole structure and the operation of the equipment will be explained with reference to FIG. 19.

In FIG. 19, a drum-like photoreceptor (image carrier) 201 is driven to rotate in the direction of an arrow D by a driving source such as a motor not shown. Charging means 202 such as a charging roller is disposed on the outer periphery of the photoreceptor 201 to charge the surface of the photoreceptor 201 uniformly while abutting with the photoreceptor 201 and rotating.

The photoreceptor 201 whose surface has been uniformly charged is scanned and exposed selectively corresponding to image information of yellow for example as a first color by latent image forming means 203 such as a laser scanning optical system to form an electrostatic latent image for yellow.

Developing means 204, 205, 206 and 207 in which yellow, magenta, cyan and black toners are stored as developers, respectively, and which are capable of contacting/separating with/from the photoreceptor 201 are disposed on the rotational downstream side of the photoreceptor 201 on which the electrostatic latent image has been recorded. The electrostatic latent image of yellow thus formed is developed only when the yellow developing means 204 abuts with the photoreceptor 201, thus forming a yellow toner image.

An intermediate transfer belt 208 is disposed adjacent to the photoreceptor 201 on the rotational downstream side of the photoreceptor 201 on which the toner image has been formed. The intermediate transfer belt 208 is hooked around a driving roller 209, a backup roller 210, a tension roller 211 and a smoothing roller 212 and is driven at the same speed with a peripheral speed of the photoreceptor 201. Driving force of the photoreceptor 201 is transmitted to the driving roller 209 to drive the intermediate transfer belt 208 in synchronism with the photoreceptor 201.

A primary transfer roller 213 is urged toward the photoreceptor 201 via the intermediate transfer belt 208 and voltage is supplied from a high voltage source not shown to the primary transfer roller 213 at the primary transfer position where the intermediate transfer belt 208 is pinched by the photoreceptor 201 and the intermediate transfer belt 208 to transfer the yellow toner image which has been formed in accordance to the aforementioned procedure to the surface of the intermediate transfer belt 208.

The photoreceptor 201 from which the yellow toner image has been transferred to the intermediate transfer belt 208 is turned further in the direction of the arrow D to wipe out the toner remaining on the surface of the photoreceptor 201 by a photoreceptor cleaner 214 comprising a cleaner blade and the like. It allows an image to be formed again.

The same procedure is repeated for the second through fourth colors (magenta, cyan and black) to lay and record toner images of four colors one after another on the intermediate transfer belt 208.

When it finishes to lay the four colors of toner images on the intermediate transfer belt 208, a recording sheet 217 is fed by a sheet feeding roller 220 and pairs of sheet conveying rollers 215 and 216. In synchronism with it, a secondary transfer roller 218 rotates in the direction of arrow E centering on a secondary transfer fulcrum 219 by a clutch and cam mechanisms not shown and abuts with the backup roller 210 via the intermediate transfer belt 208. Then, voltage from a high voltage source not shown is applied to the secondary transfer roller 218 to transfer the four color toner images on the intermediate transfer belt 208 to the recording sheet 217 altogether at the secondary transfer position where the recording member 217 and the intermediate transfer belt 208 are pinched by the backup roller 210 and the secondary transfer roller 218. Then, the intermediate transfer belt 208 from which the secondary transfer has been finished abuts with a cleaner 221 comprising a cleaner blade and the like which rotates in the direction of arrow F by clutch and cam mechanisms not shown to wipe out the toners remaining on the surface of the intermediate transfer belt 208. After finishing to wipe out the toners, the cleaner 221 turns in the opposite direction from the arrow F to retreat.

The recording sheet 217 on which the four color toner images have been transferred reaches to fixing means 222 via a first recording member conveying path for conveying the recording member 217 from the secondary transfer position in almost parallel with the equipment proper and is pinched and conveyed while being heated and pressurized by the fixing means 222 to fix the toner images. The conveying direction of the recording sheet 217 on which the toner images have been fixed is changed into the direction of the upper face of the equipment proper by the fixing means 222. It is then discharged out to the upper face of the equipment by pairs of discharge rollers 223 and 224 disposed at a second recording member conveying path for conveying the recording member 217 from the fixing means 222 almost vertically to the equipment proper, reaching to the upper face of the equipment. Thus the recording of the color image is completed.

Several arrangements of the equipment shown in FIG. 19 will be explained below supplementarily.

A control panel 231 for indicating instructions for controlling the image forming apparatus and showing states of the image forming apparatus is provided on the front cover of the equipment proper. The face on which the control panel 31 is provided is used as a face normally used by a user of the equipment. Although the control panel 231 may be provided on the upper cover, the face where the user faces to the control panel 231 is used as a front face normally used by the user of the equipment so as to provide good visibility and controllability of the control panel 231. In the equipment, the front face of the equipment proper is the face almost parallel with an axis of the image carrier.

A drum-like photoreceptor whose outer diameter is no more than 90 mmϕ or preferably no more than 80 mmϕ is used for the photoreceptor 201. Although there has been a problem that the toner is apt to adhere excessively at the downstream side (rear edge portion of the latent image) of the developing position with respect to the turning direction of the photoreceptor and the image is thickened or densified because the larger the radius of curvature of the photoreceptor 201 (when the photoreceptor is closer to a flat plane), the more moderately the developing electric field changes before and after the developing position at each developing position where the photoreceptor and each developing means face, the arrangement of using the drum-like photoreceptor having the predetermined curvature or less like the present equipment allows the developing electric field at each developing position where the photoreceptor and each developing means face to be changed sharply before and after the developing position, thus allowing a good image to be obtained.

The developing means 204, 205, 206 and 207 are disposed in parallel around the photoreceptor 201 and are arranged such that the developing means 204 at the most upstream and the developing means 207 at the most downstream form an angle no more than 140° or preferably than 125° with respect to the center of the photoreceptor 201. The developing means 204 is disposed at the position almost right above the photoreceptor 201 so that a wider space below the photoreceptor 201, i.e. a space for the primary transfer position, is assured. Accordingly, when the intermediate transfer belt is used as the intermediate transfer body, the intermediate transfer belt 208 may be engaged with the photoreceptor 1 in the wide area or the plurality of rollers may be disposed near the primary transfer position.

The developing means 204, 205, 206 and 207 are removably supported by a frame 225 and the frame 225 is pivotably supported centering on a frame fulcrum 226. Although it is possible to arrange such that the frame 225 can be drawn out to the front side of the equipment proper, e.g. in the direction almost parallel with the equipment proper, the position of the developing means 204, 205, 206 and 207 with respect to the photoreceptor 201 is not stabilized unless the position is positioned with respect to both edges of upper and lower parts of the frame 225 every time when the frame 225 is moved toward the photoreceptor 201. Therefore, it is preferable to arrange like the present equipment in which the frame 225 is pivotably supported centering on the frame fulcrum 226. Such arrangement allows the position of the developing means 204, 205, 206 and 207 with respect to the photoreceptor 201 to be stabilized at high positioning accuracy just by accurately positioning the two points of the both edges of the upper part of the frame 225 because the position of the lower part of the frame 225 is stabilized by the frame fulcrum 226.

Further, while the developing means 204 is disposed at the position almost right above the photoreceptor 201 in the present equipment, there may be a case when the developing means 204 and the photoreceptor 201 contact and damage each other when the frame 225 is moved almost in parallel with the equipment proper. Accordingly, the present equipment is arranged such that the frame 225 is pivotably moved and the frame fulcrum 226 is disposed at an adequate position to prevent the developing means 204 from contacting with the photoreceptor 201 when the frame 225 is moved even if the developing means 204 is disposed at the position almost right above the photoreceptor 201.

The driving roller 209 for driving the intermediate transfer belt 208 is disposed on the back side of the equipment proper. Therefore, a driving source and drive transmitting means for driving the photoreceptor 201 and the intermediate transfer belt 208 may be disposed concentratedly at the back of the equipment proper, allowing the equipment proper to be miniaturized.

The backup roller 210 is disposed at the lower face side of the equipment proper and the secondary transfer position is disposed on the lower face side of the equipment proper, so that gravity acts on the recording member 217 after the transfer in the direction of peeling the recording member 217 off from the intermediate transfer belt 208 at the secondary transfer position and no peeling means for peeling the recording member 217 from the intermediate transfer belt 208 needs to be provided. Accordingly, it allows the equipment structure to be simplified and the equipment proper to be miniaturized.

The tension roller 211 is disposed on the front side of the equipment proper. Further, the present equipment is arranged such that the replacement of the developing means, the removal of a jammed paper and the like are carried out from the front side of the equipment proper. Therefore, even if a replacing member or hands touch with the intermediate transfer belt 208 during such operation by mistake, it is possible to prevent the intermediate transfer belt 208 from being damaged because the contact is made around the tension roller 211 which can quickly absorb the shock given to the intermediate transfer belt 208 by displacing itself.

In the present equipment, the intermediate transfer belt 208 is hanged around almost in parallel with the equipment proper. Further, part of the intermediate transfer belt 208 from the backup roller 210 to the tension roller 211 is arranged so as to be almost parallel with the second recording member conveying path. It then allows the intermediate transfer belt 208, the first recording member conveying path and the recording member storage means 280 to be disposed so as to lay one after another almost in the horizontal direction and part of the intermediate transfer belt 208 to be disposed so as to lay one after another with the second recording member conveying path almost in the vertical direction. Therefore, it allows the small type image forming apparatus in which an installation area of the equipment proper is almost equal to the recording member storage means to be realized.

The fixing means 222 comprises a heat roller 227 containing heating means such as a halogen lamp, a first pressure roller 228, a second pressure roller 229, and pad-like or rolled surface lubricant applying means 230 for applying surface lubricant such as silicone oil to the heat roller 227 or for cleaning the surface of the heat roller 227.

The present equipment is arranged such that no sheet conveying direction changing means for largely changing the sheet conveying direction is disposed on the downstream of the fixing means 222 and that the fixing means 222 functions also as the sheet conveying direction changing means. The sheet conveying direction changing means is a tool such as a claw or a guide plate for changing the sheet conveying direction at least 45° or more to change the sheet conveying direction approximately from the horizontal direction to the vertical direction within the equipment proper.

Although it is possible to arrange such that the sheet conveying direction changing means is disposed on the downstream side of the fixing means 222 to change the conveying direction of the recording member 217, there is a problem in such arrangement in which the sheet conveying direction changing means is used as such that if the sheet conveying direction changing means is a plate-like member formed to have a curved face, a load is apt to be generated in the sheet, causing a jam, at the position where the sheet runs into the sheet conveying direction changing means. However, because the fixing means 222 functions also as the sheet conveying direction changing means and changes the conveying direction of the recording member 217 and the sheet is conveyed in the fixed direction almost parallel or almost vertical to the direction of the equipment proper in the recording member conveying paths before and after the fixing means 222 in the present equipment, it is possible to prevent the sheet from being jammed.

Further, the present equipment is arranged such that an angle formed between the first pressure roller 228 and the second pressure roller 229 with respect to the center of the heat roller 227 is within a range equal to or more than 45° and equal to or less than 90°, or preferably equal to or more than 60° and equal to or less than 80°. Arranging them such that the angle formed between the first pressure roller 228 and the second pressure roller 229 is equal to or more than 45°, or preferably equal to or more than 60° as described above allows the recording member conveying direction to be changed and the recording member conveyed in almost parallel with the equipment proper by the first recording member conveying path to be guided almost in the vertical direction without providing the sheet conveying direction changing means at the downstream side of the fixing means. Further, because the recording member may be wound fully around the heat roller 227, toners may be fully melt and an image excellent in coloring and light transmissivity can be formed even when a multi-color image having the light transmissivity is to be formed on a recording member whose base material is transparent. Further, arranging such that the angle formed between the first pressure roller 28 and the second pressure roller 229 is equal to or less than 90° or preferably equal to or less than 80° allows dislocation and wrinkles caused by a difference of conveying speed of the face of the recording member contacting with the heat roller 227 and the face of the recording member contacting with the first pressure roller 228 and the second pressure roller 229 to be reduced even when a recording member comprising a laminate of a plurality of papers such as an envelope is to be conveyed. Further, it allows to prevent the recording member from being jammed within the fixing means 222 even when a firm recording member such as a plastic film is used to form a transparent image.

Further, the present equipment is arranged such that the second recording member conveying path conveys the recording member almost in the vertical direction at the front side of the equipment proper and discharges it at the upper face of the equipment proper. A shock is often applied to the front side, i.e. to the face normally used, of the equipment proper when the user gives the shock to the equipment by mistake during the operation of the equipment. Even if such a shock is a minor one which causes no problem in forming a monochromatic image, a shear of more than several 10 $\mu$m turns out to be a shear of colors of a multi-color image in which a plurality of color images are laid each other when the user gives such shock by mistake while forming the multi-color image by the present equipment. Therefore, it is necessary to reduce the shock to prevent the shear in color of the image. Then, because the shock from the front side of the equipment proper is relaxed by the cavity of the recording member conveying path by disposing the second recording member conveying path as described above, the shock and vibration given to the equipment proper may be reduced. Even if the vibration is transmitted to the recording member being conveyed on the second recording member conveying path, no disturbance of image occurs because the image has been already fixed to the recording member conveyed there by the fixing means 222.

Further, because the present equipment is arranged such that the second recording member conveying path is disposed almost above the fixing means 222 and the fixing means 222 and the developing means 204, 205, 206 and 207 disposed thereabove are disposed so as not to overlap each other in the vertical direction, heat of the fixing means 222 is naturally exhausted above via the second recording member conveying path even when an exhaust fan not shown for exhausting air within the equipment proper is stopped in the same time when the power source is shut off. Therefore, it allows an influence of heat to the developing means and the intermediate transfer body disposed in close vicinity to the fixing means to be minimized.

Further, because the second recording member conveying path is disposed almost vertically almost above the fixing means 222, the equipment installation area may be reduced.

Figure 20:
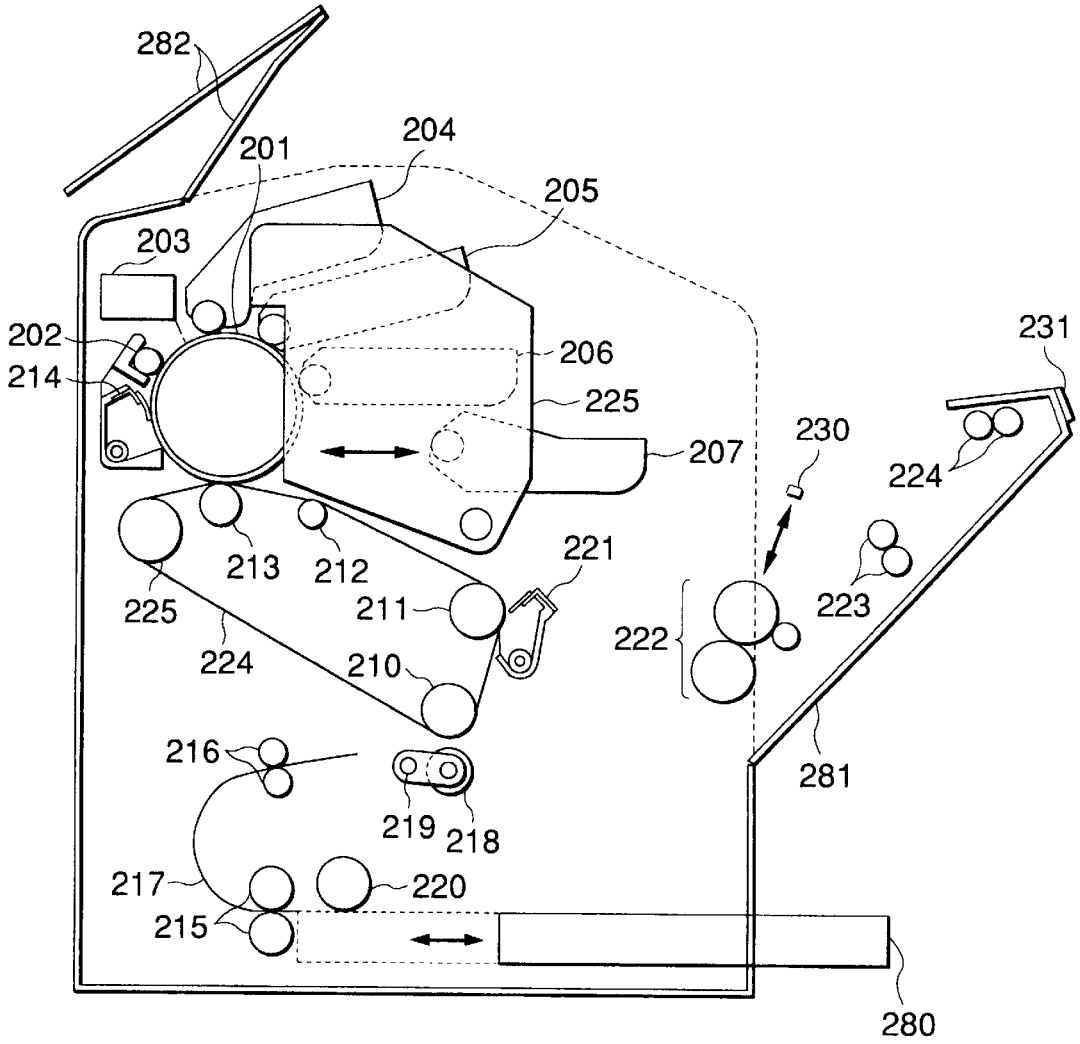
FIG. 20 is a section view of the equipment showing a state in which a cover of the image forming apparatus is opened.

FIG. 20 is a section view of the equipment showing a state when the cover of the image forming apparatus is opened. It is noted that the same components with those in FIG. 19 are denoted with the same reference numerals and an explanation thereof will be omitted here.

The operation for attaching/removing the developing means 204, 205, 206 and 207 and the recording member storage means 280 will be briefly explained with reference to FIG. 20.

A front cover 281 and an upper cover 282 of the equipment proper are arranged so as to be openable centering on respective fulcrums not shown.

When the front cover 281 is moved in the opening direction by bringing it down to the front side of the equipment proper, the fixing means 222 also moves in a body while interlocking therewith and is opened to the front side of the equipment proper together with the front cover 281.

By opening the front cover 281, the first recording member conveying path from the secondary transfer position to the fixing means 222 and the second recording member conveying path on which the pair of discharge rollers 223 and 224 for discharging the recording member 217 from the fixing means 222 to the upper face of the equipment are exposed out of the equipment. Accordingly, even if the recording member 217 is jammed either in the first recording member conveying path or the second recording member conveying path, the jammed recording member may be removed from the front side of the equipment proper just by opening the front cover 281.

Further, a waste toner container (not shown) disposed at one end of the intermediate transfer body cleaner 221 for storing waste toner collected by the intermediate transfer body cleaner 221 may be replaced from the front side of the equipment proper by opening the front cover 281.

The surface lubricant applying means 230 which composes the fixing means 222 may be also replaced from the front side of the equipment proper as shown by an arrow in the figure just by opening the front cover 281. Although a case of replacing only the surface lubricant applying means 230 is shown in the figure, the fixing means 222 may be also replaced in a body.

Although the present equipment has been arranged such that the fixing means 222 moves together with the front cover 281, it is possible to arrange such that the fixing means 222 does not move even if the front cover 281 is moved. Even if the equipment is arranged as such, because no sheet conveying direction changing means needs to be provided at the downstream of the fixing means 222 and the fixing means 222 may be disposed in the close vicinity to the front side of the equipment proper, the surface lubricant applying means 230 or the fixing means 222 may be replaced from the front side of the equipment proper. Further, because the fixing means 22 is not exposed out of the equipment and its temperature hardly drops when a paper is jammed, it becomes possible to recover the temperature of the fixing means 222 and to start to form an image quickly when the image is to be formed again after removing the jammed paper.

Alternatively, beside the front cover 281, it is also possible to provide a cover for replacing the surface lubricant applying means 230 or the fixing means 222 from the front side of the equipment proper as necessary. Thereby, the temperature of the fixing means 222 hardly drops even when the front cover 281 is opened to remove the jammed paper. Further, it allows the surface lubricant applying means 230 or the fixing means 222 to be replaced more readily from the front side of the equipment proper even if the fixing means 222 is arranged so as not to move together with the front cover 281.

It is noted that the arrangement in which the fixing means 222 moves together with the front cover 281 is preferable over the arrangement in which the fixing means 222 does not move even if the front cover 281 moves because the second recording member conveying path may be widely opened, allowing a jammed paper to be readily removed and the intermediate transfer body cleaner 221 or the waste toner container for storing its waste toner disposed in the close vicinity to the fixing means to be readily replaced.

Further, the developing means 207 may be attached/removed to/from the frame 225 as shown by an arrow in the figure just by opening the front cover 281, without opening the upper cover 282. Accordingly, it becomes easy to replace the black developing means which is used and replaced most frequently, when the developing means 207 is set as the black developing means.

When the upper cover 282 is lifted up to the upper face side of the equipment proper after opening the front cover 281 and is moved in the opening direction by bringing down part thereof to the back side, all the developing means 204, 205, 206 and 207 supported by the frame 225 are exposed out of the equipment.

Because the opening at the front side of the equipment proper is opened further than the case of opening only the front cover 281 by opening the upper cover 282 together with the front cover 281, the jammed paper in the first and second recording member conveying paths may be removed and the fixing means 222, the surface lubricant applying means 230 and others may be replaced more easily. Because the front side of the equipment proper is largely opened, it provides a good visibility, allowing the components to be replaced to be readily attached/removed.

Further, because the developing means 204, 205, 206 and 207 supported by the frame 225 are exposed to the outside of the equipment by opening the upper cover 282 together with the front cover 281, each developing means may be attach/removed and replaced from the front side of the equipment proper. Because the developing means 204, 205, 206 and 207 are disposed on the front side of the equipment proper more than the photoreceptor 201 and may be attached/removed by holding the rear part (developer storing section) thereof, there will be no case of damaging a developing roller and the like provided at a developing opening of the developing means or contaminating one's hand by toner exposed at the developing opening by touching the front part (the developing opening for attaching the toner to the photoreceptor 201) of the developing means 204, 205, 206 and 207 by mistake.

The paper cassette 280 may be attached/removed and the recording member 217 may be replenished in the direction of an arrow in the figure from the front side of the equipment proper regardless of the front cover 281 and the upper cover 282. Although the paper cassette 280 has been used as the recording member storage means in the present equipment, it is possible to use a paper tray, instead of the paper cassette. Further, it is possible to arrange such that the recording member storage means, the sheet feeding roller 220 and the pair of sheet conveying rollers 215 and 216 are constructed in a body to be able to draw them out to the front side of the equipment proper. By arranging as such, a recording member may be readily removed from the front side of the equipment proper even if the recording member is jammed in the recording member conveying path from the recording member storage means to the secondary transfer position.

Further, although the present equipment has been arranged such that the control panel 231 moves together with the front cover 281, it is possible to arrange such that the control panel 231 is provided on the front cover at the position which is the outside of the second recording member conveying path and only the front cover at the part corresponding to the second recording member conveying path can be opened so that the control panel 231 does not move even when the front cover is opened.

Figure 21:
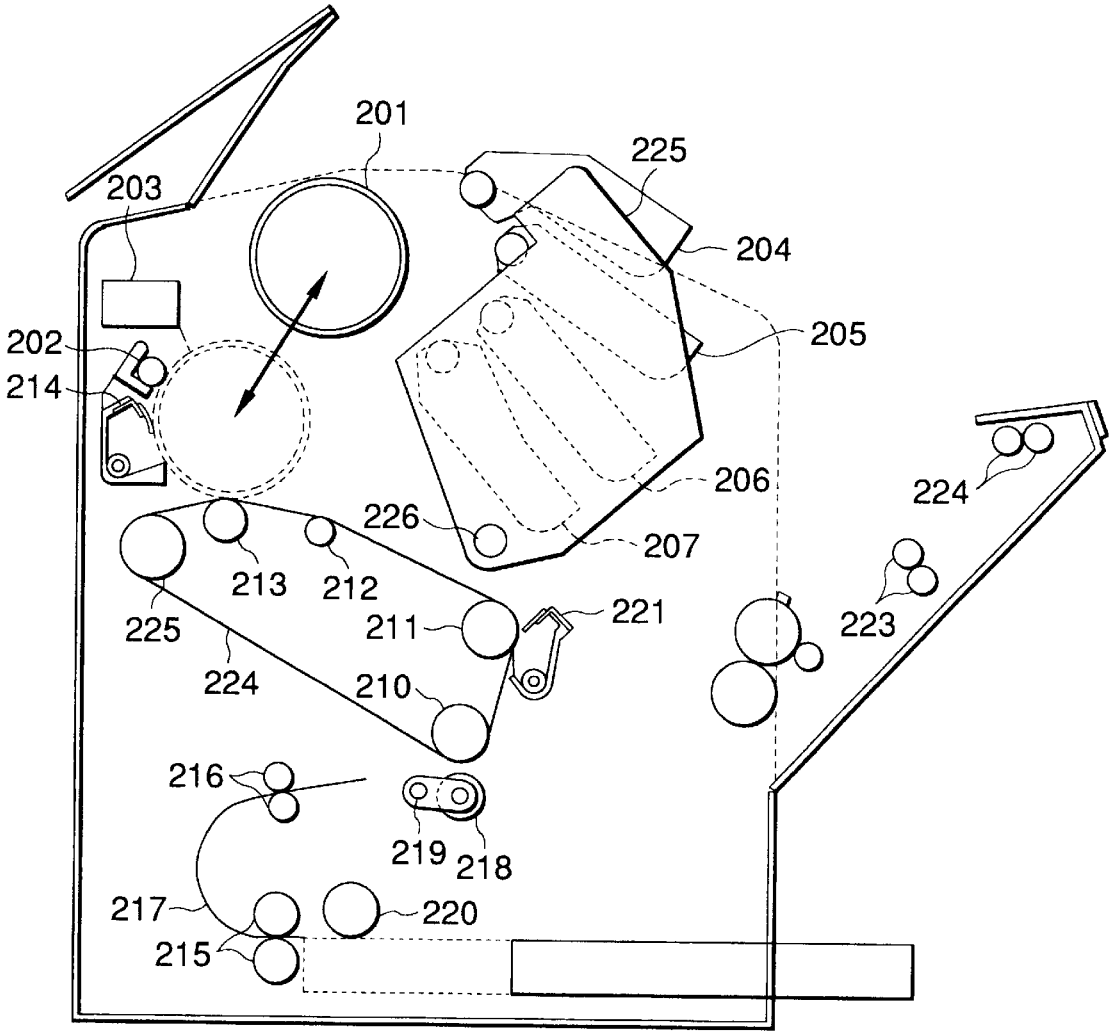
FIG. 21 is a section view of the equipment in which a frame structure of the image forming apparatus is opened.

FIG. 21 is a section view of the image forming apparatus showing a state in which the frame structure for supporting the plurality of the developing means in a body is opened. It is noted that the same components with those in FIG. 19 are denoted with the same reference numerals and an explanation thereof will be omitted here.

An operation for attaching/removing the photoreceptor 201 and others will be briefly explained with reference to FIG. 21.

The developing means 204, 205, 206 and 207 are removably supported by the frame 225 and the frame 225 is arranged to be pivotable and movable centering on the frame fulcrum 226 as described above.

When the frame 225 is moved in the opening direction by bringing down to the front side of the equipment proper after opening the front cover 281 and the upper cover 282 of the equipment proper, the photoreceptor 201 is exposed out of the equipment.

The photoreceptor 201 may be attached/removed in the direction of an arrow in the figure from the front side of the equipment proper by, thus, opening the frame 225.

Further, the photoreceptor cleaner 214 may be exposed by opening the frame 225 and then moving the photoreceptor 201 out of the equipment. In this state, a waste toner container (not shown) disposed at one end of the photoreceptor cleaner 214 for storing waste toner collected by the photoreceptor cleaner 214 may be replaced from the front side of the equipment proper. Further, although the case of replacing only the waste toner container has been shown, it is possible to replace the photoreceptor cleaner 214 and the waste toner container in a body or to construct the waste toner container or the photoreceptor cleaner 214 as one unit with the photoreceptor 201 to replace as a photoreceptor unit.

Further, although a belt-like photoreceptor may be used as the image carrier in the present equipment, it is preferable to use the drum-like photoreceptor.

In general, the belt-like photoreceptor is replaced as a belt photoreceptor unit in which a plurality of rollers for driving the belt and for giving tensile force to the belt and supporting members or the like for supporting those rollers at predetermined positions are structured in a body. Further, a plane section which is long in parallel with the direction of rotation of the photoreceptor is formed as a surface facing to the developing means in the belt-like photoreceptor in order to dispose the plurality of developing means in parallel. Although it is preferable to attach/remove the belt-like photoreceptor in the direction almost parallel with the plane section in order to readily attach/remove it, a moving distance required to attach/remove the belt-like photoreceptor becomes long because the plane section is long.

On the other hand, because the drum-like photoreceptor has a simpler structure, is inexpensive and is light and allows the moving distance in replacing it to be shortened as compared to the belt-like photoreceptor, it may be readily replaced and is suitable as a consumable which needs to be replaced.

Further, although the developing means 204, 205, 206 and 207 may be attached/removed while urging the frame 225 toward the photoreceptor 201 in the present equipment, the developing means 204, 205, 206 and 207 may be also attached/removed, respectively, while opening the frame 225. In the state in which the frame 225 is opened, the developing means 204, 205, 206 and 207 assume positions in which each developing opening heads upward and each developer storage section heads downward. Accordingly, because the toner stored in the developing means almost moves to the developer storage section in attaching/removing the developing means 204, 205, 206 and 207, it becomes possible to prevent the toner from scattering from the developing opening.

Further, because the developing means 204, 205, 206 and 207 are drawn out to the front side of the equipment proper further in the state in which the frame 225 is opened, the developing means may be attached/removed to/from the front side of the equipment proper more readily. In particular, the developing means 204 which is disposed almost right above the photoreceptor 201 may be readily attached/removed.

As described above, while the arrangement of the image carrier, the developing means, the recording member storage means and the like of the present equipment and the method for attaching/removing them have been explained with reference to FIGS. 19, 20 and 21, the arrangement of the present equipment allows the user to readily replace the components having the lengthy shape in the direction of the axis of the image carrier without damaging the components to be replaced or the equipment proper and without giving shock to the latent image forming means by allowing the image carrier, the developing means, the recording member storage means and the like to be attached/removed from the front side of the equipment proper in the direction almost vertical to the axis of the image carrier.

Figure 22:
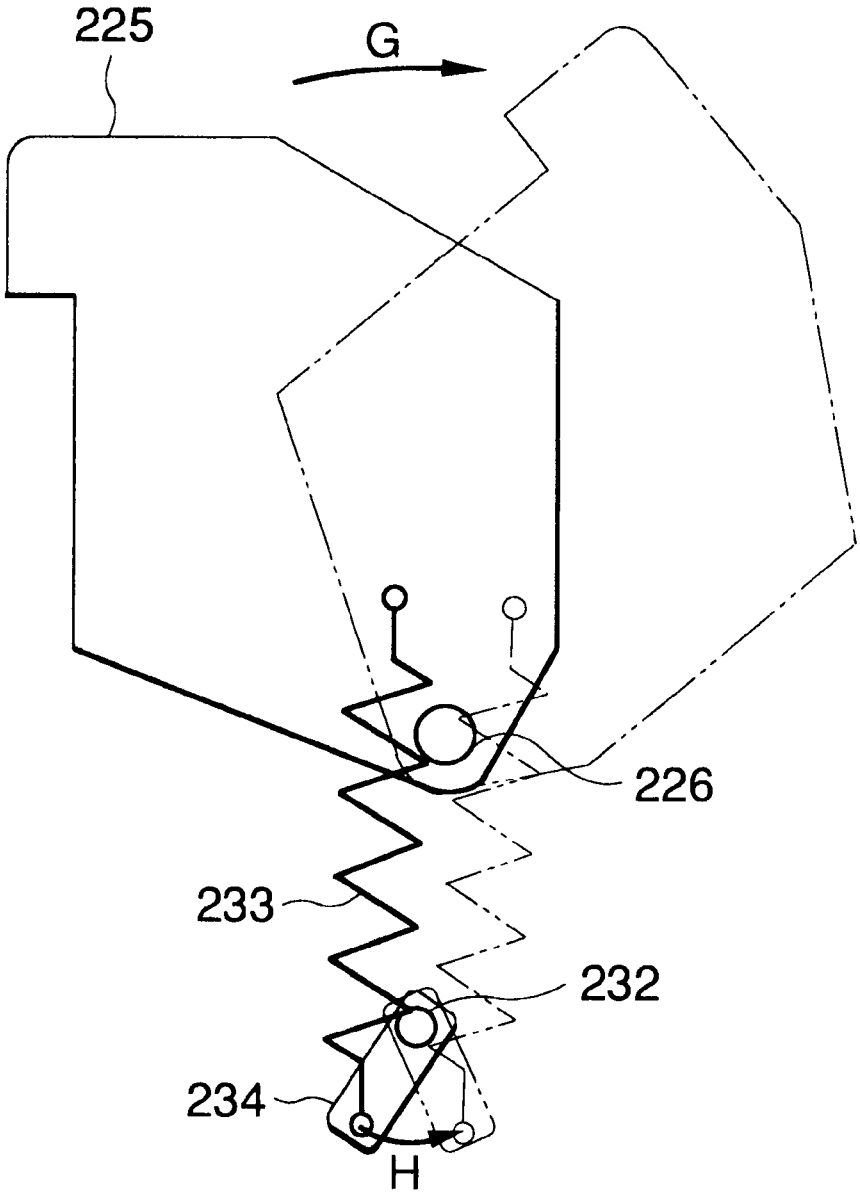
FIG. 22 is an operational schematic drawing showing a rotary motion of the frame structure of the image forming apparatus.

FIG. 22 is an operational schematic drawing showing the rotational motion of the frame structure of the image forming apparatus for supporting the plurality of developing means in a body. It is noted that the same components with those in FIG. 19 will be denoted by the same reference numerals and an explanation thereof will be omitted here.

A mechanism for rotationally moving the frame 225 from a first position where it is urged to the photoreceptor 201 to a second position where it is released from the photoreceptor 201 and for stabilizing the frame 225 at respective positions will be explained with reference to FIG. 22.

The frame 225 is arranged so as to be able to rotationally move between the first position (solid line in the figure) where it is urged to the photoreceptor 201 and the second position (two-dot chain line in the figure) where it is released from the photoreceptor 201 centering on the frame fulcrum 226.

One end of a spring 233 for stabilizing the frame 225 at the first position where the frame 225 is urged to the photoreceptor 201 and the second position where it is released from the photoreceptor 201, respectively, is fixed to the frame 225 and the other end the spring 233 is fixed to an arm 234.

The arm 234 is anchored to a side plate of the equipment proper not shown via an arm fulcrum 232 and is supported so as to be rotatable centering on the arm fulcrum 232. An explanation will be given below assuming that the frame 225 is located at the first position at first.

When the frame 225 is moved, the spring 233 is pulled along that. Then, the frame 225 is urged in the direction of returning the frame 225 to the first position by the force generated by the elongation of the spring 233. When the frame 225 is turned in the direction of arrow G further to move from the first position to the second position, the arm 234 moves in the direction of arrow H by the force generated by the elongation of the spring 233, thus eliminating the elongation of the spring 233.

Accordingly, the spring 233 is urged by the spring 233 in the direction in which it is stabilized in the respective positions when it is located at the first position and the second position.

Because the frame 225 may be stabilized at the two positions by arranging as shown in FIG. 22, the developing means 204, 205, 206 and 207 supported by the frame 225 may be put into the close vicinity to or be abutted with the photoreceptor stably regardless of the vibration caused in driving the photoreceptor and the intermediate transfer body or the vibration caused in the operation of the developing means contacting/separating with/from the photoreceptor in forming an image. Further, it allows to prevent an accident of damaging the photoreceptor and others by closing the frame 225 which is in the released position by touching it by mistake in replacing the photoreceptor.

Figure 23:
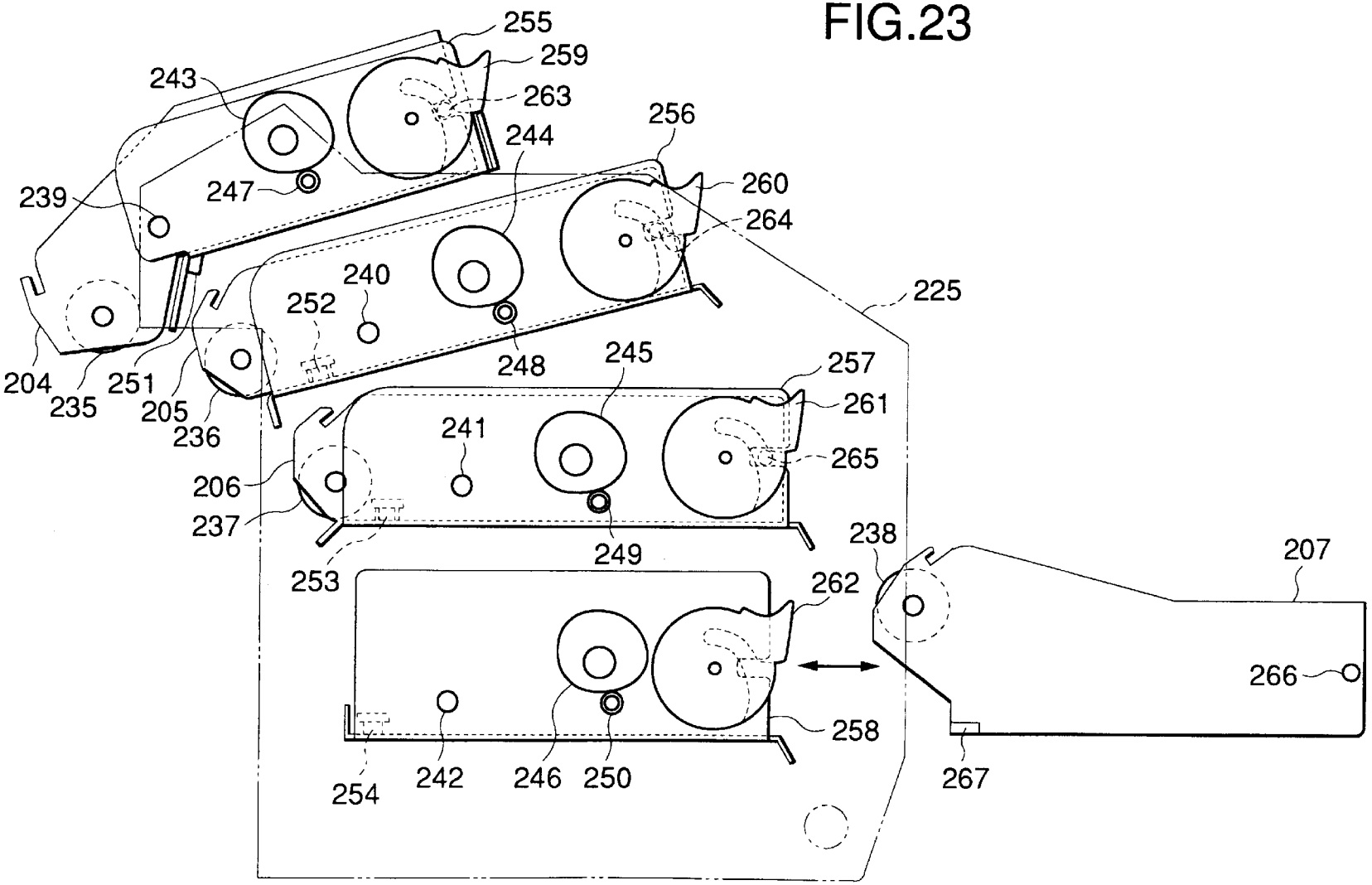
FIG. 23 is a side section view of the frame structure of the image forming apparatus.

FIG. 23 is a side section view of the frame structure for supporting the plurality of developing means of the image forming apparatus in a body. It is noted that the same components with those in FIG. 19 will be denoted by the same reference numerals and an explanation thereof will be omitted here.

The operation of the developing means 204, 205, 206 and 207 removably supported by the frame 225 will be explained briefly with reference to FIG. 23.

The frame 225 is provided with supporting means 255, 256, 257 and 258 for removably supporting the developing means 204, 205, 206 and 207, respectively.

Each of the supporting means 255, 256, 257 and 258 comprises a bottom plate for placing the developing means 204, 205, 206 and 207, respectively, and side plates formed from the both ends of the bottom plate so as to be bent upward.

The supporting means 255, 256, 257 and 258 are coupled to the frame 225 respectively via separating/contacting fulcrums 239, 240, 241 and 242 and are rotatably supported centered on the separating/contacting fulcrums 239, 240, 241 and 242.

Further, the separating/contacting pins 247, 248, 249 and 250 for transmitting driving force for rotating the supporting means 255, 256, 257 and 258 centered on the separating/contacting fulcrums 239, 240, 241 and 242 to the supporting means 255, 256, 257 and 258 are provided respectively at the side plates of the supporting means 255, 256, 257 and 258.

Still more, the frame 225 is provided with rotatable separating/contacting cams 243, 244, 245 and 246 for transmitting the driving force for turning the supporting means 255, 256, 257 and 258 centered on the separating/contacting fulcrums 239, 240, 241 and 242 to the separating/contacting pins 247, 248, 249 and 250. The separating/contacting cams 243, 244, 245 and 246 are eccentric cams.

Further, urging members not shown such as springs for urging the separating/contacting pins 247, 248, 249 and 250 and the separating/contacting cams 243, 244, 245 and 246 are provided between the frame 225 and the supporting means 255, 256, 257 and 258 so that they always abut.

The developing means 204, 205, 206 and 207 are provided with the developing rollers 235, 236, 237 and 238, respectively, at the developing openings.

The developing means 204, 205, 206 and 207 may be selectively moved between the separated position (non-developing position) and the vicinity or contact position (developing position) with respect to the photoreceptor by selectively turning the separating/contacting cams 243, 244, 245 and 246 by a driving source not shown and by selectively moving the supporting means 255, 256, 257 and 258, i.e. the developing means 204, 205, 206 and 207 supported by the supporting means 255, 256, 257 and 258, via the separating/contacting pins 247, 248, 249 and 250 which abut with the outer peripheral faces of the separating/contacting cams 243, 244, 245 and 246.

Notch grooves for inserting fixing pins 263, 264, 265 and 266 disposed on the side of the developing means 204, 205, 206 and 207 are created on the side plates of the supporting means 255, 256, 257 and 258.

Further, fixing cams 259, 260, 261 and 262 for fixing the fixing pins 263, 264, 265 and 266 inserted to the notch grooves to the notch grooves are rotatably supported by the side plates of the supporting means 255, 256, 257 and 258. The fixing cams 259, 260, 261 and 262 are grooved cams having grooves for guiding the fixing pins 263, 264, 265 and 266 and the grooves are formed so as to be eccentric with respect to the center of turn of the fixing cams 259, 260, 261 and 262. The fixing cams 259, 260, 261 and 262 also have projections for hooking by finger to turn them.

Disposed at the bottom plates of the supporting means 256, 257 and 258 are positioning pins 252, 253 and 254 which engage with the developing means 205, 206 and 207 to position the developing means 205, 206 and 207 with respect to the supporting means 256, 257 and 258.

The developing means 205, 206 and 207 have engaging grooves not shown for engaging with the positioning pins of the supporting means 256, 257 and 258.

For instance, the developing means 207 has, at its side face, an engaging section 267 provided almost in parallel with the lower face of the developing means 207 and the engaging section 267 is provided with the engaging groove for engaging with the positioning pin 254 of the supporting means 258.

The developing means 207 is attached/removed in the direction of an arrow in the figure with respect to the supporting means 258. FIG. 23 shows a state in which the developing means 207 is separated from the supporting means 258 of the frame 225.

The developing means 207 is attached to the supporting means 258 by inserting the developing means 207 almost in parallel with the supporting means 258. When the developing means 207 is inserted to the supporting means 258 from the developing opening thereof while holding the developer storage section at the rear part of the developing means 207 by hands, the fixing pin 266 of the developing means 207 is inserted to the notch groove created at the rear part of the side plate of the supporting means 258. When the fixing cam 262 of the supporting means 258 is rotated manually in a predetermined direction, the fixing pin 266 of the developing means 207 inserted to the notch groove of the side plate of the supporting means 258 is guided in the direction in which the developing means 207 advances toward the photoreceptor 201 by the groove formed in the fixing cam 262. When the developing means 207 is moved further toward the photoreceptor 201 by turning the fixing cam 262, the engaging groove of the engaging section 267 of the developing means 207 engages with the positioning pin 254 of the supporting means 258 to position the developing means 207. When the engaging section 267 of the developing means 207 engages with the positioning pin 254 of the supporting means 258, it becomes impossible for the developing means 207 to move and the fixing cam 262 to turn further. Thus, the developing means 207 is fixed to the supporting means 258.

The developing means 205 and 206 are also fixed to the supporting means 256 and 257 in the same manner with the developing means 207 by connecting the fixing pins 264 and 265 of the developing means 205 and 206 to the notch grooves of the side plates of the supporting means 256 and 257, by connecting the engaging grooves of the engaging sections of the developing means 205 and 206 with the positioning pins 252 and 253 of the supporting means 256 and 257 and by urging the fixing pins 264 and 265 of the developing means 205 and 206 by the fixing cams 260 and 261 of the supporting means 256 and 257 so that the connection of the respective pins and grooves is fixed.

The developing means 204 is also fixed to the supporting means 255 in the same manner with the developing means 207. However, instead of the engaging section 267 of the developing means 207 in which the engaging groove is created, the developing means 204 has a pin-like positioning projection 251 formed in a body at the lower face of the developing means 204 as an engaging section corresponding the engaging section 267. Meanwhile, the supporting means 255 for supporting the developing means 204 has a positioning hole not shown for engaging with the positioning projection 251 of the developing means 204 at the bottom plate of the supporting means 255 instead of the positioning pin 254 of the supporting means 258 as what corresponds thereto. Then, the developing means 204 is fixed to the supporting means 255 by connecting the fixing pin 263 of the developing means 204 to the notch groove of the side plate of the supporting means 255, by connecting the positioning projection 251 of the developing means 204 with the positioning hole of the supporting means 255 and by urging the fixing pin 263 of the developing means 204 by the fixing cam 259 of the supporting means 255 so that the respective connections are fixed.

The arrangement of the present equipment described above allows the photoreceptor to be readily attached/removed to/from the equipment proper and the cost of the photoreceptor unit to be reduced by providing the means for separating/contacting and moving the developing means with respect to the photoreceptor on the frame 225 and by not providing on the side of the photoreceptor.

Although the present equipment has been arranged such that the developing means 204, 205, 206 and 207 are supported in the state in which almost the whole lower faces thereof contact with the upper faces of the bottom plates of the supporting means 255, 256, 257 and 258, there may be a case when a looseness is created between the developing means and the supporting means when the surface precision of the lower face of the developing means or the bottom plate of the supporting means is not enough. In such a case, it is possible to prevent the looseness between the developing means and the supporting means by forming a coating film such as rubber at least on the lower face of the developing means or the bottom plate of the supporting means.

Further, the present equipment is arranged such that the bottom plate of the supporting means has an enough strength so that it will not deflect even when the developing means is placed. Accordingly, even if the developing means has the lengthy shape in the direction of the axis of the image carrier, the developing means will cause no deflection or distortion and an image may be formed stably.

Although the bottom plate and the side plates of the supporting means may be separately formed, it is preferable to form the bottom plate and the side plates in a body by bending it because, thereby, the rigidity of the supporting means improves.

Further, although the present equipment is arranged such that almost the whole face of the lower face of the developing means contacts with the bottom plate of the supporting means, it is also possible to arrange such that only part of the lower face of the developing means and the bottom plate of the supporting means contacts each other by forming a plurality of convex portions on the lower face of the developing means or the bottom plate of the supporting means. When the present equipment is arranged as such, it is preferable to form the plurality of convex portions on the lower face of the developing means or the bottom plate of the supporting means into a shape continuous in the axial direction in order to prevent the developing means from deflecting. Or, it is preferable to form the convex portions to be formed on the lower face of the developing means or the bottom plate of the supporting means at least three spots whose position is different seeing from the axial direction so as to support the end and the middle portions of the developing means respectively seeing from the axial direction, instead of forming continuously in the axial direction.

It is also possible to provide cam rotation inhibiting means for inhibiting the fixing cams 259, 260, 261 and 262 from turning in the direction opposite from the direction for fixing the developing means and from loosening the fixation of the developing means 204, 205, 206 and 207 and the supporting means 255, 256, 257 and 258 in the state in which the fixing cams 259, 260, 261 and 262 of the supporting means 255, 256, 257 and 258 urges the fixing pins 263, 264, 265 and 266 of the developing means 204, 205, 206 and 207 in the direction of fixing the developing means 204, 205, 206 and 207 with the supporting means 255, 256, 257 and 258.

Further, although the present equipment has been arranged such that the developing means 204 has the positioning projection 251 as part of means for connecting with the supporting means 255 and the supporting means 255 has the corresponding positioning hole and the developing means 205, 206 and 207 has the positioning grooves as part of means for connecting with the supporting means 256, 257 and 258 and the supporting means 256, 257 and 258 have the corresponding positioning pins 252, 253 and 254, respectively, it is also possible to arrange such that all the developing means are provided with the same positioning projection with that of the developing means 204 and all the supporting means are provided with the same positioning hole with that of the supporting means 255. Or, in contrary, it is also possible to arrange such that all the developing means are provided with the same positioning groove with that of the developing means 207 and all the supporting means are provided with the same positioning pin with that of the supporting means 258.

It is also possible to prevent the developing means from being erroneously inserted by differentiating the type, arrangement and number of the positioning projection or the positioning groove of the developing means and the corresponding positioning hole and positioning pin of the supporting means per developing means and supporting means corresponding thereto.

Figure 24A:
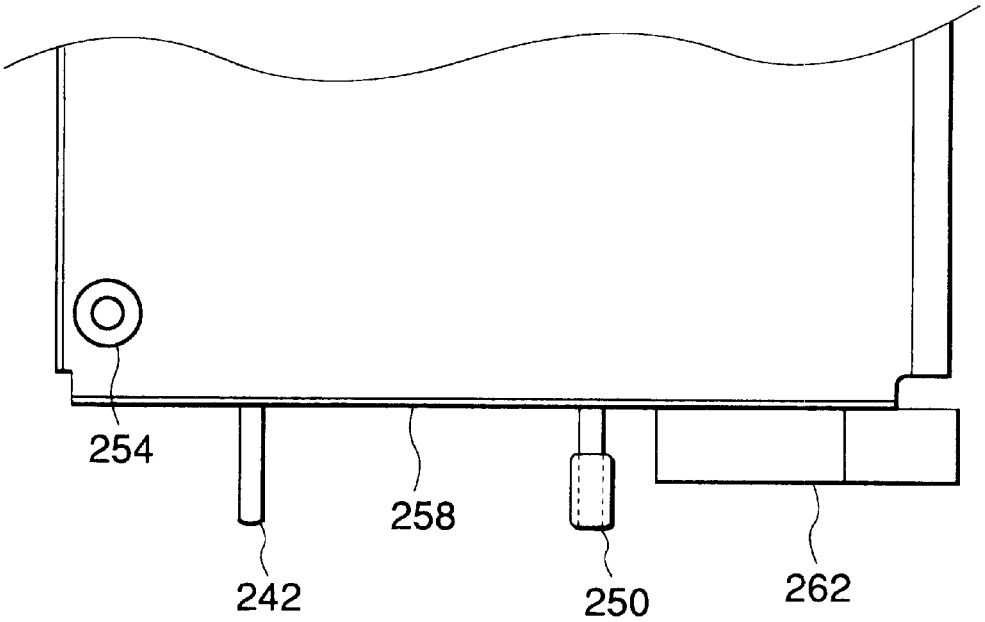
FIGS. 24A and 24B are schematic drawings of supporting means for supporting developing means of the image forming apparatus.
Figure 24B:
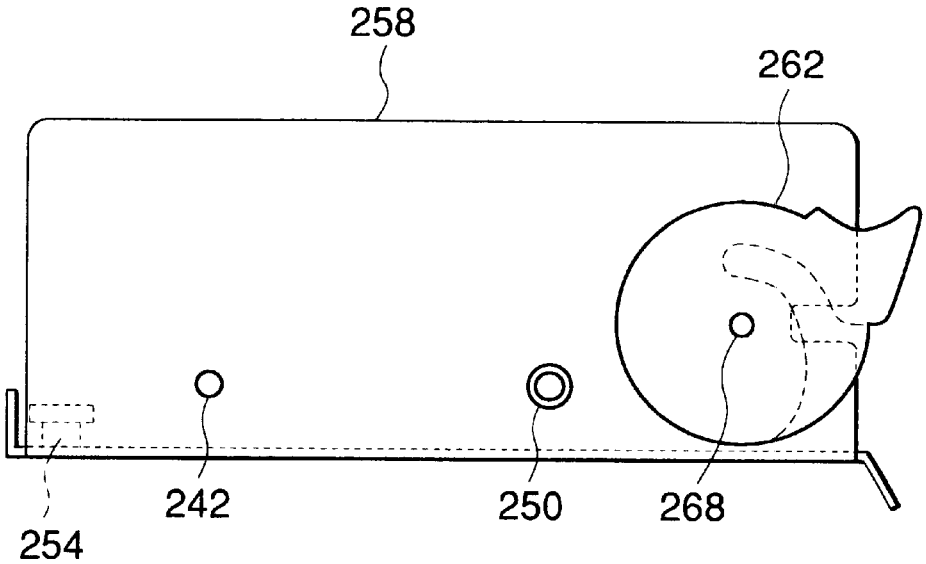

FIGS. 24A and 24B are schematic drawings of the supporting means for supporting the developing means of the image forming apparatus. It is noted that the same components with those in FIG. 19 will be denoted by the same reference numerals and an explanation thereof will be omitted here.

The supporting means pivotably supported by the frame structure for supporting the developing means will be explained briefly by using FIGS. 24A and 24B and by exemplifying the supporting means 258. FIG. 24A is an upper schematic drawing of the supporting means 258 and FIG. 24B is a side schematic drawing of the supporting means 258.

The supporting means 258 comprises the bottom plate for placing the developing means and the side plates bent upward from the both ends of the bottom plate in a body therewith.

The supporting means 258 is mounted to the frame via the separating/contacting fulcrum 242 formed on the side plate of the supporting means 258 and is pivotably supported around the separating/contacting fulcrum 242.

The side plate of the supporting means 258 is also provided with the separating/contacting pin 250 for transmitting the driving force for driving and turning the supporting means 258 centering on the separating/contacting fulcrum 242 to the supporting means 258.

The separating/contacting pin 250 receives the driving force through the separating/contacting cam pivotably supported by the frame. It is noted that it is also possible to form a coating film made of lubricant resin at the section where the separating/contacting pin 250 abuts with the separating/contacting cam.

The notch groove for inserting the fixing pin disposed on the side of the developing means is formed on the side plate of the supporting means 258.

Further, the fixing cam 262 for fixing the fixing pin of the developing means inserted to the notch groove to the notch groove is rotatably supported by a fixing cam fulcrum 268 at the side plate of the supporting means 258.

The fixing cam 262 is a grooved cam having a groove for guiding the fixing pin. The groove is created so as to be eccentric with respect to the center of rotation of the fixing cam 262, i.e. to the fixing cam fulcrum 268.

The positioning pin 254 which engages with the developing means to position the developing means to the supporting means 258 is disposed at the bottom plate of the supporting means 258.

Figure 25A:
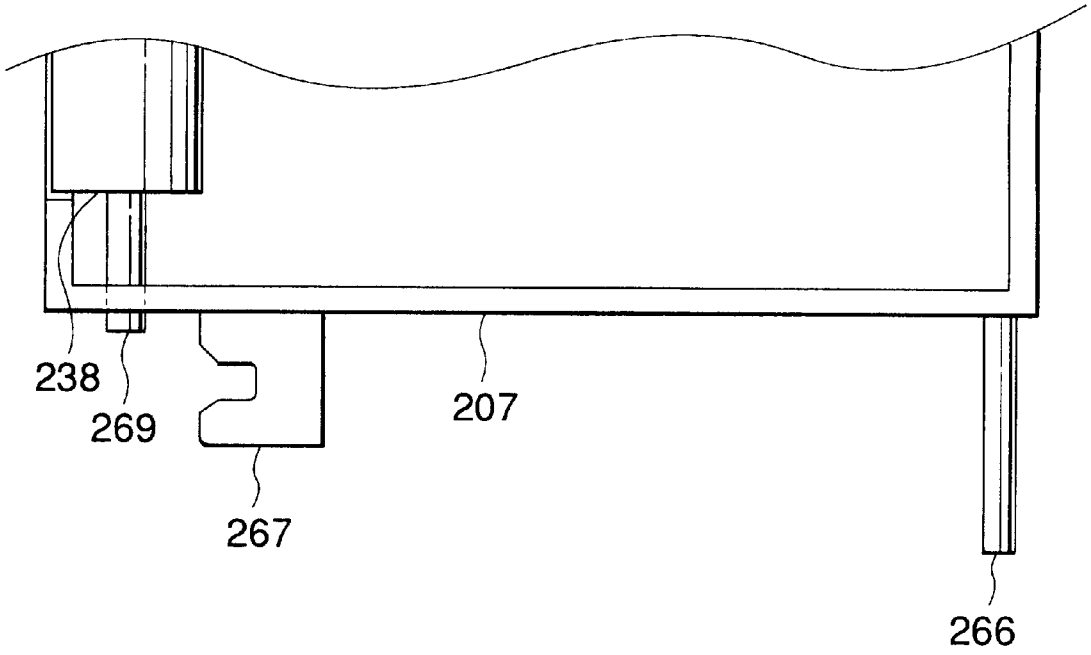
FIGS. 25A and 25B are schematic drawings of the developing means of the image forming apparatus.
Figure 25B:
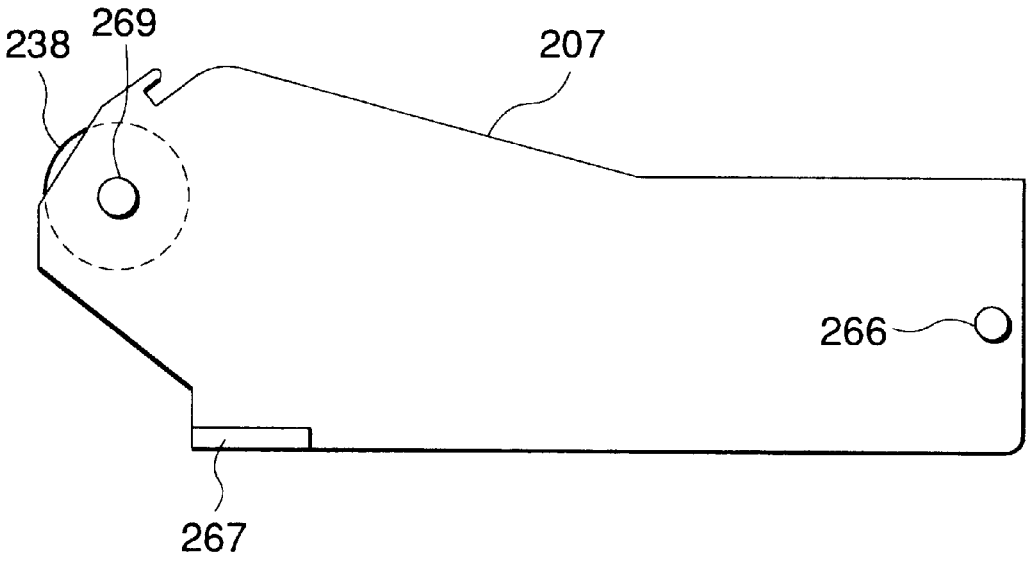

FIGS. 25A and 25B are schematic drawings of the developing means of the image forming apparatus. It is noted that the same components with those in FIG. 23 will be denoted by the same reference numerals and an explanation thereof will be omitted here.

The developing means will be briefly explained by using FIGS. 25A and 25B and by exemplifying the developing means 207. FIG. 25A is an upper sectional schematic drawing of the developing means 207 and FIG. 25B is a side schematic drawing of the developing means 207.

The developing means 207 is provided with the developing roller 238 at the developing opening thereof. The developing roller 238 has a shaft 269 at the both ends thereof. The shaft 269 is rotatably supported by the side of the developing means 207 and is driven by the driving source and the drive transmitting means not shown.

The fixing pin 266 which is to be inserted to the notch groove at the side plate of the supporting means is formed on the side of the developing means 207.

Further, the engaging section having the engaging groove for engaging with the positioning pin formed at the bottom plate of the supporting means is formed on the side of the developing means 207.

Figure 26A:
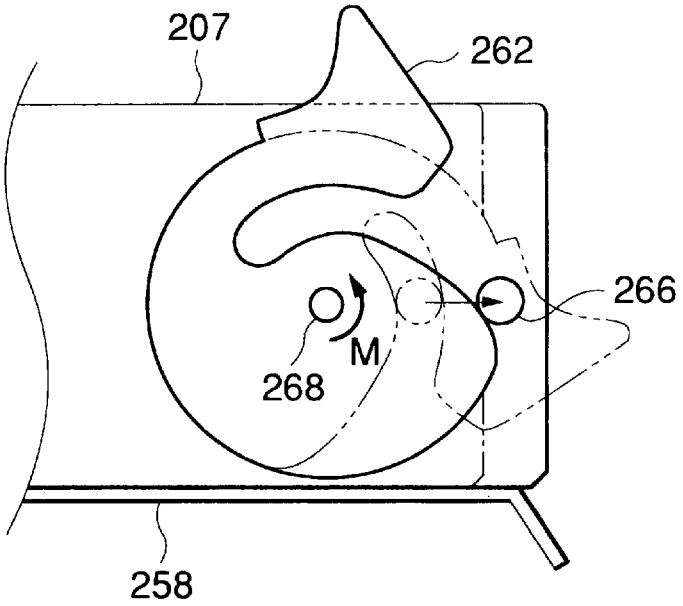
FIGS. 26A and 26B are operational schematic drawings showing operations of the supporting means in attaching/removing the developing means of the image forming apparatus.
Figure 26B:
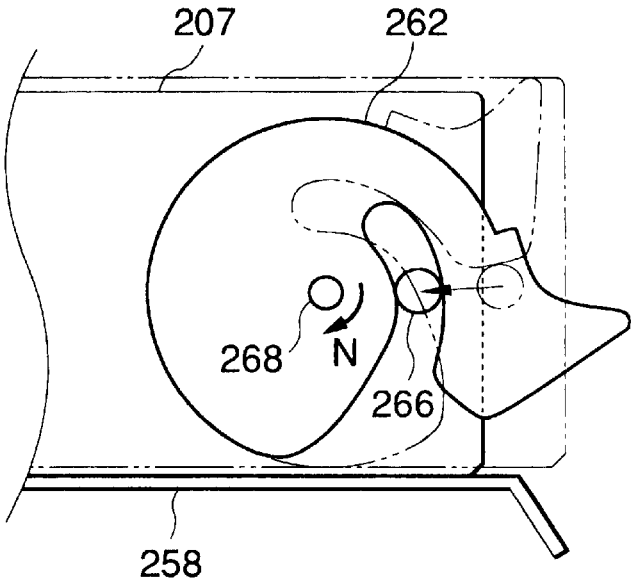

FIGS. 26A and 26B are operational schematic drawings showing the operation of the supporting means of the image forming apparatus for attaching/removing the developing means. It is noted that the same components with those in FIGS. 23 and 24 will be denoted by the same reference numerals and an explanation thereof will be omitted here.

The operation of the supporting means, removably supporting the developing means, for attaching/removing the developing means will be explained briefly by using FIGS. 26A and 26B and by exemplifying the supporting means 258 and the developing means 207. FIG. 26A is a side schematic drawing of the supporting means 258 showing the operation for releasing the developing means 207 from the supporting means 258 and FIG. 26B is a side schematic drawing of the supporting means 258 showing the operation for fixing the developing means 207 to the supporting means 258.

FIG. 26A shows a state in which the developing means 207 is fixed by the supporting means 58 when the developing means 207, the fixing pin 266 formed on the side of the developing means 207 and the fixing cam 262 rotatably supported by the side of the supporting means 258 are located respectively at the positions shown by a two-dot chain line.

When the fixing cam 262 is rotated and moved in the direction of an arrow M centering on the fixing cam fulcrum 268, the fixing pin 266 formed on the side of the developing means 207 is guided by the eccentric groove of the fixing cam 262 along the notch groove not shown formed on the side plate of the supporting means 258 as if it is pushed out from the supporting means 258 to the rear side thereof in the direction of the arrow in the figure. When the developing means 207 moves in the direction of increasing the distance between the photoreceptor 201 and the developing means 207, i.e. toward the rear side of the supporting means 258, as the fixing pin 266 moves as described above, the positioning pin not shown formed at the bottom plate of the supporting means 258 is released from the engaging groove of the engaging section not shown of the developing means 207, thus releasing the developing means 207 from the supporting means 258.

When the developing means 207, the fixing pin 266 formed on the side of the developing means 207 and the fixing cam 262 rotatably supported by the side of the supporting means 258 are located respectively at the positions shown by a solid line, the developing means 207 is released from the supporting means 258.

When the developing means 207 moves in the direction of being released from the supporting means 258, at least part of the developer storage section of the developing means 207, i.e. the rear portion of the developing means 207, protrudes out of the rear portion of the supporting means 258.

By arranging the present equipment as described above, the developing means 207 always moves in the direction of separating from the photoreceptor 201 when the fixing cam 262 for fixing the developing means 207 is rotated so as to release the developing means 207, so that it becomes possible to prevent the developing means 207 from contacting with the photoreceptor 201 and the developing means 207 or the photoreceptor 201 from being damaged in releasing it. Further, because the rear portion of the developing means 207 protrudes out of the rear portion of the supporting means 258 when the developing means 207 is released, the developing means 207 may be taken out of the supporting means 258 readily by hands.

FIG. 26B shows a state in which the developing means 207 is not fixed by the supporting means 258 when the developing means 207, the fixing pin 266 formed on the side of the developing means 207 and the fixing cam 262 rotatably supported by the side of the supporting means 258 are located respectively at the positions shown by a two-dot chain line.

When the developing means 207 is pushed into the supporting means 258 in almost parallel with the bottom plate of the supporting means 258, the fixing pin 266 formed on the side of the developing means 207 is inserted to the notch groove not shown formed on the side of the supporting means 258.

When the developing means 207 is pushed in further, the fixing pin 266 moves further by being guided by the notch groove not shown formed on the side of the supporting means 258 and the developing means 207 moves in the direction of shortening the distance between the photoreceptor 201 and the developing means 207, i.e. toward the front side of the supporting means 258.

When the developing means 207 is pushed in, the fixing pin 266 of the developing means 207 moves along the notch groove not shown formed on the side of the supporting means 258 and is inserted to the eccentric groove of the fixing cam 262 rotatably supported by the side of the supporting means 258.

When the fixing pin 266 of the developing means 207 abuts with the fixing cam 262 of the supporting means 258, the developing means 207 cannot be pushed in further from that position and the move of the developing means 207 is stopped once there.

When the fixing cam 262 is rotated in the direction of an arrow N centering on the fixing cam fulcrum 268 when the developing means 207 is moved to the position where the fixing pin 266 of the developing means 207 abuts with the fixing cam 262 of the supporting means 258, the fixing pin 266 formed on the side of the developing means 207 is guided by the eccentric groove of the fixing cam 262 along the notch groove not shown formed on the side plate of the supporting means 258 as if it is pushed in the direction of an arrow in the figure toward the front and lower part of the supporting means 258.

Along the move of the fixing pin 266, the developing means 207 moves toward the front and lower part of the supporting means 258. Then, the developing means 207 is fixed to the supporting means 258 when the positioning pin not shown formed at the bottom plate of the supporting means 258 engages with the engaging groove of the engaging section not shown of the developing means 207 and when the lower face of the developing means 207 is urged to and adheres with the upper face of the bottom plate of the supporting means 258.

When the developing means 207, the fixing pin 266 formed on the side of the developing means 207 and the fixing cam 262 rotatably supported by the side of the supporting means 258 are located respectively at the positions shown by a solid line, the developing means 207 is fixed to the supporting means 258.

By arranging the present equipment as described above, the developing means 207 is stopped once at the front side from the position where it is fixed to the supporting means 258, i.e. at the position fully separated from the photoreceptor 201, in inserting the developing means 207 to the supporting means 258, so that the developing means 207 will not run into the photoreceptor 201, damaging itself or the photoreceptor 201, even if the user inserts the developing means 207 to the supporting means 258 by excessive force by mistake.

Further, the developing means 207 is urged, in the same time, in the two directions of engaging the positioning pin not shown formed at the bottom plate of the supporting means 258 with the engaging groove of the engaging section not shown of the developing means 207 (i.e. the front direction of the supporting means 258) and of adhering the lower face of the developing means 207 with the upper face of the bottom plate of the supporting means 258 (i.e. in the direction of the lower face of the supporting means 258) when the fixing cam 262 for fixing the developing means 207 to the supporting means 258 is turned so as to fix the developing means 207, so that the developing means 207 is fixed to the supporting means 258 firmly without looseness and images may be formed stably even when the equipment is used for a long period of time.

Figure 27:
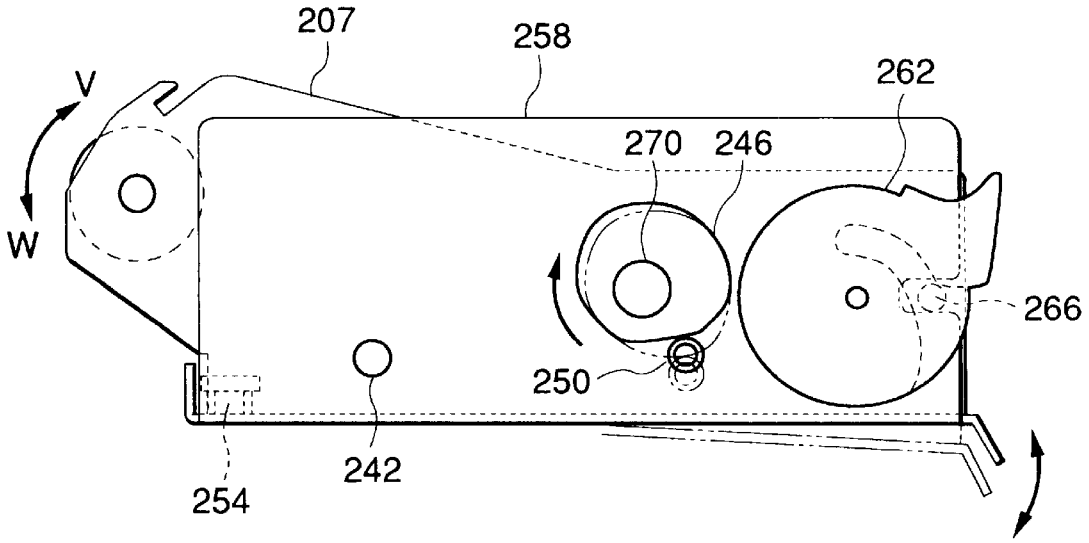
FIG. 27 is an operational schematic drawing showing operations for separating/contacting the developing means from/to the image carrier of the image forming apparatus.

FIG. 27 is an operational schematic drawing showing operations for separating/contacting the developing means from/to the photoreceptor of the image forming apparatus. It is noted that the same components with those in FIG. 23 will be denoted by the same reference numerals and an explanation thereof will be omitted here.

The operations for moving the developing means to the developing position where the developing means contacts with or approaches to the photoreceptor and to the non-developing position where the developing means is separated from the photoreceptor will be explained briefly by using FIG. 27 and by exemplifying the developing means 207 and the supporting means 258.

In FIG. 27, the developing means 207 is fixed to the supporting means 258 by engaging the positioning pin formed at the bottom plate of the supporting means 258 with the engaging groove of the engaging section not shown of the developing means 207 by fixing the fixing pin 266 formed on the side of the developing means 207 and inserted to the notch groove formed on the side of the supporting means 258 by turning the fixing cam 262 rotatably supported by the side of the fixing cam 262 in the direction of fixing the developing means 207 to the supporting means 258.

The operation for selectively moving the developing means 207 to the non-developing position or the developing position is performed by selectively turning a separating/contacting cam 246 rotatably supported by the frame not shown by a predetermined angle in the direction of an arrow in the figure by a driving source not shown.

A separating/contacting pin 250 formed on the side plate of the supporting means 258 abuts with the outer peripheral face of the separating/contacting cam 246 and when the separating/contacting cam 246 is rotated by the predetermined angle centered on a separating/contacting cam fulcrum 270, the separating/contacting pin 250 moves by a predetermined distance because the separating/contacting cam 246 is an eccentric cam.

A separating/contacting fulcrum 242 is formed on the side of the supporting means 258 and the supporting means 258 is rotatably supported by the frame via the separating/contacting fulcrum 242.

Accordingly, when the separating/contacting cam 246 is turned by the predetermined angle and the separating/contacting pin 250 is moved, the supporting means 258 and hence the developing means 207 fixed by the supporting means 258 turn and as shown by an arrow in the figure centering on the separating/contacting fulcrum 242 and move to an either position of position V or position W. The developing means 207 may be moved selectively between the developing position and the non-developing position with respect to the photoreceptor 201 by moving the developing opening of the developing means 207 reciprocally between the position V and the position W in correspondence to the turn of the separating/contacting cam 246.

The shape and the turning angle of the separating/contacting cam 246 are set so that the position in which the supporting means 258 directs the developing opening of the developing means 207 in the direction of position V is the developing position and the position in which the supporting means 258 directs the developing opening of the developing means 207 in the direction of position W is the non-developing position.

Because the positions of the developing means 204, 205, 206 and 207 with respect to the photoreceptor 201 are different each other, the developing position and the non-developing position in each developing means need not be the same with those of the developing means 207 and may be adequately selected in the developing means 204, 205 and 206, other than the developing means 207. That is, one of the position V or the position W of the reciprocal move of the developing means caused by the separating/contacting cam may be set as the developing position and the other as the non-developing position corresponding to the position of each developing means.

Although the preferred embodiment has been explained by exemplifying the type of image forming apparatus in which the plurality of developing means are disposed in parallel on the outer peripheral face of the image carrier, it is also applicable to a type of image forming apparatus in which the plurality of developing means are supported by a turnable frame structure and the developing means are moved sequentially and selectively almost at the same developing position facing to the image carrier by turning the frame structure to develop an image.

Figure 28:
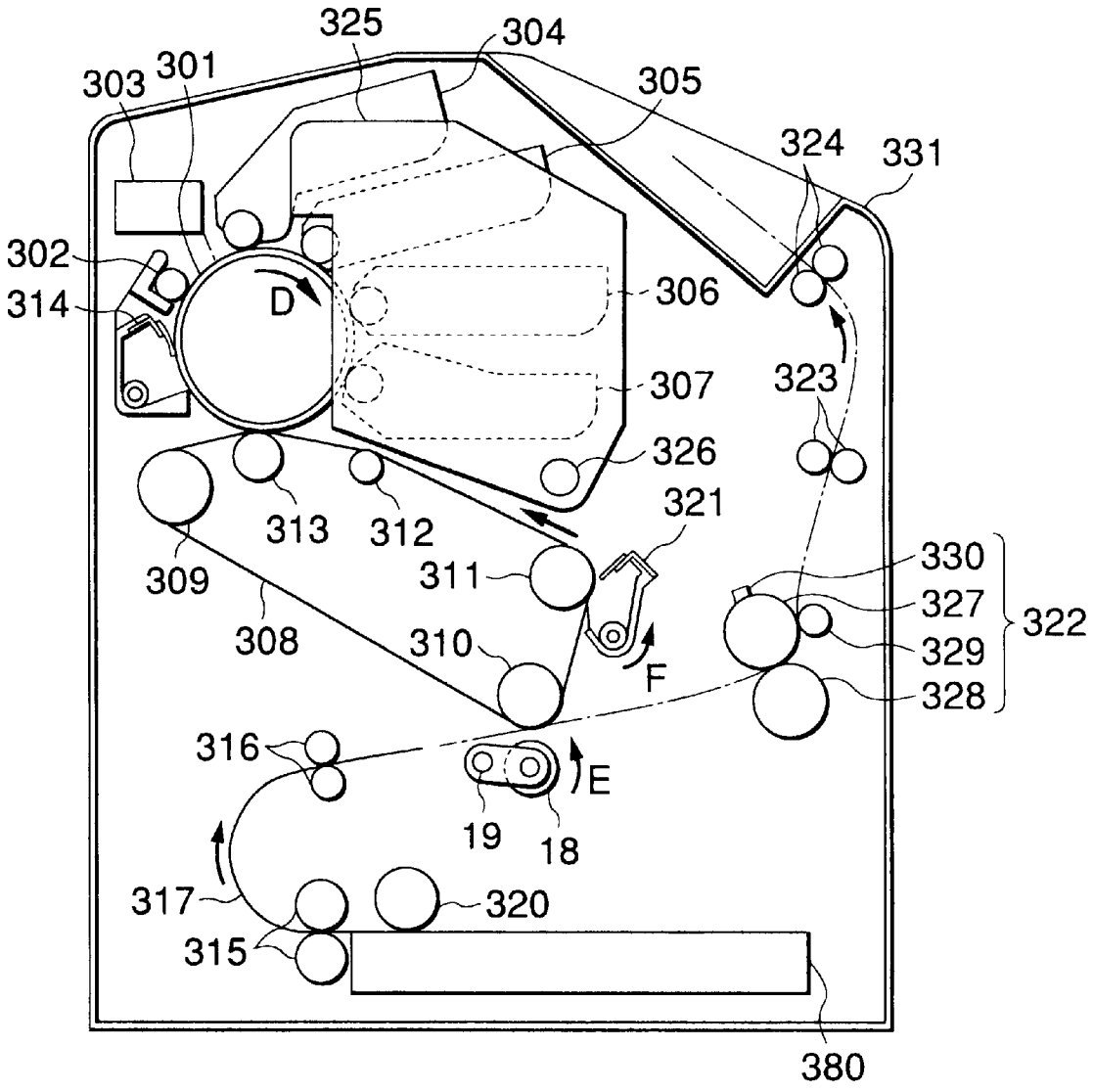
FIG. 28 is a section view showing the whole structure of an image forming apparatus according to the present invention.

FIG. 28 is a section view showing the whole structure of a further image forming apparatus, i.e. the color image forming apparatus using a belt-like intermediate transfer body. The whole structure and the operation of the equipment will be explained with reference to FIG. 28.

In FIG. 28, a drum-like photoreceptor (image carrier) 301 is driven to rotate in the direction of an arrow D by a driving source such as a motor not shown. Charging means 302 such as a charging roller is disposed on the outer periphery of the photoreceptor 301 to charge the surface of the photoreceptor 301 uniformly while abutting with the photoreceptor 301 and rotating.

The photoreceptor 301 whose surface has been uniformly charged is scanned and exposed selectively corresponding to image information of yellow for example as a first color by latent image forming means 303 such as a laser scanning optical system to form an electrostatic latent image for yellow.

Developing units 304, 305, 306 and 307 in which yellow, magenta, cyan and black toners are stored as developers, respectively, and which are capable of contacting/separating with/from the photoreceptor 301 are disposed on the rotational downstream side of the photoreceptor 301 on which the electrostatic latent image has been recorded. The electrostatic latent image of yellow thus formed is developed only when the yellow developing unit 304 abuts with the photoreceptor 301, thus forming a yellow toner image.

An intermediate transfer belt 308 is disposed adjacent to the photoreceptor 301 on the rotational downstream side of the photoreceptor 301 on which the toner image has been formed. The intermediate transfer belt 308 is hooked around a driving roller 309, a backup roller 310, a tension roller 311 and a smoothing roller 312 and is driven at the same speed with a peripheral speed of the photoreceptor 301. Driving force of the photoreceptor 301 is transmitted to the driving roller 309 to drive the intermediate transfer belt 308 in synchronism with the photoreceptor 301.

A primary transfer roller 313 is urged toward the photoreceptor 301 via the intermediate transfer belt 308 and voltage is supplied from a high voltage source not shown to the primary transfer roller 313 at the primary transfer position where the intermediate transfer belt 308 is pinched by the photoreceptor 301 and the primary transfer roller 313 to transfer the yellow toner image which has been formed in accordance to the aforementioned procedure to the surface of the intermediate transfer belt 308.

The photoreceptor 301 from which the yellow toner image has been transferred to the intermediate transfer belt 308 is turned further in the direction of the arrow D to wipe out the toner remaining on the surface of the photoreceptor 301 by a photoreceptor cleaner 314 comprising a cleaner blade and the like. It allows an image to be formed again.

The same procedure is repeated for the second through fourth colors (magenta, cyan and black) to lay and record toner images of the four colors one after another on the intermediate transfer belt 308.

After finishing to lay the four colors of toner images on the intermediate transfer belt 308, a recording member 317 is fed from a sheet cassette (recording member storage means) by a sheet feeding roller 320 and pairs of sheet conveying rollers 315 and 316. In synchronism with it, a secondary transfer roller 318 turns in the direction of an arrow E centering on a secondary transfer fulcrum 319 by clutch and cam mechanisms not shown and abuts with the backup roller 310 via the intermediate transfer belt 308. Then, voltage from a high voltage source not shown is applied to the secondary transfer roller 318 to transfer the four color toner images on the intermediate transfer belt 308 to the recording member 317 altogether at the secondary transfer position where the recording member 317 and the intermediate transfer belt 308 are pinched by the backup roller 310 and the secondary transfer roller 318.

Then, the intermediate transfer belt 308 from which the secondary transfer has been finished abuts with a cleaner 321 comprising a cleaner blade and the like which turns in the direction of an arrow F by clutch and cam mechanisms not shown to wipe out the toners remaining on the surface of the intermediate transfer belt 308. After finishing to wipe out the toners, the cleaner 321 turns in the opposite direction from the arrow F to retreat.

The recording member 317 on which the four color toner images have been transferred reaches to fixing means 322 via a first recording member conveying path for conveying the recording member 317 from the secondary transfer position in almost parallel with the equipment proper and is pinched and conveyed while being heated and pressurized by the fixing means 322 to fix the toner images. The conveying direction of the recording member 317 on which the toner images have been fixed is changed in the direction of the upper face of the equipment proper by the fixing means 322. It is then discharged out to the upper face of the equipment by pairs of discharge rollers 323 and 324 disposed at a second recording member conveying path for conveying the recording member 317 from the fixing means 322 almost vertically to the equipment proper, reaching to the upper face of the equipment. Thus the recording of the color image is completed.

Several arrangements of the equipment shown in FIG. 28 will be explained below supplementarily.

A control panel 331 for indicating instructions for controlling the image forming apparatus and showing a status of the image forming apparatus is provided on a front cover of the equipment proper. It is noted that the control panel 331 may be provided on an upper cover.

The developing units 304, 305, 306 and 307 are removably supported by a frame 325 and the frame 325 is rotatably supported centering on a frame fulcrum 326.

The fixing means 322 comprises a heat roller 327 containing heating means such as a halogen lamp, a first pressure roller 328, a second pressure roller 329, and pad-like or rolled surface lubricant applying means 330 for applying surface lubricant such as silicone oil to the heat roller 327 or for cleaning the surface of the heat roller 327.

Figure 29:
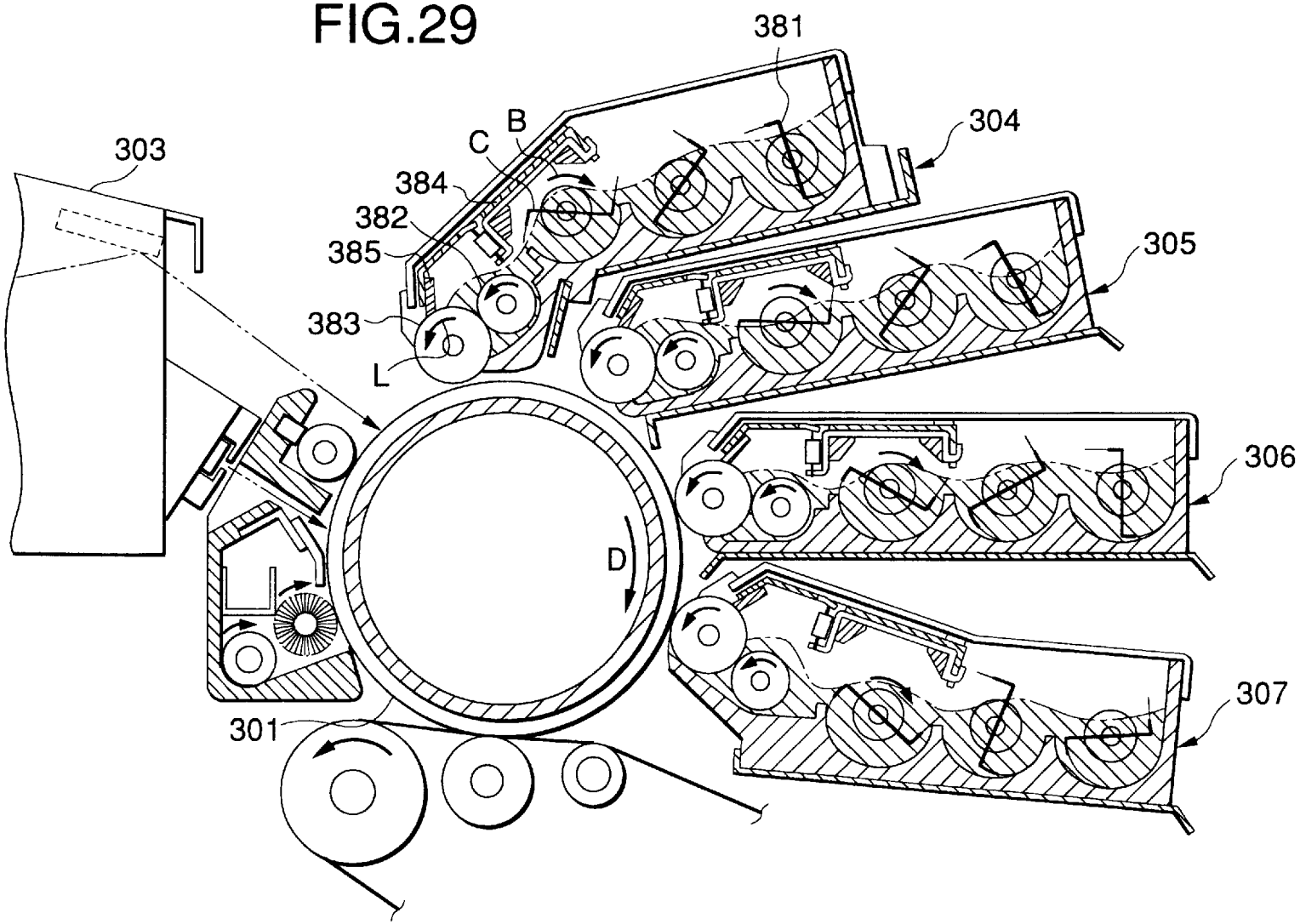
FIG. 29 is a section view showing an arrangement of developing units around a photoreceptor of the image forming apparatus.

FIG. 29 is a section view showing an arrangement of the developing units disposed around the photoreceptor. The whole structure and an operation of each developing unit will be explained with reference to FIG. 29.

FIG. 29 shows, from the top to the bottom, the yellow developing unit 304, the magenta developing unit 305, the cyan developing unit 306 and the black developing unit 307.

Each developing unit is filled with toner (cross-hatched in the figure) and is provided with agitators 81 for agitating the toner by slowly rotating in the direction of an arrow B in order to prevent the toner from coagulating and to cause it to deposit uniformly.

A supplying roller 382 in which a conductive elastic member is disposed around a shaft member is pressed by a developing roller 383 while rotating in the direction of an arrow C to supply the toner to the developing roller 383 while frictionally charging it.

The developing roller 383 which has been supplied with the toner rotates in the direction of an arrow L and a restricting member 385 pasted to one end of a sheet metal 384 contacts and presses it to restrict a layer of the toner to an adequate thickness.

It is also possible to arrange the developing roller 383 by providing an elastic member such as rubber around the surface of a metallic roller or by applying a surface treatment to the surface of the metallic roller with an adequate surface roughness and to make the restricting member 385 by rubber, resin, metal and the like.

The developing unit constructed as described above is approached to the photoreceptor 301 and a potential is applied between the photoreceptor 301 and the developing roller 383 as necessary to explicitly image the electrostatic latent image on the photoreceptor 301 by the toner. The magenta developing unit 305, the cyan developing unit 306 and the black developing unit 307 also have almost the same structure with the yellow developing unit 304.

Figure 30:
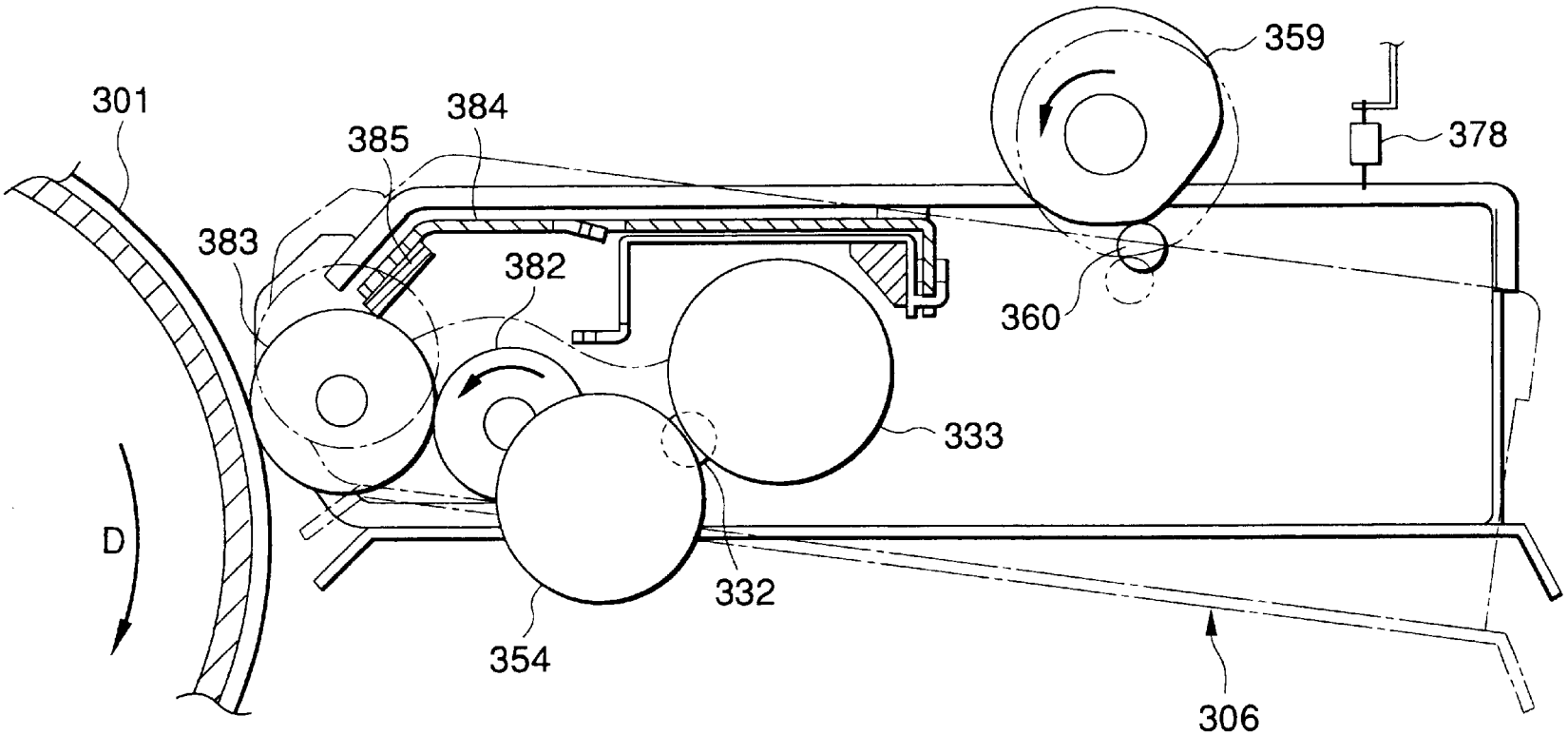
FIG. 30 is a section view of a cyan developing unit of the image forming apparatus.

FIG. 30 is a section view showing the cyan developing unit 306 of the image forming apparatus of the present embodiment. Developing unit moving means for moving each developing unit to a developing position where each developing unit is approached to the photoreceptor 301 and a standby position where it is separated from the photoreceptor 301 will be explained with reference to FIG. 30.

In FIG. 30, a figure shown by a solid line represents the developing position where the developing unit is approached to the photoreceptor 301 and a figure shown by a two-dot chain line represents the standby position where the developing unit is separated from the photoreceptor 301.

Power is transmitted to the developing roller 383 and the supplying roller 382 from an input gear 333 via a plurality of gears. The input gear 333 is supplied with the power from a power source for driving the developing unit, i.e. from a driving motor, via a developing unit driving gear 354. It is noted that the input gear 333 is fixed to the developing unit and when the developing unit rocks, it rocks in the same manner centering on a rocking fulcrum 332. It is noted that because the developing unit driving gear 354 is fixed to the image forming apparatus proper, it does not move even when the developing unit rocks.

Here, the rocking fulcrum 332 of the developing unit is set centering on the vicinity of a gear tangent point of the input gear 333 and the developing unit driving gear 354. Accordingly, the developing unit moves between the developing position where the developing unit approaches to the photoreceptor 301 and the standby position where the developing unit is separated from the photoreceptor 301. Further, the developing unit is provided with a cam pin 360 and when a cam 359 makes a rotation, it receives force of action of pushing down the right side of the developing unit in the figure centering on the rocking fulcrum 332. Thereby, the developing unit moves to the position shown by the two-dot chain line in the figure, i.e. to the standby position where the developing unit is separated from the photoreceptor 301.

When the cam 359 does not act on the cam pin 360, the right side of the developing unit in the figure is urged and pulled up by an urging spring 378 to the developing position. Further, because the rocking fulcrum 332 of the developing unit is set centering on the gear tangent point of the input gear 333 and the developing unit driving gear 354 as described above, the position of the gear tangent point does not change and the developing unit driving gear 354 and the input gear 333 can transmit the power.

Figure 31A:
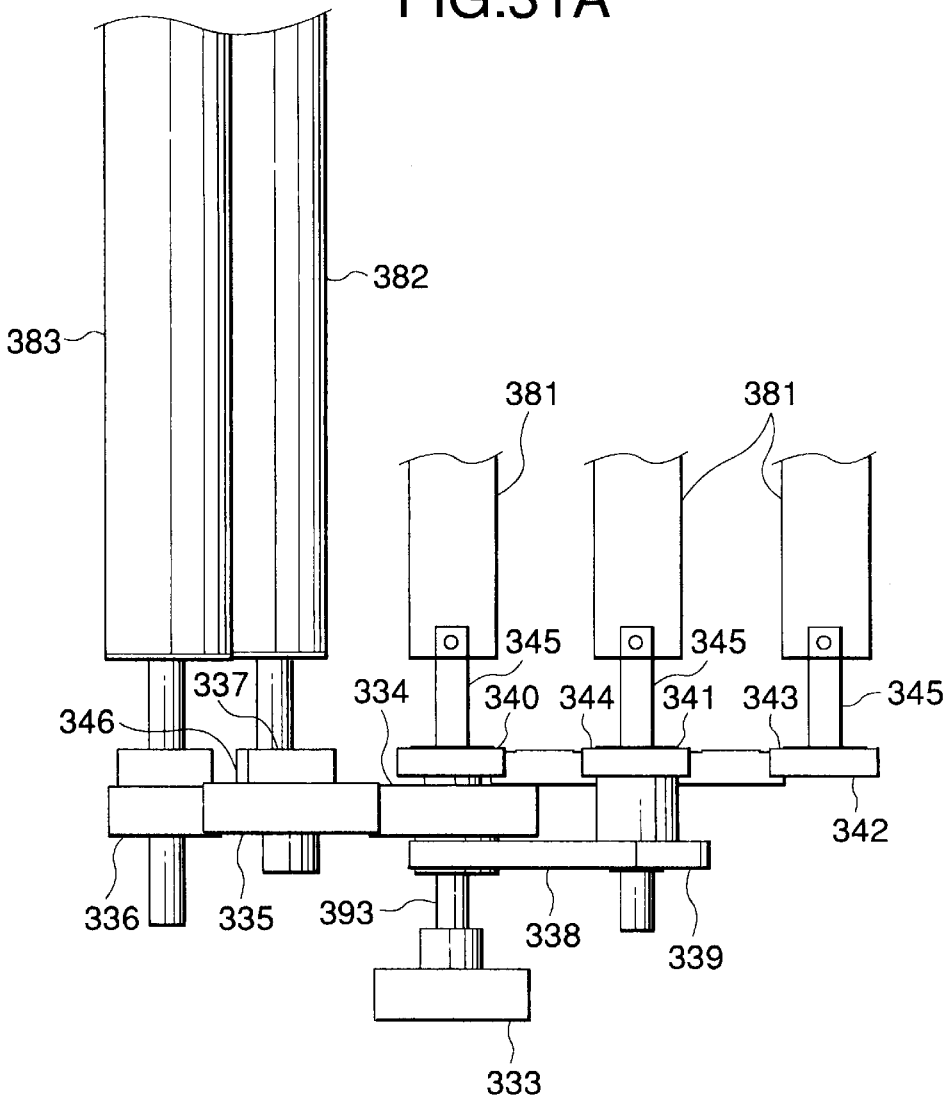
FIGS. 31A and 31B are drawings showing an arrangement of a gear train of a developing unit driving system of the cyan developing unit of the image forming apparatus.
Figure 31B:
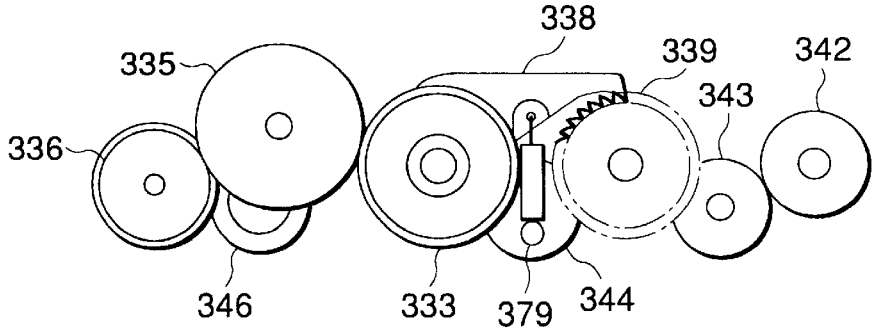

FIGS. 31A and 31B are drawings showing an arrangement of a gear train of a developing unit driving system of the cyan developing unit of the image forming apparatus. FIG. 31A is a projected plan view of the developing unit and FIG. 31B is a projected view from the side of the developing unit. The arrangement and operation of the gear train of the developing unit driving system will be explained with reference to FIGS. 31A and 31B.

Here, the developing unit driving system means a system for driving the developing roller 383, the supplying roller 382 and the agitators 381 shown in FIGS. 28 and 29.

In FIGS. 31A and 31B, the power of the developing unit driving system is input to the input gear 333 at first. The power input to the input gear 333 is transmitted through a shaft 393, a transmission gear 334, a transmission gear 345, and a developing roller gear 336 to drive the developing roller 383. The force for driving the supplying roller 382 is also input to the input gear 333 and is transmitted through the shaft 393, the transmission gear 334, the transmission gear 335, a transmission gear 337 and a supplying roller gear 346 to drive the supplying roller 382. The developing roller 383 and the supplying roller 382 abut each other in the same direction of rotation as described above to supply toner to the developing roller 383 while frictionally charging it.

The force for driving the agitators 381 is also input to the input gear 333 and is transmitted to an agitator gear 341 through the shaft 393, an eccentric cam (not shown) formed at the peripheral portion thereof, a rachet arm 338 and a rachet gear 339. The force is transmitted also to agitator gears 340 and 342 at the same speed via idler gears 343 and 344. Accordingly, agitator shafts 345 turn at the same speed and rotate the agitators 381 set at the edges thereof to convey toners. Here, the force is transmitted from the rachet arm 338 to the rachet gear 339 such that when the shaft 393 makes a turn, the eccentric cam (not shown) formed at the peripheral portion thereof causes the rachet arm 338 to be eccentrically driven around the shaft 393, thus driving the rachet gear 339 per tooth. This deceleration mechanism allows the agitator's toner agitating speed to be reduced and to suppress the toner from deteriorating or decomposing.

Figure 32A:
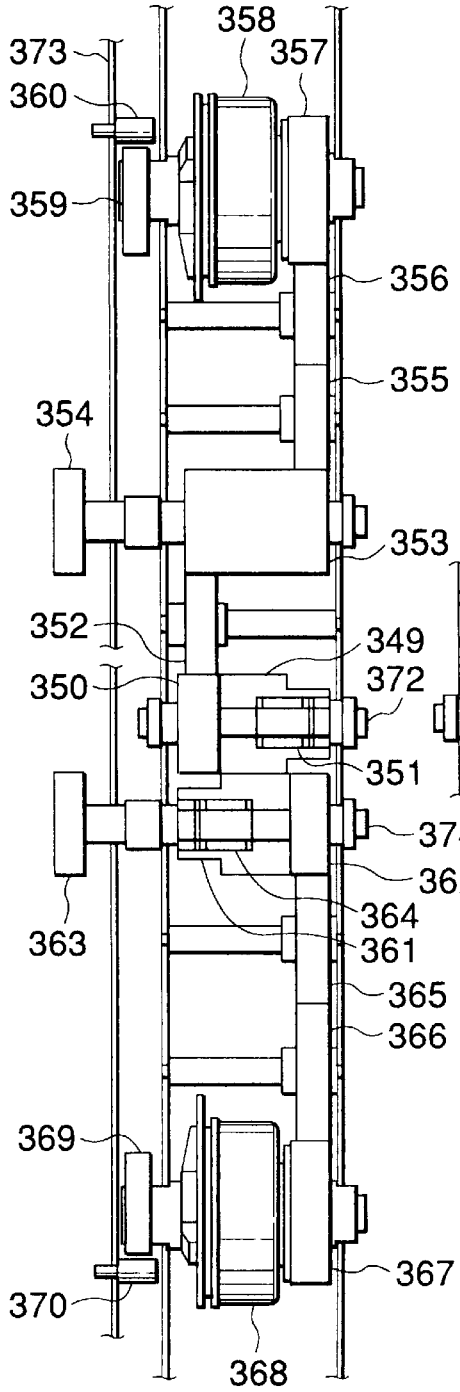
FIGS. 32A through 32C are schematic drawings showing a separating/contacting driving mechanism of the cyan developing unit and black developing unit of the image forming apparatus.
Figure 32B:
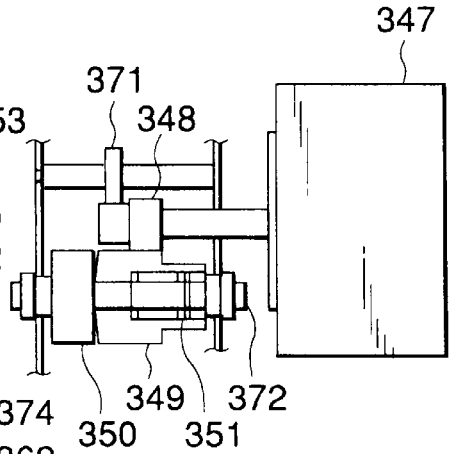
Figure 32C:
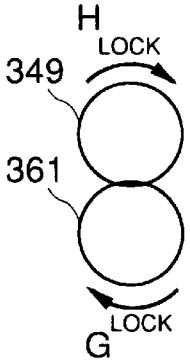

FIGS. 32A through 32C are schematic drawings showing a separating/contacting drive mechanism of the cyan developing unit and black developing unit of the image forming apparatus. It is noted that gears are arranged in a developed form in order to explain engagements of respective components.

The arrangement of the gear train of the driving system for separating/contacting the developing unit will be explained with reference to FIGS. 32A to 32C. Here, the driving system for separating/contacting the developing units means a driving system for moving the developing unit to the developing position where the developing unit is approached to the electrostatic latent image carrier or to the standby position where it is separated from the latent image carrier. A method for driving an arbitrary developing unit by turning the driving motor forward or backward will be also explained.

FIG. 32A is a developed view of the gear train of the developing unit separating/contacting driving system, FIG. 32B is a developed view in which only the driving motor and initial gears of the developing unit separating/contacting driving system are excerpted and FIG. 32C is a drawing showing directions in which one-way clutch is locked. Although a hybrid type stepping motor is used for a driving motor 347 of the developing unit separating/contacting driving system in the present embodiment, another driving source may be used so long as it can drive in forward and backward directions.

The developing unit separating/contacting driving system is driven as follows. That is, when the driving motor 347 rotates, its driving force is transmitted to a rotation transmitting unit 358 via a pinion gear 348, a transmission gear 349, a one-way clutch 351, a shaft 372, a transmission gear 350, a transmission gear 352, a transmission gear 353, a transmission gear 355, a transmission gear 356 and a rotation transmitting unit gear 357.

When a pulse signal is input to the rotation transmitting unit 358, it turns by a predetermined partial angle. Accordingly, when the pulse signal is input to the rotation transmitting unit 358, the cam 359 turns by a first partial angle and when the pulse signal is input again, it turns by a second partial angle. The rotation transmitting unit of the present embodiment is arranged such that the cam turns per 120° and 240° from the initial position every time when the pulse signal is input. Here, because the cam is designed such that its radius of action is maximized at the initial position, it pushes down the cam pin provided on the developing unit. Because the developing unit has the rocking fulcrum as described above, the developing unit rocks centering on the rocking fulcrum and along that, the developing unit is moved to the developing position where it approaches to the photoreceptor. Further, because the cam is designed such that its radius of action is minimized when it turns by 120° from the initial position, it does not push down the cam pin provided on the developing unit. Therefore, the developing unit can move to the standby position where it is separated from the photoreceptor.

The driving force of the driving motor 347 is also transmitted to the input gear 333 of the developing unit driving system described above with reference to FIG. 31A and 31B via the pinion gear 348, the transmission gear 349, the one-way clutch 351, the shaft 372, the transmission gear 350, the transmission gear 352, the transmission gear 353 and the developing unit driving gear 354 to drive the developing roller 383, the supplying roller 382 and the agitators 381, respectively.

Next, the method for driving an arbitrary developing unit by turning the driving motor 347 forward/backward will be explained with reference to FIGS. 32A to 32C.

As shown in FIG. 32C, the one-way clutch 351 is arranged such that it is locked when the transmission gear 349 turns in the direction of an arrow H. It is released and does not transmit torque when the transmission gear 349 turns in the opposite direction from the arrow H. Further, a one-way clutch 364 is arranged such that it is locked when a transmission gear 361 turns in the direction of an arrow G. It is released and does not transmit torque when the transmission gear 361 turns in the opposite direction from the arrow G. The transmission gear 350 and the shaft 372 as well as the transmission gear 362 and the shaft 374 are arranged such that they turn in a body by a pin or by D-cut works.

In the mechanism constructed as described above, when the transmission gear 349 turns in the direction of the arrow H, the one-way clutch 351 is locked and transmits the power to the shaft 372 and the transmission gear 350. When the transmission gear 349 turns in the opposite direction from the arrow H, however, the one-way clutch 351 is released and no power is transmitted to the shaft 372 and the transmission gear 350. Because the transmission gear 349 and the transmission gear 361 are engaged and always turn in the opposite direction from each other, when the transmission gear 349 turns in the direction of the arrow H and the one-way clutch 351 is locked, the transmission gear 361 always turns in the opposite direction from the arrow G, the one-way clutch 364 is released and no power is transmitted to the shaft 374 and the transmission gear 362.

When the transmission gear 349 turns in the opposite direction from the arrow H, it transmits no power to the shaft 372 and the transmission gear 350, but the transmission gear 361 transmits the power to the shaft 374 and the transmission gear 362 because it turns in the direction of the arrow G.

Accordingly, when the driving motor 347 turns in the CCW direction (seeing from the direction of a motor shaft), the power is transmitted to the pinion gear 348, the transmission gear 349, the one-way clutch 351, the shaft 372, the transmission gear 350 and the transmission gear 352 to drive the cam 359 as well as the developing unit driving gear 354 for passing the output to the developing unit driving system in the end.

When the driving motor 347 turns in the CW direction (seeing from the direction of the motor shaft) in contrary, the driving force is transmitted through the pinion gear 348, the transmission gear 349, the transmission gear 361, the one-way clutch 364 and the shaft 374 to drive the cam 369 as well as the developing unit drive gear 363 for transmitting the power to the developing unit driving system in the end.

The above-mentioned arrangement allows the driving force of the two developing units to be selectively obtained just by switching the direction of rotation of the driving motor 347 in the forward and backward directions and allows the equipment to be structured with less power source.

Figure 33:
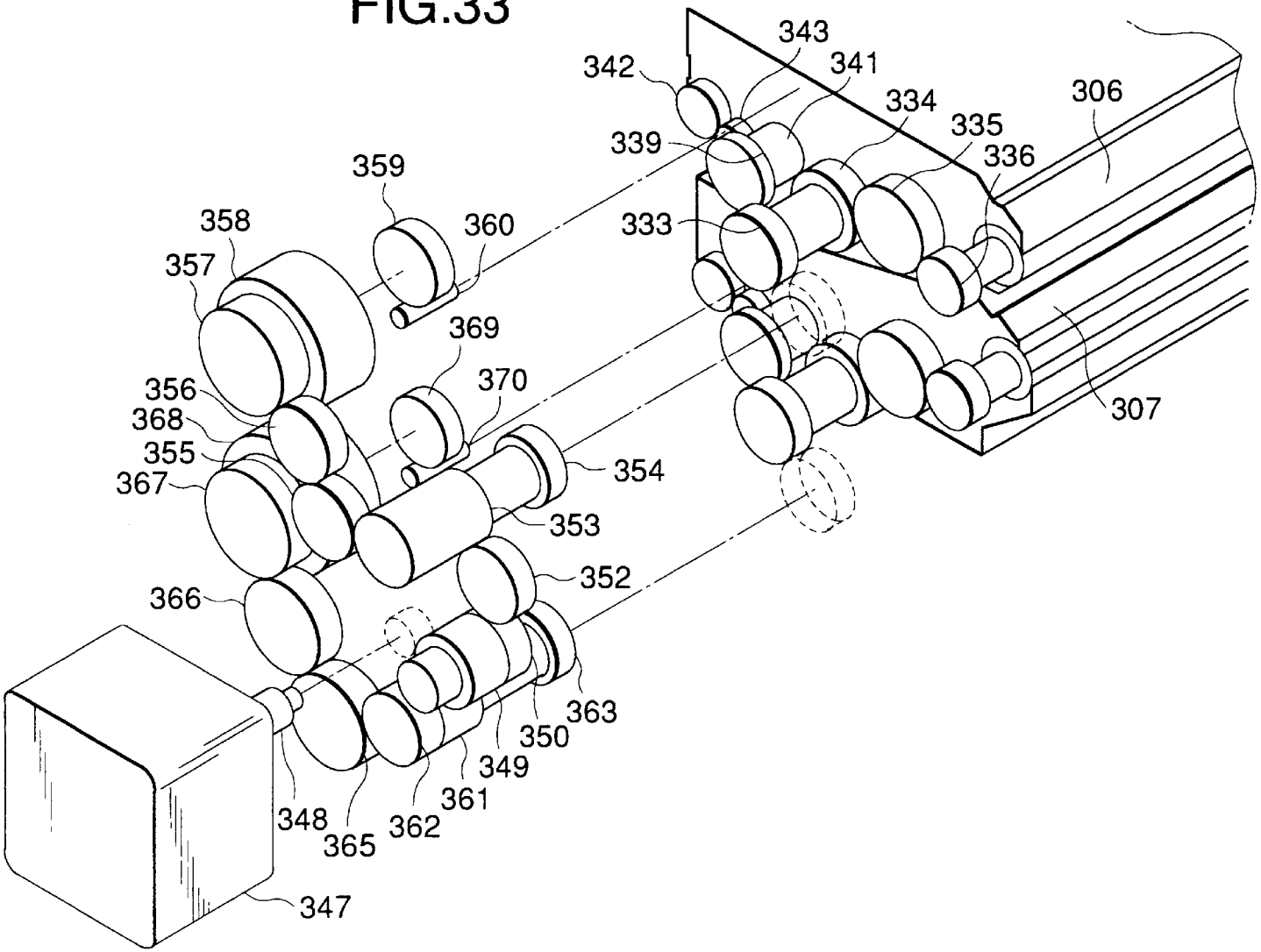
FIG. 33 is a perspective view showing a developing unit driving system and a developing unit separating/contacting driving system of the cyan developing unit and black developing unit.

FIG. 33 is a perspective view showing a developing unit driving system and a developing unit separating/contacting driving system of the cyan developing unit and black developing unit. It is noted that respective components are distributed in the axial direction in order to explain engagements thereof.

The whole structure and operation of the developing unit driving system and the developing unit separating/contacting driving system described above will be explained with reference to FIG. 33.

FIG. 33 shows the cyan developing unit 306, the black developing unit 307, the driving motor 347 for driving the both developing units and two, i.e. a plurality of, gear trains of the rotation transmitting units 358 and 368.

As described before, when the driving motor 347 turns in one direction, the driving force is transmitted to one developing unit, thus driving the developing roller, the supplying roller and the agitators thereof. When the driving motor 347 turns in the opposite direction, on the other hand, the driving force is transmitted to the other developing unit, thus driving, similarly, the developing roller, the supplying roller and the agitators thereof.

The mechanism for separating/contacting the developing unit will now be explained. Both the cyan developing unit 6 and the black developing unit 7 are pivotally supported by the rocking fulcrums (not shown in FIG. 33) explained with reference to FIG. 30. The cyan developing unit 306 is provided with the cam pin 360 and the black developing unit 307 is provided with a cam pin 370. The cyan developing unit 306 and the black developing unit 307 move to the developing position where they approach to the photoreceptor or to the standby position where they separate from the photoreceptor when the cam 359 turns and presses down the cam pin 360 and when the cam 369 turns and presses down the cam pin 370, respectively.

The arrangement described above allows the two driving unit driving systems and the two developing unit separating/contacting driving systems to be driven selectively by one driving source and the image forming apparatus having the simple structure to be provided will less power source.

Figure 34A:
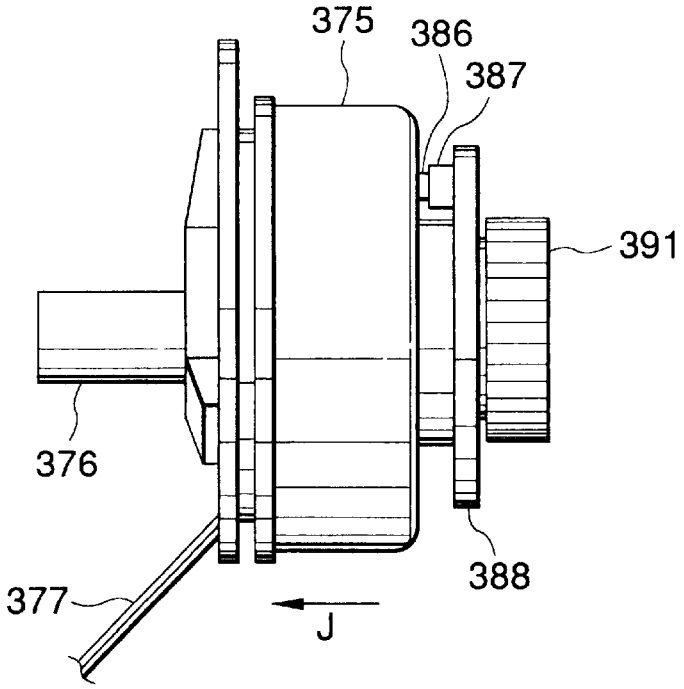
FIGS. 34A and 34B are drawings for explaining a structure of a rotation transmitting unit.
Figure 34B:
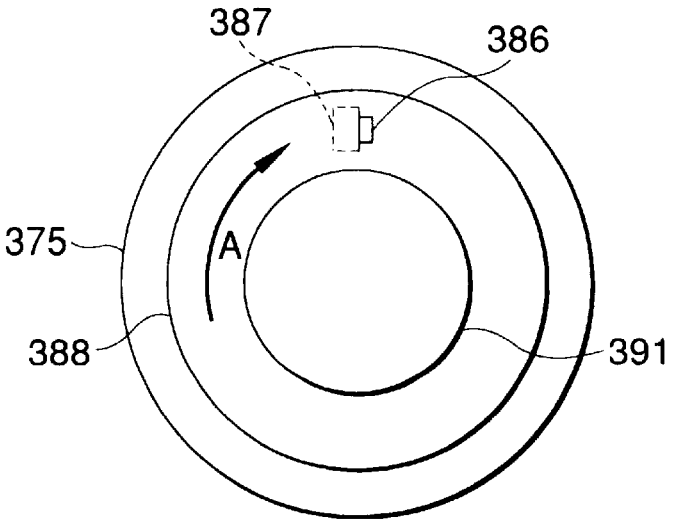
Figure 35:
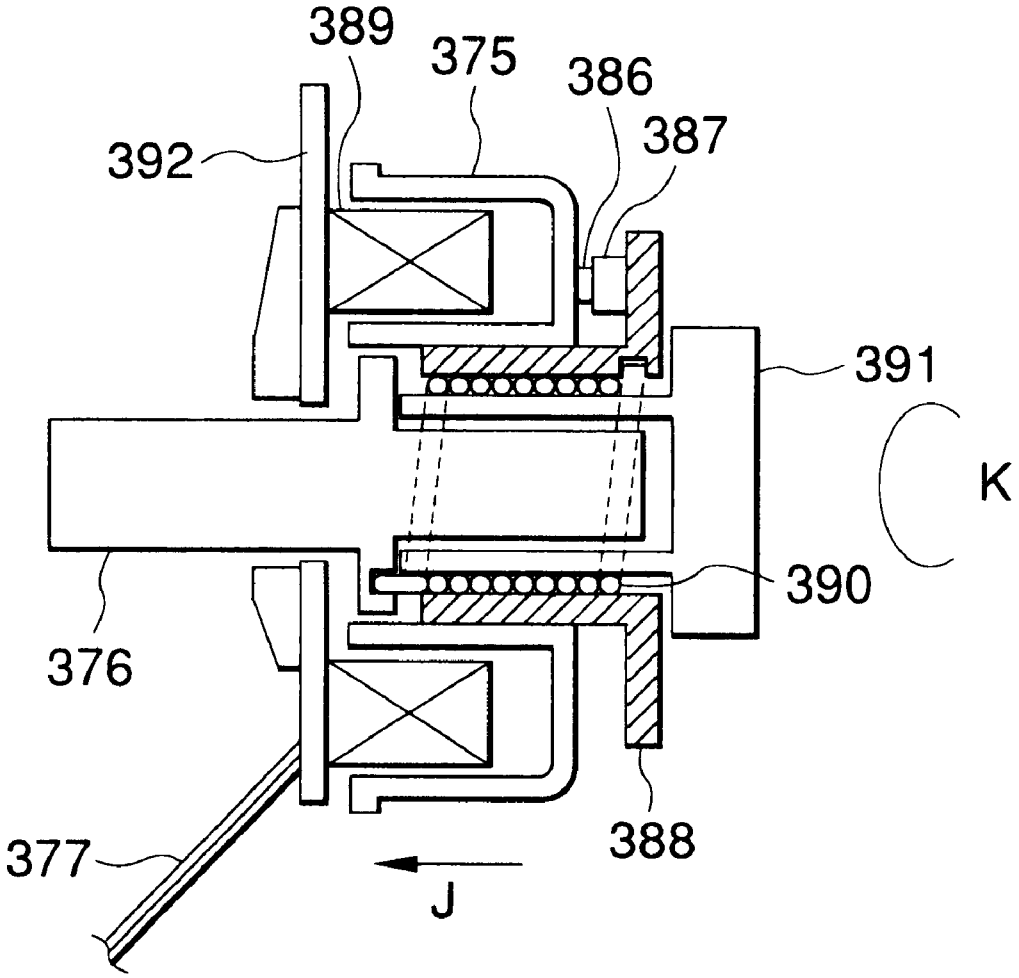
FIG. 35 is a section view of the rotation transmitting unit.
Figure 36:
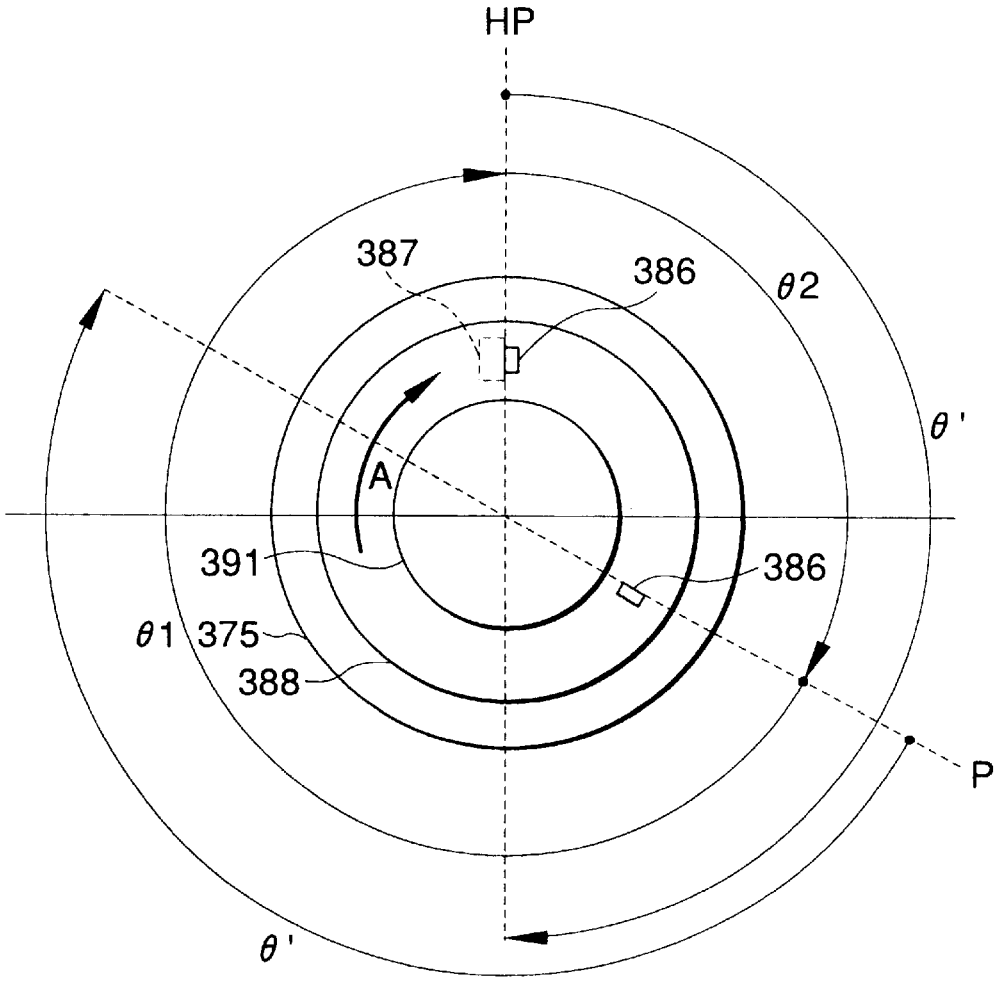
FIG. 36 is a diagram for explaining operating angles of the rotation transmitting unit.

FIGS. 34A and 34B are drawings for explaining a structure of the rotation transmitting unit, FIG. 35 is a section view of the rotation transmitting unit and FIG. 36 is a diagram for explaining operating angles of the rotation transmitting unit.

The arrangement and operation of the rotation transmitting unit and an initializing operation of the developing unit separating/contacting driving system will be explained in detail with reference to FIGS. 34A, 34B, 35 and 36.

At first, the arrangement and operation of the rotation transmitting unit will be explained in detail with reference to FIGS. 34A, 34B and 35. The rotation transmitting unit is transmitting means for intermittently transmitting turning force from the driving source to a member to be driven. FIG. 34A is a side view of the rotation transmitting unit and FIG. 34B is a front view of the rotation transmitting unit seen from the direction of axis thereof. FIG. 35 is a section view of the rotation transmitting unit.

The structure of the rotation transmitting unit will be explained at first. In FIG. 35, the rotation transmitting unit comprises an input member 391, a rotation transmitting unit output shaft 376, a pulse signal input section 377, a movable member 375, a rotary member 388, a coil 389, a spring member 390 and a base 392. The movable member 375 is also provided with a fixed claw 386 and the rotary member 388 is provided with a rotary claw 387.

The input member 391 is a member to which power from the driving source such as a motor is input and is composed of a hollow shaft and a gear formed at the outer periphery thereof in a body in the present embodiment.

The hollow shaft portion of the input member 391 is wound by the spring member 390 such that it tightens the hollow shaft portion from the outside.

One end of the spring member 390 is fitted into a groove not shown created in the rotary member 388 and the other end thereof is fitted into a groove not shown created in the rotation transmitting unit output shaft 376. The rotation transmitting unit output shaft 376 is a shaft which outputs the power from the driving source to the member to be driven and is inserted to the hollow section of the hollow shaft portion described above. In the present embodiment, the cam not shown is created at the edge of the output shaft.

The rotary member 388 is axially supported by the movable member 375 and turns while sliding within the inner face of the movable member 375. The input member 391 is axially supported by the rotary member 388 via the spring member 390 and turns slidably therein. The rotation transmitting unit output shaft 376 is inserted to the hollow shaft portion of the input member 391 as described above and turns also slidably therein.

The coil 389 wound in the axial direction is provided on the base 392 and the movable member 375 is provided around the coil 389 so as to cover the coil.

The movable member 375 is constructed so as to movable in the axial direction and is urged in the opposite direction from an arrow J within the figure by a leaf spring not shown in a normal state. When current flows through the coil 389, a magnetic field is generated, creating a magnetic circuit among the movable member 375 and the base 392. Then, the movable member 375 moves in the direction of the arrow J within the figure. When the current flowing through the coil 389 is shut off, the magnetic field is extinguished and the movable member 375 returns to the original position by the leaf spring not shown.

Next, the operating principle of the rotation transmitting unit will be explained also with reference to FIGS. 34A to 35.

When the power from the driving source is input to the input member 391 and the input member 391 turns in the direction of K within the figure seeing from the axial direction, the spring member 390 wound around the hollow shaft of the input member 391 also turns in synchronism with it because the spring member 390 is wound around the shaft so as to tighten it as described above. Accordingly, the rotary member 388 and the rotation transmitting unit output shaft 376 which engage with the spring member 390 via the grooves also turn in synchronism with the input member 391. Therefore, the driving force input to the input member 391 is transmitted to the rotation transmitting unit output shaft 376, putting the driving source and the member to be driven into a connected state.

Here, the rotary member 388 is provided with the rotary claw 387 and the movable member 375 is provided with the fixed claw 386 as described above. When the rotary member 388 turns in synchronism with the input member 391 as described above, the position of the rotary claw 387 turns and moves in the direction of an arrow A in the figure as shown in FIG. 34B and abuts with the fixed claw 386. Thereby, the turn of the rotary member 388 is hampered and is stopped.

Then, because the input member 391 continues to turn further even through the rotary member 388 stops turning, the edge of the spring member 390 on the side fitted with the rotary member 388 receives force in the opposite direction from the arrow K in the figure. Thereby, the spring member 390 which has been tightening the shaft section of the input member 391 and which has been turning in synchronism with the input member 391 has its tightening force weaken and stops turning. Thereby, the rotation transmitting unit output shaft 376 which engages with the spring member 390 via the groove also stops turning. Then, the driving force input to the input member 391 is not transmitted to the rotation transmitting unit output shaft 376 and the driving source and the member to be driven are put into a shut-off state.

Next, the principle for connecting the driving source and the member to be driven again will be explained.

As described above, the movable member 375 is provided with the fixed claw 386 and is arranged so as to be movable in the axial direction. It is urged in the opposite direction from the arrow J in the figure by the leaf spring not shown in the normal state. In this state, the fixed claw 386 is positioned where it abuts with the rotary claw 387 and hampers the rotary member 388 from turning.

When current flows through the coil 389, the magnetic field is generated and the magnetic circuit is created with the base 392 as described above, the movable member 375 moves in the direction of the arrow J in the figure. Along that, the fixed claw 386 also moves in the direction of the arrow J in the figure and the rotary claw 387 which has abutted with the fixed claw 386 is released from the abutment. Then, the rotary member 388 starts to turn again. Thereby, because the spring member 390 tightens the hollow shaft section of the input member 391, the input member 391 and the spring member 390 turn again in synchronism. Along that, the rotary member 388 and the rotation transmitting unit output shaft 376 which engage with the spring member 390 via the grooves also turn in synchronism with the input member 391. Therefore, the driving force input to the input member 391 is transmitted to the rotation transmitting unit output shaft 376, putting the driving source and the member to be driven into the connected state again.

When the current flowing through the coil 389 is shut off, the movable member 375 is urged again in the opposite direction from the arrow J in the figure by the leaf spring not shown.

The turning rotary plate 388 continues to turn until when the rotary claw 387 abuts with the fixed claw 386 again. Because the fixed claw 386 is provided only at one spot while the rotary claw 387 makes one turn in the example shown in FIGS. 34A to 34B, the rotary claw 387 abuts with the fixed claw 386 again when the rotary member 388 makes one turn. Therefore, the turning force input to the input member 391 is transmitted to the rotation transmitting unit output shaft 376 only by one turn.

The operation of the rotation transmitting unit described above may be summarized as follows. That is, when the input member 391 is turning by receiving rotational power from the driving source, one turn of the rotational power is transmitted from the input member 391 to the rotation transmitting unit output shaft 376 by flowing current through the coil 389 with a certain pulse width, i.e. every time when the pulse is input to the pulse signal input section.

Although the case in which the fixed claw 386 is created at one spot in the circumferential direction has been used in the explanation of the structure so far, a case of connecting and cutting the rotational power from the input member 391 to the rotation transmitting unit output shaft 376 by providing the fixing claws 386 at two spots in the circumferential direction to divide the turn into two parts will be shown in the present embodiment hereinbelow.

In the present embodiment, one turn of the rotation transmitting unit of 360° is divided into a second partial angle $\theta_2$ and a first partial angle $\theta_1$ as shown in FIG. 36. In particular, the second partial angle $\theta_2$ is set at 120° and the first partial angle $\theta_1$ is set at 240° from a stop position P in the present embodiment. That is, the fixed claws 386 are provided at two spots in the path where the rotary claw 387 makes one turn. Firstly, the fixed claw 386 is provided so that the rotary claw 387 stops at the position HP and secondly, the fixed claw 386 is provided so that the rotary claw 387 stops at the position P.

Accordingly, in the case of the present embodiment, when the rotary claw 387 is stopped by the fixed claw 86 at the stop position HP, the rotary claw 387 is released and the rotary member 88 turns the angle of 120° till the next fixed claw 386, i.e. the stop position P, when a signal having a predetermined pulse width $\Delta t_1$ is input to the pulse input section. Accordingly, because the input member 391 is connected with the rotation transmitting unit output shaft 376 while the rotary member 388 turns as described above, the rotation transmitting unit output shaft 376 also turns only by 120° and stops.

When the signal of the predetermined pulse width $\Delta t_1$ is input again to the pulse signal input section, the rotary claw 387 is released again and the rotary member 388 turns until the next fixing claw, i.e. until the stop position HP, by the angle of 240°. Accordingly, because the input member 391 is similarly connected with the rotation transmitting unit output shaft 376 while the rotary member 388 turns, the rotation transmitting unit output shaft 376 also turns only by 240° and stops.

Here, the pulse width $\Delta t_1$ input to the pulse signal input section 377 will be explained in detail.

The signal of the pulse width $\Delta t_1$ needs to be shorter than a time required to turn the predetermined partial angle and to be fully longer than a sum of a time during which the moving member moves in the axial direction due to the excitation caused by the pulse input and a time during which the rotating claw turns and surpasses the fixing claw.

The pulse width will be explained more concretely. In the present embodiment, when a number of rotations of the input member is 20 (rotations/min.), the input member makes one turn in three seconds. That is, it takes one second for the rotary member 388 to turn from the stop position HP to the stop position P.

If the pulse width $\Delta t_1$ is that of 0.5 seconds, a time which the fixed claw 386 takes in moving in the axial direction is also 0.5 seconds and during which the rotary claw 387 turns in the direction A by 60° from the stop position HP. Because the fixed claw 386 returns to the original position when the rotary claw 387 turns by 60° from the stop position HP, the rotary claw 387 abuts with the fixed claw 386 surely at the next stop position P. Thereby, the rotation transmitting unit output shaft 376 surely turns by 120°.

However, when the pulse width $\Delta t_1$ is that of 1.5 seconds, a time which the fixed claw 386 takes in moving in the axial direction is also 1.5 seconds and during which the rotary claw 387 turns in the direction A by 180° from the stop position HP. Because the fixed claw 386 returns to the original position in the axial direction when the rotary claw 387 turns by 180° from the stop position HP, the rotary claw 387 abuts with the fixed claw 386 after turning to the stop position HP, jumping the next stop position P. Accordingly, the rotation transmitting unit output shaft 376 turns by 360° and cannot turn only by 120°.

When the pulse width $\Delta t_1$ is that of 0.01 second, a time which the fixed claw 386 takes in moving in the axial direction is also 0.01 second and during which the rotary claw 387 turns in the direction A only by 1.2° from the stop position HP. Further, because the moving member also takes time in moving in the axial direction, there is a possibility that the rotary claw 387 cannot surpass the fixed claw 386 at the stop position HP. Therefore, there is a possibility that the rotation transmitting unit output shaft 376 cannot be turned only by 120°.

Due to the reason described above and because the second partial angle $\theta_2$ is 120°, the signal of the pulse width $\Delta t_1$ needs to be shorter than the time required in turning by 120° and to be fully longer for the clutch to operate due to the excitation caused by the pulse input. That is, because it is preferable for the fixed claw 386 to return to the original position in the axial direction at the intermediate point between the stop position HP and the stop position P, the signal of the pulse width $\Delta t_1$ of the present embodiment is preferable to be around 0.5 seconds.

However, the case described above is the case in which the number of rotations of the input member is assumed to be 20 (rotations/min.) and it is needless to say that the signal width of the adequate pulse width $\Delta t_1$ may differ when the number of revolutions of the input member differs.

Because the above-mentioned operation allows the position of the cam to be specified without providing a position sensor specifically for detecting the position of the cam, the standby position where the developing unit is separated from the photoreceptor and the developing position where the developing unit is approached to the photoreceptor may be specified by the developing unit separating/contacting driving system.

Further, the initializing operation of the developing unit separating/contacting mechanism of the present embodiment will be explained. Generally, each mechanism composing the image forming apparatus is not necessarily stopped at a predetermined position before the power source is turned on. Then, the initializing operation needs to be implemented in order to let the developing unit separating/contacting mechanism stop at the predetermined position. In concrete, it is necessary to implement the initializing operation so that the developing unit is positioned at the standby position where the developing unit is separated from the photoreceptor.

In the present embodiment, it is necessary to stop the cam at the stop position HP shown in FIG. 36 in the rotation transmitting unit in order to put the developing unit at the standby position. Here, the method for setting the cam at the stop position HP by the initializing operation will be explained with reference to FIG. 36.

As described above, each mechanism composing the image forming apparatus is not necessarily stopped at the predetermined position. Then, when the power source of the image forming apparatus is turned on and the driving motor turns, the rotary claw 387 of the rotation transmitting unit turns to the position where it abuts with the fixed claw 386 as described above, so that the rotary claw 387 also stops at either the stop position HP or the stop position P. Then, the rotation transmitting unit output shaft 376 also stops at a position corresponding to the stop position HP or the stop position P.

Here, a signal pulse $\Delta t_2$ which corresponds to a time required for the rotation transmitting unit to turn by an angle $\theta_1$ which is larger than the second partial angle $\theta_2$ and smaller than the first partial angle $\theta_1$ is input once. In the present embodiment, it may be an angle larger than 120° and smaller than 240°. Then, a case when the pulse signal $\Delta t_2$ which corresponds to a time required for the input member to turn by 180° is input will be shown.

The output shaft of the rotation transmitting unit may be always stopped at the position corresponding to the stop position HP by inputting the pulse as described above. The pulse width will be explained by using a more concrete example. When the number of revolutions of the input member is assumed to be 20 (rotations/min.) in the present embodiment, the input member turns once in three seconds. That is, the length of the pulse signal $\Delta t_2$ which corresponds to a time required for the input member to turn by 180° is 1.5 seconds.

That is, when the pulse signal $\Delta t_2$ having the length of 1.5 seconds is input to the pulse input section when the rotary claw 387 abuts with the fixed claw 386 at the stop position HP in the initial state, a time which takes for the fixed claw 386 to move in the axial direction is also 1.5 seconds and during that time, the rotary claw 387 turns in the direction A by 180° from the stop position HP. Because the fixed claw 386 returns to the original position at the position where the rotary claw 387 turns by 180° from the stop position HP, the rotary claw 387 abuts with the fixed claw 386 at the stop position HP. Thereby, the rotation transmitting unit output shaft 376 also stops at the position corresponding to the stop position HP, so that the initializing operation is completed.

Further, when the pulse signal $\Delta t_2$ having the length of 1.5 seconds is input to the pulse input section when the rotary claw 387 abuts with the fixed claw 386 at the stop position P in the initial state, a time which takes for the fixed claw 386 to move in the axial direction is also 1.5 seconds and during that time, the rotary claw 387 turns in the direction A by 180° from the stop position P. Because the fixed claw 386 returns to the original position at the position where the rotary claw 387 turns by 180° from the stop position HP, the rotary claw 387 abuts with the fixed claw 386 at the stop position HP. Thereby, the rotation transmitting unit output shaft 376 also stops at the position corresponding to the stop position HP, so that the initializing operation is completed.

However, the case described above applies to the case when the number of rotations of the input member is assumed to be 20 (rotations/min.) and it is needless to say that the adequate signal width $\Delta t_2$ is different when the number of rotations of the input member is different.

Further, the case in which the pulse signal $\Delta t_2$ corresponding to the rotation of the input member of 180° is input has been described in the present embodiment, it is the most desirable angle because it is an angle in-between 120° and 240°. It is because, even if the initial state is either at the stop position HP or the stop position P, it is the position where there is a least probability that the fixed claw 386 interferes with the rotary claw 387 in returning to the original position after moving in the axial direction.

The arrangement described above allows the position of the cam to be specified initially without providing the position sensor or the like specifically to detect the position of the cam and the developing unit separating/contacting position to be specified when the power source is turned on. Further, it allows the position of the cam to be specified by inputting the predetermined pulse and the inexpensive and simple image forming apparatus to be constructed.

Further, although the rotation transmitting unit has been explained so far exemplifying the case in which 360° of one turn of the rotation transmitting unit is divided into the first partial angle $\theta_1$ (240°) and the second partial angle $\theta_2$ (120°) it is possible to obtain totally the same operation even if the angle is divided into three or more partial angles.

That is, in the rotation transmitting unit comprising the input shaft for obtaining turning force from the driving source, the output shaft for transmitting the turning force to the member to be driven, transmitting means interposed between the input shaft and the output shaft for transmitting the turning force intermittently from the driving source to the member to be driven and the control means for controlling the transmitting means, the rotation transmitting unit can be stopped sequentially at each partial stop position from the initial position, i.e. the origin, by arranging such that one turn of the transmitting means is divided into n parts ($\theta_n$, $\theta_{n-1}$, . . . , $\theta_2$, $\theta_1$) and the turning force is transmitted from the input shaft to the output shaft sequentially by each partial angle as pulse is input by the control means; such that the partial angle is represented by the following relational equation;

$$\sum_{1}^{n} \theta i = 360° \tag{26}$$

and such that the control means is capable of outputting the pulse at any timing and outputs a signal having a pulse width corresponding to an angle of revolution $\alpha$ of the input member represented by a relational equation of $\alpha<\theta_{min}$ (where, $\theta_{min}$ is a minimum partial angle among each partial angle of $\theta_1$ to $\theta_n$).

Further, the rotation transmitting unit can be stopped at the stop position, i.e. the origin, in initializing it and totally the same operation can be obtained if it is arranged such that the partial angle of the transmitting means is represented by a relational equation of $180°<\theta_1<360°$ and the control means outputs a signal having a pulse width corresponding to an angle of turn $\beta$ of the input member represented by the following relational equation:

$$\sum_{2}^{n} \theta i < \beta < \theta_1 \tag{27}$$

The present embodiment described above has exemplified the case when the number of parts=2.

The arrangement described above allows the position of the cam to be specified initially without providing the position sensor or the like specifically to detect the position of the cam. Further, it allows the position of the cam to be specified by inputting the predetermined pulse.

Figure 37:
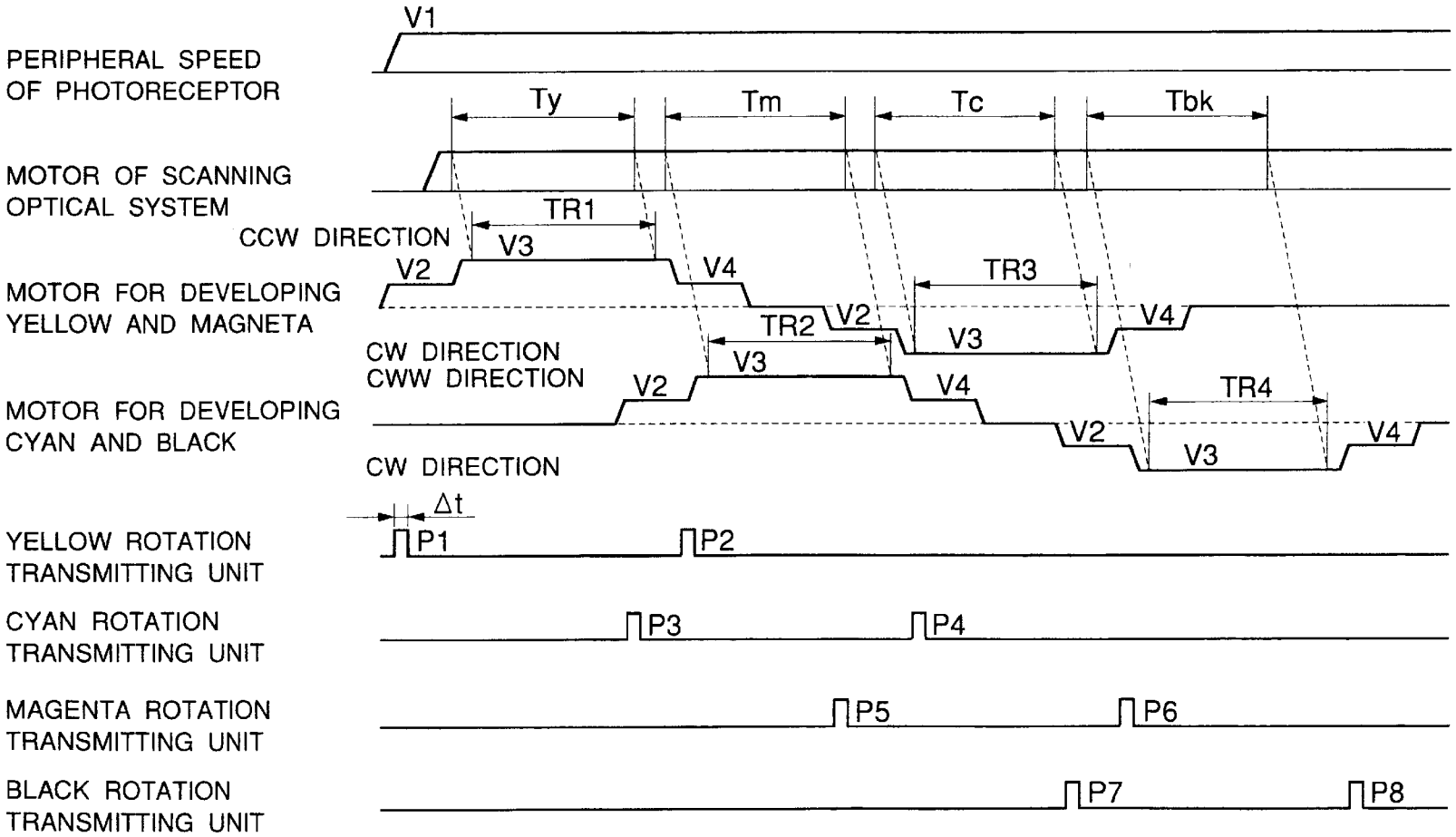
FIG. 37 is a timing chart showing modes for controlling a peripheral speed of a photoreceptor, a motor of an exposure scanning optical system, driving motors of developing unit driving system and developing unit separating/contacting driving system and the rotation transmitting units of the developing unit separating/contacting driving system.

FIG. 37 is a timing chart showing modes for controlling a peripheral speed of the photoreceptor, a motor of the exposure scanning optical system, driving motors of the developing unit driving systems and the developing unit separating/contacting driving systems and the rotation transmitting unit of the developing unit separating/contacting driving system. The control modes for driving the image forming apparatus in the present embodiment will be explained in detail with reference to FIG. 37.

In FIG. 37, when the photoreceptor 301 starts to rotate and its peripheral speed reaches to a predetermined peripheral speed of V1, the laser scanning optical system starts its turning operation. Then, when the scanning optical system reaches to a predetermined rotational speed, an yellow latent image is written on the photoreceptor 301 during time Ty. Next, the motor for driving the yellow and magenta developing units starts to slow-up in the CCW direction and increases the speed up to speed V2 for driving the separating/contacting cam. Here, the developing unit separating/contacting cam has been initialized in advance when the power source of the image forming apparatus is turned on and all of the developing units of the yellow developing unit 304, the magenta developing unit 305, the cyan developing unit 306 and the black developing unit 307 are positioned at the standby position where they are separated from the photoreceptor 301.

In the present embodiment, the cam is stopped at the stop position HP shown in FIG. 36 and is pressing down the pin provided on the developing unit. Then, when a pulse signal P1 having a predetermined time $\Delta t$ is input to the rotation transmitting unit for yellow, the cam of the developing unit turns by the second partial angle, i.e. $\theta_2$=120°, so that the yellow developing unit moves to the developing position where it approaches to the photoreceptor. In succession, the motor for driving the yellow and magenta developing unit starts to slow-up from the speed V2 in the same direction and increases the speed of the developing roller to speed V3 by which the development is favorably carried out.

When the speed is increased to the predetermined speed V3, the yellow latent image on the photoreceptor 301 approaches to the developing roller section of the yellow developing unit and the development is carried out in time TR1. When the development is finished in time TR1, the motor for driving the yellow and magenta developing units slows down from the speed V3 to speed V4 for driving the separating/contacting cam. When the speed slows down to the speed V4, a pulse signal P2 having the predetermined time $\Delta t$ is input to the rotation transmitting unit for yellow.

Because the cam of the developing unit turns by the first partial angle, i.e. $\theta_1$=240°, the yellow developing unit moves to the position where it is separated from the photoreceptor. When the yellow developing unit finishes to separate from the photoreceptor, the motor for driving the yellow and magenta developing units slows down from the speed V4 to stop.

The yellow toner image is formed on the photoreceptor through the series of operations described above and the yellow toner image is transferred to the intermediate transfer belt when the photoreceptor abuts with the intermediate transfer belt.

In succession, when the yellow latent image has been written on the photoreceptor, a cyan latent image is written on the photoreceptor 301 during time Tc in the laser scanning optical system. Prior to that, the motor for driving the cyan and black developing units starts to slow-up in the CCW direction and increases the speed up to speed V2 for driving the separating/contacting cam.

Here, a pulse signal P3 having the predetermined time $\Delta t$ is input to the rotation transmitting unit of the cyan developing unit. Thereby, the rotation transmitting unit of the cyan developing unit turns by the second partial angle (120°), so that the cyan developing unit moves to the developing position where it approaches to the photoreceptor. In succession, the motor for driving the cyan and black developing units starts to slow-up from the speed V2 in the same direction and increases the speed of the developing roller to the speed V3 by which the development is favorably carried out. When the speed is increased to the predetermined speed, the cyan latent image on the photoreceptor 301 approaches to the developing roller section of the cyan developing unit and the development is carried out in time TR2. When the development is finished in the time TR2, the motor for driving the cyan and black developing units slows down from the speed V3 to the speed V4 for driving the separating/contacting cam again.

When the speed slows down to the speed V4, a pulse signal P4 having the predetermined time Δt is input to the cyan rotation transmitting unit. Thereby, because the cam of the developing unit turns by the first partial angle, i.e. $\theta_2$=240°, the cyan developing unit moves to the position where it is separated from the photoreceptor. The cyan toner image is formed on the photoreceptor through the series of operations described above and the cyan toner image is transferred to the intermediate transfer belt which abuts with the photoreceptor.

The operation in developing magenta will be explained below. When the cyan latent image has been written on the photoreceptor, a magenta latent image is written on the photoreceptor 301 during time Tm in the laser scanning optical system. Along that, the motor for driving the yellow and magenta developing units, which has been stopped after finishing to develop yellow, starts to slow-up in the CW direction, i.e. in the opposite direction from that in developing yellow, and increases the speed up to speed V2 for driving the separating/contacting cam.

Here, a pulse signal P5 having the predetermined time Δt is input to the rotation transmitting unit of the magenta developing unit. Thereby, the cam of the magenta developing unit turns by the second partial angle, i.e. $\theta_2$=120°, so that the magenta developing unit moves to the developing position where it approaches to the photoreceptor. In succession, the motor for driving the yellow and magenta developing units starts to slow-up from the speed V2 in the same direction and increases the speed of the developing roller to the speed V3 by which the development is favorably carried out. When the speed is increased to the predetermined speed, the magenta latent image on the photoreceptor 301 approaches to the developing roller section of the magenta developing unit and the development is carried out in time TR3. When the development is finished in the time TR3, the motor for driving the yellow and magenta developing units slows down from the speed V3 to the speed V4 for driving the separating/contacting cam. When the speed slows down to the speed V4, a pulse signal P6 having the predetermined time Δt is input to the rotation transmitting unit of the magenta developing unit. Thereby, because the cam of the developing unit turns by the first partial angle, i.e. $\theta_1$=240°, the magenta developing unit moves to the position where it is separated from the photoreceptor. The magenta toner image is developed on the photoreceptor through the series of operations described above and the magenta toner image is transferred to the intermediate transfer belt which abuts with the photoreceptor.

The operation in developing black will be explained below. When the magenta latent image has been written on the photoreceptor, a black latent image is written on the photoreceptor 301 during time Tbk in the laser scanning optical system. Along that, the motor for driving the cyan and black developing units, which has been stopped after finishing to develop cyan, starts to slow-up in the CW direction, i.e. in t he opposite direction from that in developing cyan, and increases the speed up to speed V2 for driving the separating/contacting cam.

Here, a pulse signal P7 having the predetermined time Δt is input to the rotation transmitting unit of the black developing unit. Thereby, the cam of the black developing unit turns by the second partial angle, i.e. θ2=120°, so that the black developing unit moves to the developing position where it approaches to the photoreceptor. In succession, the motor for driving the cyan and black developing units starts to slow-up from the speed V2 in the same direction and increases the speed of the developing roller to the speed V3 by which the development is favorably carried out. When the speed is increased to the predetermined speed, the black latent image on the photoreceptor 301 approaches to the developing roller section of the black developing unit and the development is carried out during time TR4. When the development is finished during the time TR4, the motor for driving the cyan and black developing units slows down from the speed V3 to the speed V4 for driving the separating/contacting cam. When the speed slows down to the speed V4, a pulse signal P8 having the predetermined time Δt is input to the rotation transmitting unit of the black developing unit. Thereby, because the cam of the developing unit turns by the first partial angle $\theta_1$ (240°), the black developing unit moves to the position where it is separated from the photoreceptor. The black toner image is developed on the photoreceptor through the series of operations described above and the black toner image is transferred to the intermediate transfer belt which abuts with the photoreceptor.

The control modes for driving each developing unit shown in FIG. 37 allows the toner image of each color to be formed on the intermediate transfer belt 8 one after another and the full color image to be obtained by transferring them on the recording medium altogether. Further, because the operation for separating/contacting each developing unit may be carried out during when the other developing unit is conducting the development, the interval between the developing time of the plurality of developing units may be shortened and the image forming apparatus capable of outputting at high speed may be provided.

As described above, according to the image forming apparatus of the present invention, the image carrier, the developing means, the recording member storage means and the like can be readily attached/removed from the side of the face of the equipment proper normally used without damaging those components or the equipment proper in attaching/removing them.

Further, according to the image forming apparatus, the arrangement described above allows the image carrier to be attached/removed more simply.

Further, according to the image forming apparatus, the arrangement described above allows the developing means to be readily attached/removed without damaging it.

Further, according to the image forming apparatus, the arrangement described above allows the image carrier, the developing means and the like to be attached/removed more simply.

Further, according to the image forming apparatus, the arrangement described above allows the image carrier, the developing means and the like to be attached/removed simply and a recording member jammed within the equipment proper to be readily removed because the equipment opening for removing the recording member jammed within the equipment proper and the opening for attaching/removing the image carrier, the developing means and the like are disposed on the side of the face of the equipment proper normally used. It also allows the installation area of the equipment proper to be reduced.

Further, according to the image forming apparatus, the arrangement described above allows the installation area of the equipment proper to be reduced further.

Further, according to the image forming apparatus, the arrangement described above allows the recording member jammed within the equipment proper to be removed more simply.

Further, according to the image forming apparatus, the arrangement described above allows the developing means having the lengthy shape in the axial direction of the image carrier to be supported and moved without causing deflection or distortion within the equipment proper.

Further, according to the image forming apparatus, the arrangement described above allows the developing means to be positioned accurately with respect to the image carrier with the simple arrangement.

Further, according to the image forming apparatus, the arrangement described above allows the frame structure for supporting the developing means to be stabilized at the predetermined position with the simple arrangement.

Further, according to the image forming apparatus, the arrangement described above allows to prevent toner from scattering in attaching/removing the developing means.

Further, according to the image forming apparatus, the arrangement described above allows the developing means to be attached/removed to/from the frame structure with the simple arrangement.

Further, according to the image forming apparatus, the arrangement described above allows the developing means to be fixed to the frame structure firmly with the simple arrangement.

Further, according to the image forming apparatus, the arrangement described above allows the installation area of the equipment proper to be reduced further.

As described above, according to the image forming apparatus of the present invention, the arrangement described above allows the inexpensive image forming apparatus having less power sources and the simple structure to be obtained.

Further, according to the image forming apparatus, the arrangement described above allows the image forming apparatus which takes less time in moving the developing unit and which is capable of outputting images at high speed to be obtained.

According to the image forming apparatus of the present invention, the arrangement described above allows the inexpensive image forming apparatus having the simple structure to be obtained.

Further, according to the image forming apparatus, the arrangement described above allows the rotation transmitting unit which requires no position detecting member for detecting rotation stop positions to be obtained.

What is claimed is:

1. An image forming apparatus, comprising:

a rotatable image carrier;

driving means for driving said image carrier;

an image carrier driving member for transmitting a driving force received from said driving means at an image carrier driving position to said image carrier;

latent image forming means for forming a latent image on said image carrier at a latent image forming position;

developing means for developing the latent image on said image carrier to form a developed image;

a transfer member to which the developed image on said image carrier is transferred at a transferred at a transferring position; and transfer member conveying means for receiving driving force from said image carrier driving member at a transfer driving position to convey said transfer member, wherein a time during which said image carrier moves from the latent image forming position to the transferring position is substantially equal to a time during which said image carrier driving member moves from the image carrier driving position to the transfer driving position.

2. The image forming apparatus according to claim 1, wherein $k_T$ is 0.167 or less, where a period of rotation of said image carrier driving member is $T_{11}$, a time difference between the time during which said image carrier moves from the latent image forming position to the transferring position and the time during which said image carrier driving member moves from the image carrier driving position to the transfer driving position is $\Delta T$ and a ratio of $\Delta T$ to $T_{11}$ described above is $k_T$.

3. The image forming apparatus according to claim 1, wherein said image carrier driving member comprises a gear, said driving means has a driving means gear which engages with said image carrier driving member, said transfer member conveying means has a conveying force transmitting gear which engages with said image carrier driving member and said driving means gear and the conveying force transmitting gear are pressed against said image carrier driving member.

4. The image forming apparatus according to claim 1, wherein the image forming apparatus comprises a plurality of said developing units and images on said image carrier are laid and transferred to said transfer member one after another.

5. The image forming apparatus according to claim 4, wherein $k_T$ is 0.064 or less, where a period of rotation of said image carrier driving member is $T_{11}$, a time difference between the time during which said image carrier moves from the latent image forming position to the transferring position and the time during which said image carrier driving member moves from the image carrier driving position to the transfer driving position is $\Delta T$ and a ratio of $\Delta T$ to $T_{11}$ described above is $k_T$.

6. An image forming apparatus, comprising an image carrier;

latent image forming means for forming a latent image on said image carrier;

developing means for developing the latent image on said image carrier by toner;

primary transfer means for transferring the toner images on said image carrier to an intermediate transfer belt one after another;

secondary transfer means for transferring the toner images laid on said intermediate transfer belt to a recording member altogether;

a driving source for driving said image carrier;

first drive transmitting means for transmitting driving force of said driving source to said image carrier to drive said image carrier; and second drive transmitting means for transmitting driving force of said image carrier to said intermediate transfer belt to drive said intermediate transfer belt in synchronism with said image carrier, wherein said second drive transmitting means is disposed on the downstream side of said primary transfer means with respect to the direction in which said intermediate transfer belt is conveyed.

7. The image forming apparatus according to claim 6, wherein a peripheral speed of said intermediate transfer belt is set so as to be faster than a peripheral speed of said image carrier.

8. The image forming apparatus according to claim 6, wherein said primary transfer means is urged toward said image carrier via said intermediate transfer belt.

9. The image forming apparatus according to claim 8, wherein said intermediate transfer belt is stretched approximately in the tangential direction of said image carrier at the primary transfer position where said primary transfer means is disposed.

10. The image forming apparatus according to claim 6, wherein wrinkle preventing means is disposed on the upstream side of said primary transfer means in order to smooth out the wrinkled intermediate transfer belt before it is conveyed to said primary transfer position.

11. The image forming apparatus according to claim 6, wherein said first and second drive transmitting means are gears, a number of teeth of said first drive transmitting means from a latent image forming position on said image carrier to said primary transfer position is an integer, and a number of teeth of said first drive transmitting means from a position where said first drive transmitting means receives driving force from said driving source to a position where said first drive transmitting means transmits the driving force to said second drive transmitting means is an integer.

12. The image forming apparatus according to claim 6, wherein said image carrier is a drum.

13. The image forming apparatus according to claim 6, wherein said first and second drive transmitting means are gears and a pitch diameter of said first drive transmitting means is set so as to be larger than a pitch diameter of said second drive transmitting means.

14. An image forming apparatus, comprising:

an image forming apparatus body;

an image carrier provided in said image forming apparatus body;

latent image forming means for forming a latent image corresponding to each color component on said image carrier;

a plurality of developing means for developing the latent image on said image carrier by toner corresponding to each color component;

an intermediate transfer body;

primary transfer means for transferring the toner images on said image carrier one after another to said intermediate transfer body;

secondary transfer means for transferring the multi-color image formed on said intermediate transfer body altogether to a recording member conveyed from a recording member storage means;

fixing means for fixing said multi-color image to the recording member;

a first recording member conveying path for conveying the recording member in the recording member storage means from said secondary transfer means to said fixing means; and a second recording member conveying path for discharging the recording member conveyed from said fixing means out of said image forming apparatus body; said latent image forming means being disposed on the back side of said image forming apparatus body; and said image carrier, said developing means and the recording member storage means being attachable/removable almost in the same direction at the front side of said image forming apparatus body and said direction being a direction vertical to an axis of said image carrier.

15. The image forming apparatus according to claim 14, wherein said image carrier is a drum-like image carrier.

16. The image forming apparatus according to claim 14, wherein said developing means are disposed at the front side of said image forming apparatus body more than said image carrier.

17. The image forming apparatus according to claim 14, wherein the upper and front faces of said image forming apparatus body are openable covers.

18. The image forming apparatus according to claim 14, wherein said second recording member conveying path conveys the recording member almost in the vertical direction at the front side of said image forming apparatus body and discharges the recording member to the upper face of said image forming apparatus body.

19. The image forming apparatus according to claim 14, wherein said fixing means guides the recording member by changing the conveying direction of the recording member from said first recording member conveying path to said second recording member conveying path.

20. The image forming apparatus according to claim 14, wherein said second recording member conveying path and/or said fixing means moves interlocking with an operation for opening and closing said front cover.

21. The image forming apparatus according to claim 14, further comprising:

supporting means for removably supporting said developing means;

coupling means for coupling said developing means with said supporting means; and moving means for moving said supporting means to move said developing means coupled with said supporting means to a developing position or to a non-developing position.

22. The image forming apparatus according to claim 21, further comprising a frame structure for supporting said plurality of supporting means corresponding to said plurality of developing means, wherein said frame structure is turned and moved to move said developing means fixed to said frame structure via said supporting means to a first position where it is urged to said image carrier and to a second position where it is released from said image carrier.

23. The image forming apparatus according to claim 22, further comprising bi-stabilizing means for stabilizing said frame structure in two stable states at said first position and said second position.

24. The image forming apparatus according to claim 23, wherein said developing means is removable in a state in which said frame structure is opened at said second position and a toner storage section of said developing means assumes a downward position.

25. The image forming apparatus according to claim 21, wherein said coupling means comprising:

a pin, provided either on said developing means or said supporting means, for engaging with the other;

an inserted portion, provided either on said developing means or said supporting means, into which said other pin is inserted; and a cam for urging said pin inserted to said inserted portion in predetermined directions.

26. The image forming apparatus according to claim 25, wherein said predetermined directions are directions of urging the developing means to said image carrier and of urging said developing means to said supporting means.

27. The image forming apparatus according to claim 14, wherein said intermediate transfer body is a intermediate transfer belt and is spanned by a driving roller positioned on the back side of the equipment proper for driving said intermediate transfer belt; a backup roller positioned at the lower face side of the equipment proper and is provided at the position facing to said secondary transfer means; and a tension roller positioned at the front side of the equipment proper for giving tension to said intermediate transfer belt.

28. An image forming apparatus, comprising:

a latent image carrier on which a latent image is formed;

a plurality of developing units for developing the latent image on said latent image carrier;

driving motors for driving said developing units; and a plurality of developing unit moving means for moving respective ones of said developing units to a development position and a standby position by driving said driving motors forward or backward.

29. An image forming apparatus, comprising:

a latent image carrier on which a latent image is formed;

a plurality of developing units for developing the latent image on said latent image carrier;

a plurality of developing unit moving means for moving respective ones of said developing units to a developing position where said developing units are adjacent to said latent image carrier and a standby position where said developing units are separated from said latent image carrier;

driving motors for driving said developing unit moving means; and selective driving means for selectively driving one of said developing unit moving means selected among said plurality of developing unit moving means by driving said driving motor forward or backward.

30. The image forming apparatus according to claim 29, wherein said developing unit moving means comprises:

supporting means for rockably supporting said developing unit;

urging means for rocking and urging said developing unit in a first direction; and a cam mechanism for rocking and moving said developing unit in a second direction.

31. The image forming apparatus according to claim 30, wherein said urging means urges said developing unit in the direction of the developing position and said cam mechanism moves said developing unit in the direction of the standby position.

32. The image forming apparatus according to claim 30, wherein said supporting means is disposed near an engagement point of a gear train for driving said developing unit.

33. The image forming apparatus according to claim 30, comprising four rotation transmitting units, four of said developing units and two of said driving motors, said rotation transmitting units comprising:

an input shaft for obtaining the turning force from the driving source;

an output shaft for transmitting the turning force to the member to be driven;

a transmitter interposed between said input shaft and said output shaft for transmitting the turning force intermittently from the driving source to the member to be driven; and a controller which controls said transmitter wherein said rotation transmitting unit being arranged such that one turn of said transmitter is divided into n parts ($\theta_n$, $\theta_{n-1}$, . . . , $\theta_2$, $\theta_1$) and the turning force is transmitted from said input shaft to said output shaft sequentially by each partial angle as a pulse is input by said controller, said partial angle being represented by the following equation:

$$\sum_{1}^{n} \theta i = 360^\circ$$

said controller being capable of outputting the pulse at any timing and outputting a signal having a pulse width corresponding to an angle of revolution "a" represented by a relational equation of $\alpha<\theta_{min}$ (where, $\theta_{min}$ is a minimum partial angle among each partial angle of $\theta_1$ to $\theta_n$).

34. A rotation transmitting unit for transmitting a turning force from a drive source to a member to be driven, comprising:

an input shaft for obtaining the turning force from the driving source;

an output shaft for transmitting the turning force to the member to be driven;

transmitting means interposed between said input shaft and said output shaft for transmitting the turning force intermittently from the driving source to the member to be driven; and control means for controlling said transmitting means, wherein said rotation transmitting unit being arranged such that one turn of said transmitting means is divided into n parts ($\theta_n$, $\theta_{n-1}$, $\theta_2$, $\theta_1$) and the turning force is transmitted from said input shaft to said output shaft sequentially by each partial angle as pulse is input by said control means, wherein said partial angle being represented by the following relational equation:

$$\sum_{1}^{n} \theta i = 360^\circ$$

said control means being capable of outputting the pulse at any timing and outputting a signal having a pulse width corresponding to an angle of revolution a represented by a relational equation of $\alpha<\theta_{min}$ (where, $\theta_{min}$ is a minimum partial angle among each partial angle of $\theta_1$ to $\theta_n$).

35. The rotation transmitting unit according to claim 34, wherein the partial angle of said transmitting means is represented by a relational equation of $180^\circ<\theta_1<360^\circ$ and said control means outputs a signal having a pulse width corresponding to an angle of rotation $\beta$ represented by the following relational equation:

$$\sum_{2}^{n} \theta i < \beta < \theta_1$$

.

36. The rotation transmitting unit according to claim 35, wherein said cam mechanism is controlled so as to turn or stop when said value of n is 2.

37. An image forming apparatus, comprising:

a rotatable image carrier;

a driver which drives said image carrier;

an image carrier driving member for transmitting a driving force received from said driver at an image carrier driving position to said image carrier;

a latent image forming unit for forming a latent image on said image carrier at a latent image forming position;

a developer for developing the latent image on said image carrier to form a developed image;

a transfer member to which the developed image on said image carrier is transferred at a transferred at a transferring position; and a transfer member conveying unit for receiving driving force from said image carrier driving member at a transfer driving position to convey said transfer member, wherein a time during which said image carrier moves from the latent image forming position to the transferring position is substantially equal to a time during which said image carrier driving member moves from the image carrier driving position to the transfer driving position.

38. An image forming apparatus, comprising:

an image carrier;

a latent image forming unit for forming a latent image on said image carrier;

a developer for developing the latent image on said image carrier with toner;

a primary transfer unit for transferring the toner images on said image carrier to an intermediate transfer belt one after another;

a secondary transfer unit for transferring the toner images laid on said intermediate transfer belt to a recording member altogether;

a driving source for driving said image carrier;

a first drive transmitter for transmitting driving force of said driving source to said image carrier to drive said image carrier; and a second drive transmitter for transmitting driving force of said image carrier to said intermediate transfer belt to drive said intermediate transfer belt in synchronism with said image carrier, wherein said second drive transmitter is disposed on the downstream side of said primary transfer unit with respect to the direction in which said intermediate transfer belt is conveyed.

39. An image forming apparatus, comprising:

an image forming apparatus body;

an image carrier provided in said image forming apparatus body;

latent image forming unit for forming a latent image corresponding to each color component on said image carrier;

a plurality of developers for developing the latent image on said image carrier by toner corresponding to each color component;

an intermediate transfer body;

primary transfer unit for transferring the toner images on said image carrier one after another to said intermediate transfer body;

secondary transfer unit for transferring the multi-color image formed on said intermediate transfer body altogether to a recording member conveyed from a recording member storage unit;

fixer which fixes said multi-color image to the recording member;

a first recording member conveying path for conveying the recording member in the recording member storage unit from said secondary transfer unit to said fixer; and wherein a second recording member conveying path for discharging the recording member conveyed from said fixer out of said image forming apparatus body; said latent image forming unit being disposed on the back side of said image forming apparatus body; and said image carrier, said developers and the recording member storage unit being attachable and removable in substantially the same direction at the front side of said image forming apparatus body and said direction being a direction vertical to an axis of said image carrier.

40. An image forming apparatus, comprising:

a latent image carrier on which a latent image is formed;

a plurality of developing units for developing the latent image on said latent image carrier;

driving motors for driving said developing units; and a plurality of developing unit moving units for moving respective ones of said developing units to a development position and a standby position.

41. An image forming apparatus, comprising:

a latent image carrier on which a latent image is formed;

a plurality of developing units for developing the latent image on said latent image carrier;

a plurality of developing unit moving units for moving respective ones of said developing units to a developing position where said developing units are adjacent to said latent image carrier and a standby position where said developing units are separated from said latent image carrier;

driving motors for driving said developing unit moving units; and selective driving unit which selectively drives one of said developing unit moving units selected among said plurality of developing unit moving units by driving said driving motor forward or backward.

42. A rotation transmitting unit for transmitting a turning force from a drive source to a member to be driven, comprising:

an input shaft for obtaining the turning force from the driving source;

an output shaft for transmitting the turning force to the member to be driven;

transmitter interposed between said input shaft and said output shaft for transmitting the turning force intermittently from the driving source to the member to be driven; and controller which controls said transmitter, wherein said rotation transmitting unit is arranged such that one turn of said transmitter is divided into n parts ($\theta_n$, $\theta_{n-1}$, $\theta_2$, $\theta_1$) and the turning force is transmitted from said input shaft to said output shaft sequentially by each partial angle as pulse is input by said controller, wherein said partial angle is represented by the following relational equation:

$$\sum_{1}^{n} \theta i = 360°$$

said controller being capable of outputting the pulse at any timing and outputting a signal having a pulse width corresponding to an angle of revolution "a" represented by a relational equation of $\alpha<\theta_{min}$ (where, $\theta_{min}$ is a minimum partial angle among each partial angle of $\theta_1$ to $\theta_n$).

* * * * *